US009830776B2

(12) United States Patent
Colvin et al.

(10) Patent No.: US 9,830,776 B2
(45) **Date of Patent: *Nov. 28, 2017**

(54) SYSTEMS AND GAMING DEVICES FOR INDICATING COMP ELIGIBILITY

(71) Applicant: Gaming Arts, LLC, Las Vegas, NV (US)

(72) Inventors: David Colvin, Las Vegas, NV (US); Eric D. Colvin, Las Vegas, NV (US)

(73) Assignee: Gaming Arts, LLC, Las Vegas, NV (US)

( * ) Notice: Subject to any disclaimer, the term of this patent is extended or adjusted under 35 U.S.C. 154(b) by 402 days.

This patent is subject to a terminal disclaimer.

(21) Appl. No.: 14/514,722

(22) Filed: Oct. 15, 2014

(65) Prior Publication Data

US 2015/0031444 A1 Jan. 29, 2015

Related U.S. Application Data

(63) Continuation-in-part of application No. 14/023,856, filed on Sep. 11, 2013, which is a continuation-in-part of application No. 13/788,013, filed on Mar. 7, 2013.

(Continued)

(51) Int. Cl.
*G07F 17/32* (2006.01)

(52) U.S. Cl.
CPC ..... *G07F 17/3255* (2013.01); *G07F 17/3232* (2013.01); *G07F 17/3234* (2013.01);
(Continued)

(58) Field of Classification Search
CPC ..... G07F 17/3255
See application file for complete search history.

(56) References Cited

U.S. PATENT DOCUMENTS 4,378,940 A 4/1983 Gluz
4,475,157 A 10/1984 Bolan
(Continued)

FOREIGN PATENT DOCUMENTS

EP 1377349 A1 1/2004
EP 1418994 A1 5/2004
(Continued)

OTHER PUBLICATIONS

Final Office Action (U.S. Appl. No. 13/788,050); dated Feb. 25, 2016.

(Continued)

*Primary Examiner* — Steven J Hylinski
(74) *Attorney, Agent, or Firm* — Brooks Kushman P.C.

(57) ABSTRACT

Systems and methods provide a comp policy associated with a game of chance. A gaming device includes a processor programmed to present the game of chance to a player, wherein gameplay data is generated during play of the game of chance. The gaming device also includes a user interface device configured to receive input from the player to enable the player to play the game of chance, and a comp indicator configured to provide an indication if the player is determined to be eligible for a comp. A computing device is coupled to the gaming device. The computing device is configured to receive the gameplay data from the gaming device, determine whether the player is eligible for the comp based on the gameplay data, and transmit data representative of whether the player is determined to be eligible for the comp to the gaming device.

65 Claims, 15 Drawing Sheets

Related U.S. Application Data

(60) Provisional application No. 61/698,963, filed on Sep. 10, 2012.

(52) U.S. Cl.
CPC ..... *G07F 17/3239* (2013.01); *G07F 17/3241* (2013.01); *G07F 17/3244* (2013.01); *G07F 17/3262* (2013.01); *G07F 17/3267* (2013.01); *G07F 17/3286* (2013.01); *G07F 17/329* (2013.01)

(56) References Cited

U.S. PATENT DOCUMENTS 4,651,995 A 3/1987 Henkel
4,661,906 A 4/1987 DiFrancesco
4,768,151 A 8/1988 Birenbaum
5,718,631 A 2/1998 Invencion
5,813,911 A 9/1998 Margolin
5,967,895 A 10/1999 Kellen
6,048,269 A 4/2000 Burns
6,398,645 B1 6/2002 Yoseloff
6,398,646 B1 6/2002 Wei
6,514,140 B1 2/2003 Storch
6,645,072 B1 11/2003 Kellen
6,645,077 B2 11/2003 Rowe
6,656,045 B2 12/2003 Wei
6,729,957 B2 5/2004 Burns
6,776,715 B2 8/2004 Price
6,852,031 B1 2/2005 Rowe
7,118,477 B1 10/2006 Kellen
7,335,106 B2 2/2008 Johnson
7,357,715 B2 4/2008 Kane
7,438,640 B2 10/2008 Amour
7,537,521 B2 5/2009 Amour
7,614,948 B2 11/2009 Saffari
7,749,067 B2 7/2010 Frain
7,753,781 B2 7/2010 Storch
7,815,502 B2 10/2010 Hardy
7,862,427 B2 1/2011 Nguyen
7,874,907 B2 1/2011 Lozano
7,887,420 B2 2/2011 Nguyen
7,892,085 B2 2/2011 Harris
7,946,915 B2 5/2011 Cannon
7,951,004 B2 5/2011 Saffari
7,959,509 B2 6/2011 Saffari
7,980,942 B2 7/2011 Kane
7,980,943 B2 7/2011 McGlone
7,985,130 B2 7/2011 Lind
8,021,230 B2 9/2011 Baerlocher
8,025,561 B2 9/2011 Reddicks
8,070,579 B2 12/2011 Bienvenue
8,100,758 B2 1/2012 Walker
8,109,828 B2 2/2012 Kane
8,201,827 B2 6/2012 Weingardt
8,579,709 B2 11/2013 Saffari
8,821,255 B1 * 9/2014 Friedman ..... G07F 17/32 463/25
2002/0137217 A1 9/2002 Rowe
2002/0169021 A1 * 11/2002 Urie ..... G07F 17/32 463/25
2002/0177478 A1 11/2002 Glasson
2003/0036425 A1 * 2/2003 Kaminkow ..... G06Q 20/3433 463/25
2003/0040354 A1 2/2003 Itkis
2003/0045341 A1 3/2003 Itkis
2003/0045342 A1 3/2003 Miller
2003/0144050 A1 7/2003 Keaton
2003/0148808 A1 8/2003 Price
2004/0038736 A1 * 2/2004 Bryant ..... G07F 17/3244 463/29
2004/0048671 A1 3/2004 Rowe
2004/0082384 A1 * 4/2004 Walker ..... G07F 17/32 463/40
2004/0173965 A1 9/2004 Stanek
2004/0178579 A1 9/2004 Lowell
2004/0251628 A1 12/2004 Kilby
2004/0266509 A1 12/2004 Bennett
2005/0059468 A1 3/2005 Cannon
2005/0064932 A1 3/2005 Cannon
2005/0143166 A1 * 6/2005 Walker ..... G07F 17/3244 463/25
2005/0289056 A1 * 12/2005 Guinn ..... G06Q 20/1085 705/43
2006/0027965 A1 2/2006 Kane
2006/0046819 A1 3/2006 Nguyen
2006/0052160 A1 3/2006 Saffari et al.
2006/0073888 A1 4/2006 Nguyen et al.
2006/0128457 A1 6/2006 Cannon
2006/0151944 A1 7/2006 Jubinville
2006/0160603 A1 7/2006 Lulek
2006/0160620 A1 7/2006 Matthews
2006/0178196 A1 8/2006 Thomas
2006/0189382 A1 8/2006 Muir et al.
2006/0229124 A1 * 10/2006 Walker ..... G07F 17/32 463/20
2007/0060288 A1 3/2007 Willyard
2007/0060361 A1 3/2007 Nguyen
2007/0093285 A1 4/2007 Lee
2007/0129955 A1 * 6/2007 Dalmia ..... G06Q 20/04 705/1.1
2007/0155471 A1 7/2007 Powell
2007/0161423 A1 7/2007 Bienvenue
2007/0173313 A1 7/2007 Bienvenue
2007/0281773 A1 12/2007 Sprinkle
2007/0287533 A1 12/2007 Amour
2007/0293305 A1 12/2007 Amour
2007/0298867 A1 * 12/2007 Huang ..... G07F 17/32 463/25
2008/0026813 A1 1/2008 Cannon
2008/0070670 A1 3/2008 Brunelle et al.
2008/0076534 A1 * 3/2008 Iddings ..... G07F 17/32 463/25
2008/0102946 A1 5/2008 Amour
2008/0176627 A1 7/2008 Lardie
2008/0188308 A1 * 8/2008 Shepherd ..... G07F 17/32 463/39
2008/0220845 A1 9/2008 Kane
2008/0248865 A1 10/2008 Tedesco
2008/0287187 A1 * 11/2008 Seelig ..... G07F 17/32 463/27
2009/0098934 A1 4/2009 Amour
2009/0197664 A1 8/2009 Schultz
2009/0197684 A1 8/2009 Arezina
2009/0318231 A1 12/2009 Lange
2010/0016068 A1 1/2010 White et al.
2010/0197385 A1 8/2010 Aoki
2010/0267444 A1 10/2010 Walker et al.
2010/0304847 A1 12/2010 Bramble
2011/0028201 A1 2/2011 Warner
2011/0045889 A1 2/2011 Khal
2011/0045890 A1 2/2011 Khal
2011/0105218 A1 5/2011 Anderson
2011/0105234 A1 5/2011 Nguyen
2011/0143832 A1 6/2011 Walker
2011/0230257 A1 * 9/2011 LeBaron ..... G07F 17/32 463/25
2011/0263325 A1 10/2011 Atkinson
2011/0275430 A1 11/2011 Walker
2012/0040733 A1 2/2012 Bienvenue
2012/0122539 A1 5/2012 Khal
2012/0123915 A1 5/2012 Risnoveanu
2012/0172105 A1 7/2012 Huynh
2012/0172111 A1 7/2012 Parham
2012/0190423 A1 7/2012 Yoseloff
2012/0238342 A1 9/2012 Amour
2012/0246034 A1 9/2012 Kolios
2012/0258793 A1 10/2012 LeBaron
2012/0270631 A1 10/2012 Graves
2013/0123018 A1 5/2013 Sareli et al.
2013/0231172 A1 9/2013 Cannon
2014/0051491 A1 2/2014 Johnson

(56) References Cited

U.S. PATENT DOCUMENTS

| | | | | |
|---|---|---|---|---|
| 2014/0073393 | A1 | 3/2014 | Colvin | |
| 2014/0073394 | A1 | 3/2014 | Colvin | |
| 2014/0073395 | A1 | 3/2014 | Colvin | |
| 2014/0073396 | A1 | 3/2014 | Colvin | |
| 2014/0073397 | A1 | 3/2014 | Colvin | |
| 2014/0073398 | A1 | 3/2014 | Colvin | |
| 2014/0073399 | A1 | 3/2014 | Colvin | |
| 2014/0073400 | A1 | 3/2014 | Colvin | |
| 2014/0073401 | A1 | 3/2014 | Colvin | |
| 2014/0073402 | A1 | 3/2014 | Colvin | |
| 2014/0073418 | A1* | 3/2014 | LeMay | G07F 17/3204 463/29 |

FOREIGN PATENT DOCUMENTS

| | | | |
|---|---|---|---|
| EP | 1969570 | A2 | 9/2008 |
| EP | 1965875 | A4 | 8/2009 |
| WO | 9519207 | A1 | 7/1995 |
| WO | 2005/029425 | A1 | 3/2005 |

OTHER PUBLICATIONS

Patent Examination Report No. 1 (AU 2015201204); dated Feb. 22, 2016.
European Search Report (EP 15 16 3389); dated Jul. 17, 2015.
European Search Report (EP 13 83 4962); dated Apr. 4, 2016.
Non-Final Office Action (U.S. Appl. No. 13/788,038); dated May 10, 2016.
Non-Final Office Action (U.S. Appl. No. 13/788,055); dated Apr. 22, 2016.
Non-Final Office Action (U.S. Appl. No. 13/788,013); dated May 26, 2016.
Final Office Action (U.S. Appl. No. 14/023,856); dated Jun. 3, 2016.
High Five Bingo, "5 Types of Bingo Game" published on or before Mar. 3, 2010, printed from URL <http://web.archive.org/web/20100323032754/ http://www.high5bingo.com/5-types-of-bingo.html>, 3 pages.
Mecca Bingo published on or before Feb. 28, 2009, printed from URL <http://web.archive.org/web/20090228085104 /http://high5bingo.com/mecca-bingo.html>, 3 pages.
Non-Final Office Action (U.S. Appl. No. 13/788,061); dated Jul. 1, 2016.
Non-Final Office Action (U.S. Appl. No. 14/514,692); dated Sep. 22, 2016.
Non-Final Office Action dated Jun. 6, 2015 for U.S. Appl. No. 14/023,856, filed Sep. 11, 2013 (inventors David Colvin et al.)
Non-Final Office Action dated Apr. 17, 2015 for U.S. Appl. No. 13/788,076, filed Mar. 7, 2013 (inventors David Colvin et al.)
Video King Pick 'N Play product webpage, available at http://www.videokingnetwork.com/product.asp?id=78, visited Jan. 13, 2013.
Non-Final Office Action dated Jun. 25, 2013 for U.S. Appl. No. 13/788,045, filed Mar. 7, 2013 (inventors David Colvin et al.).
Non-Final Office Action dated Dec. 6, 2013 for U.S. Appl. No. 13/788,070, filed Mar. 7, 2013 (inventors David Colvin et al.).
Non-Final Office Action dated Dec. 20, 2013 for U.S. Appl. No. 13/788,076, filed Mar. 7, 2013 (inventors David Colvin et al.).
International Search Report and Written Opinion dated Dec. 31, 2013 for International Application No. PCT/US2013/058953 filed Sep. 10, 2013 (inventors David Colvin et al.).
Non-Final Office Action dated Feb. 27, 2014 for U.S. Appl. No. 13/788,026, filed Mar. 7, 2013 (inventors David Colvin et al.).
Non-Final Office Action dated Jul. 3, 2014 for U.S. Appl. No. 13/788,013, filed Mar. 7, 2013 (inventors David Colvin et al.).
Non-Final Office Action dated Jul. 3, 2014 for U.S. Appl. No. 13/788,018, filed Mar. 7, 2013 (inventors David Colvin et al.).
Non-Final Office Action dated Jul. 3, 2014 for U.S. Appl. No. 13/788,038, filed Mar. 7, 2013 (inventors David Colvin et al.).
Non-Final Office Action dated Jul. 3, 2014 for U.S. Appl. No. 13/788,050, filed Mar. 7, 2013 (inventors David Colvin et al.).
Non-Final Office Action dated Jul. 3, 2014 for U.S. Appl. No. 13/788,055, filed Mar. 7, 2013 (inventors David Colvin et al.).
Non-Final Office Action dated Jul. 3, 2014 for U.S. Appl. No. 13/788,061, filed Mar. 7, 2013 (inventors David Colvin et al.).
Non-Final Office Action dated Jul. 24, 2014 for U.S. Appl. No. 13/788,065, filed Mar. 7, 2013 (inventors David Colvin et al.).
Final Office Action dated Jul. 25, 2014 for U.S. Appl. No. 13/788,076, filed Mar. 7, 2013 (inventors David Colvin et al.).
Final Office Action dated Aug. 29, 2014 for U.S. Appl. No. 13/788,070, filed Mar. 7, 2013 (inventors David Colvin et al.).
Beverage Ordering Service System webpage, Bally Technologies, available at http://www.ballytech.com/systems/marketing/Boss (last visited Oct. 7, 2014).
Video: Beverage Ordering Service System (BOSS) from Bally Technologies, available at http://www.youtube.com/watch?v=NbcxuOUx62s (published Sep. 23, 2013).
Video: Beverage Ordering Service System—Patron Experience from Bally Technologies, available at http://www.youtube.com/watch?v=oPQlq2rZJ90 (published Sep. 23, 2013).
Final Office Action dated Nov. 3, 2014 for U.S. Appl. No. 13/788,026, filed Mar. 7, 2013 (inventors David Colvin et al.).
Non-Final Office Action (U.S. Appl. No. 13/788,018, filed Mar. 7, 2013); dated Jan. 12, 2016.
Non-Final Office Action (U.S. Appl. No. 13/788,065, filed Mar. 7, 2013); dated Jan. 12, 2016.
Final Office Action (U.S. Appl. No. 13/788,076, filed Mar. 7, 2013); dated Dec. 29, 2015.

* cited by examiner

1300

COMP ACCOUNTABILITY REPORT

Date: March 1, 2014 Shift: Swing Time: 22:17 F&B Manager: Bill Jones Slot Manager on Duty: Christy Johnson Server Name: Julie Smith Server Employee Number: 707111 TOTAL ERROR RATE: 1.4% 1320

| Time | Player Name | Player Number | Player Comp Rating | Machine No. | Comp Amt | In Policy | Out of Policy | Total Error |
|---|---|---|---|---|---|---|---|---|
| 20:03 | Phil Pateni | 00254998 | 3 | 1645 | 2 | ✓ | | 0 |
| 20:07 | Uncarded | - | - | 1701 | 5 | | ✓ | 5 |
| 20.08 | Robert Jones | 00025894 | 2 | 1699 | 3 | ✓ | | 0 |
| 20:13 | Sue Best | 00875992 | 5 | 1702 | 5 | ✓ | | 0 |
| 20:15 | Uncarded | - | 1 | 1598 | 2 | ✓ | | 0 |
| 20:18 | Ed Albertson | 01289666 | 6 | 1609 | 3 | | ✓ | 3 |
| 20:26 | Jean Shiano | 00928052 | 4 | 1608 | 2 | | ✓ | 2 |
| 20:27 | Tony Dennison | 00872256 | 2 | 1578 | 4 | ✓ | | 0 |
| 20:27 | Janice Green | 02368999 | 2 | 1648 | 2 | ✓ | | 0 |
| 20:33 | Sam Roth | 00689585 | 5 | 1688 | 5 | ✓ | | 0 |
| 20:34 | Ted Dawson | 00448587 | 5 | 1625 | 4 | ✓ | | 0 |

1304 1306 1308 1310 1312 1314 1316 1318

1302

FIG. 13

SYSTEMS AND GAMING DEVICES FOR INDICATING COMP ELIGIBILITY

CROSS REFERENCE TO RELATED APPLICATIONS

This application is a continuation-in-part of U.S. application Ser. No. 14/023,856 filed on Sep. 11, 2013, which is a continuation-in-part of U.S. application Ser. No. 13/788,013 filed on Mar. 7, 2013, which in turn claims the benefit of U.S. Provisional Application Ser. No. 61/698,963 filed Sep. 10, 2012, the disclosures of which are hereby incorporated by reference in their entirety.

BACKGROUND

Embodiments of the present disclosure relate to systems and gaming devices for indicating eligibility for one or more complimentary benefits, generally referred to as "comps."

Many casinos and other gaming establishments invest significant amounts of money to bring players into the casinos and encourage the players to spend money in the casinos, such as by playing games of chance in the casinos. Generally speaking, the longer the players remain in the casino and play games therein, the more money the casinos expect to earn.

To encourage the players to stay and play games in a particular casino, at least some casinos offer the players "comps," such as free beverages, free meals, or free rooms depending on the amount of money the player is spending in the casino. To justify the cost of providing the comps, casino personnel typically monitor the amount of money the player is spending and give increasingly valuable comps as the player's spending increases. However, monitoring the player's spending may be time-consuming for casino personnel, and the casino personnel may only be able to estimate the amount of money the player has spent. In addition, miscommunication may occur between casino personnel such that players may receive comps more frequently than desired from the casino's perspective based on the player's spending. On the other hand, players may feel that the amount of money they have spent has gone unnoticed by casino personnel. Therefore, the players may believe that they deserve more comps than are being provided by the casino. Likewise, the players may not know how much they are spending and may not know when comps may be available based on their gameplay.

In addition, casino personnel may not adequately follow a casino's comp policy. For example, casino personnel may give unearned comps to players to increase the amount of tips the players give the casino personnel. The unearned comps may end up costing the casino significant amounts of money over time.

BRIEF SUMMARY

In one embodiment, a system is provided that includes a gaming device. The gaming device includes a processor programmed to provide a game of chance to a player, wherein gameplay data is generated during play of the game of chance. The gaming device also includes an electronic storage device configured to store gameplay data for the game of chance, a user interface device configured to receive input from the player to enable the player to play the game of chance, a payment input device configured to enable the player to input money or credits for use in the game of chance, and a payment output device configured to enable the player to withdraw money or credits from the gaming device. The gaming device further includes a card reader device configured to receive data from a player reward card and a randomization device configured to randomly determine a game outcome for the game of chance. A comp indicator is attached to or integrated with the gaming device. The comp indicator is configured to provide an indication if the player is determined to be eligible for a comp. The system also includes a computing device coupled to the gaming device. The computing device is configured to receive the gameplay data from the gaming device, determine whether the player is eligible for the comp based on the gameplay data, and transmit data representative of whether the player is determined to be eligible for the comp to the gaming device.

In another embodiment, a method of administering a comp policy is provided. The method includes presenting a game of chance to a player on a gaming device, enabling the player to input money or credits for use in the game of chance using a payment input device of the gaming device, enabling the player to withdraw money or credits from the gaming device using a payment output device of the gaming device, and providing a comp indicator attached to or integrated within the gaming device, wherein the comp indicator is configured to provide an indication if the player is determined to be eligible for a comp. The method also includes generating gameplay data associated with the game of chance for the player using the gaming device, receiving input from the player at the gaming device to enable the player to play the game of chance, and randomly determining a game outcome for the game of chance using a randomization device. The method also includes transmitting the gameplay data from the gaming device to a computing device, determining, by the computing device, whether the player is eligible for the comp based on the gameplay data, and transmitting data representative of whether the player is determined to be eligible for the comp from the computing device to the gaming device.

In yet another embodiment, a gaming device is provided that includes a processor programmed to provide a game of chance to a player and to determine whether the player is eligible for a comp. The gaming device also includes an electronic storage device configured to store gameplay data for the game of chance, a user interface device configured to receive input from the player to enable the player to play the game of chance, a payment input device configured to enable the player to input money or credits for use in the game of chance, and a payment output device configured to enable the player to withdraw money or credits from the gaming device. The gaming device further includes a card reader device configured to receive data from a player reward card, a randomization device configured to randomly determine a game outcome for the game of chance, and a comp indicator configured to be activated upon a determination that the player is eligible for a comp.

BRIEF DESCRIPTION OF THE DRAWINGS

FIG. 13 is an exemplary compliance report that may be generated for one or more personnel of the gaming systems of FIG. 1 or 2 or the gaming system of FIG. 11.

DETAILED DESCRIPTION

Figure 1:
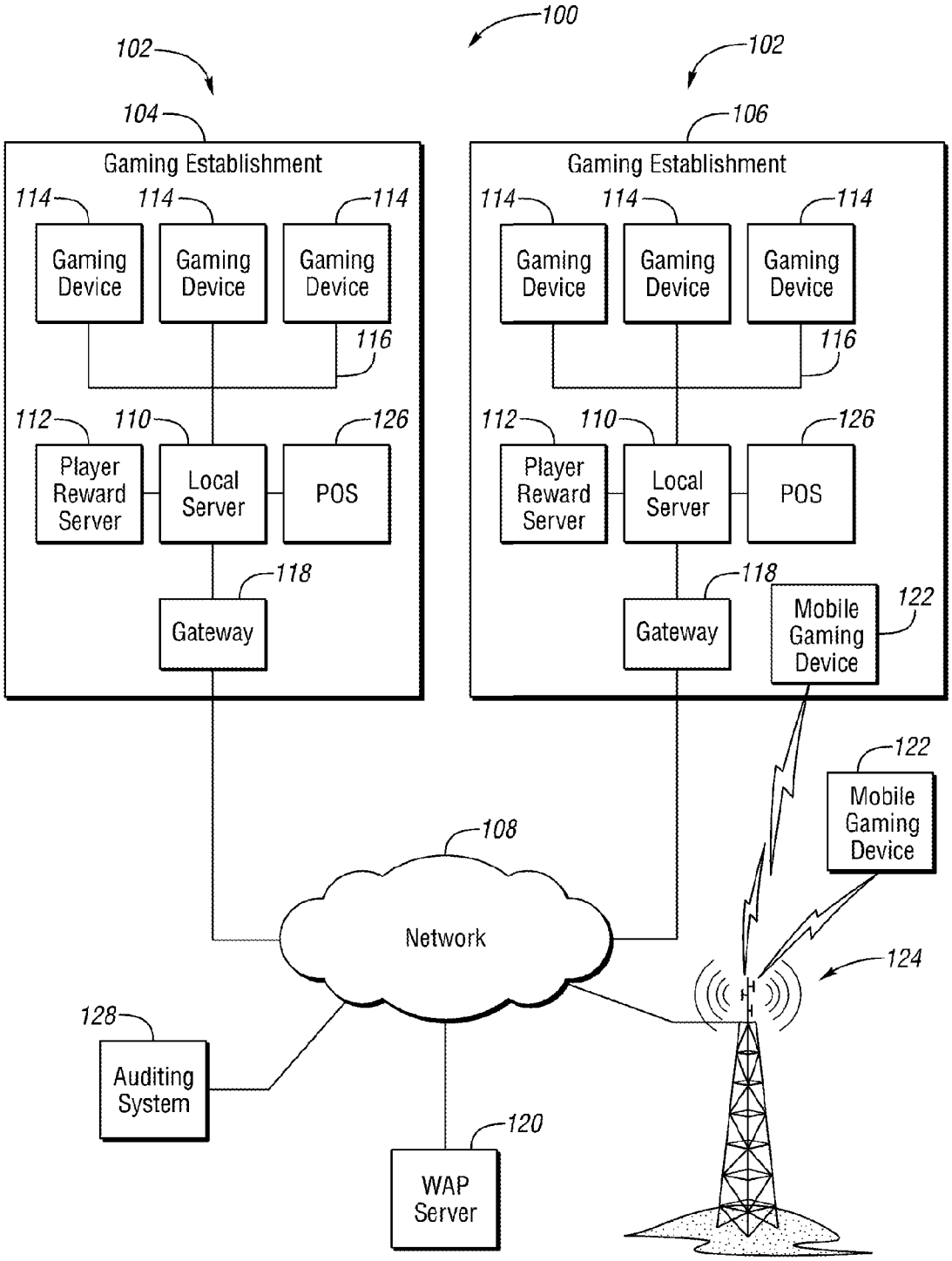
FIG. 1 is a block diagram of a system that may be used to play a game of chance.

Systems and methods for indicating eligibility of a player of a game of chance to receive one or more comps are described herein. In one embodiment, a plurality of gaming devices are connected to one or more servers over a network, such as a wide area network (WAN) and/or a local area network (LAN). In one embodiment, the gaming devices are electronic gaming machines (EGMs), otherwise known as "slot machines." These may be classified as Class II, Class III, video lottery terminals (VLT), or the like. EGMs may present either one or a plurality of games to the player such as video reels, video poker, video keno, video bingo, and the like. In another embodiment, the gaming devices are gaming kiosks or terminals. Alternatively, the gaming devices may include, for example, cellular phones, laptop or desktop computers, and/or any other suitable devices. The servers may include one or more local servers within a gaming establishment and/or one or more wide area progressive (WAP) servers connected to the local servers and/or to the gaming devices through the network.

In one embodiment, each gaming device presents either one or a plurality of games of chance to a player to enable the player to select and play the games of chance. In addition, each gaming device may include a randomization device, such as a random number generator (RNG) and/or a permutation generator, that is used to play a selected game on the gaming device. The randomization device may be used to randomly determine a game outcome for the game of chance. For example, if the player selects a game of bingo to be played on a gaming device, the gaming device uses the randomization device to select a plurality of house indicia from a pool of 75 indicia (or from a different sized pool) to be used during the game. In another embodiment, at least some aspects of the game are provided by one or more servers, such as a local server, a wide area server, a local area progressive server (LAP), or a wide area progressive server (WAP). The server or servers may include a randomization device for randomly selecting the house indicia in the bingo game.

In the example of a video poker game, either one or a plurality of games are presented to the player. After game selection and wagering, a number of playing cards, generally selected from a 52 card deck, are distributed to the player. In the case of draw poker or its many variants, the player selectively chooses to retain one or more of the original cards dealt and to discard those cards not chosen to be retained. The discarded cards are then replaced by new cards. If the player obtains a predefined winning combination of cards, the player wins an amount associated with the particular combination of cards.

In the example of mechanical, electromechanical, or video reel machines, the games may include a number of mechanical or simulated rotating reels that are arranged in a horizontal configuration forming columns. One or a number of rows are presented to the player to allow for one or many different winning pay lines. Pay lines may be straight across or designed in any convenient fashion. A typical game many include five reels or columns and three or four rows or the like.

In the example of the bingo game, the house indicia are compared to a plurality of player indicia that are included within a pattern selected for one or more player cards. If at least some of the player indicia within the pattern are matched by the house indicia, the player may win a prize based on the number of house indicia that have been matched and an associated pay table.

In the example of a keno game or a keno-related game of chance, the gaming device uses the randomization device to randomly select a plurality of house indicia in a similar manner as described with respect to the game of bingo. However, the house indicia are typically randomly selected, or called, from a pool of 80 house indicia, although other sizes of house indicia pools may be used. The called house indicia are compared to a plurality of player indicia to determine how many player indicia are matched by the house indicia and may be irrespective of a pattern of the player indicia. The embodiments described herein may include allowing the player to select the number of and specific player indicia to be utilized for a keno game or may include an automated or quick pick selection. For example, a player may select one player indicia or spot to play a 1 spot game, 2 player indicia or spots for a 2 spot game, 3 player indicia or spots for a 3 spot game, etc. Embodiments may also require a minimum number of player indicia or spots for a game. For example, a 10 player indicia or 10 spot game may require a minimum of 5 player indicia or spots. Embodiments may also include a maximum number of player indicia or spots that are playable. For example, in an 80 number game, the maximum number of house indicia or spots selectable by the player may be confined to 20 numbers or less or a 20 number game or less. Accordingly, in an 80 number game, the minimum number of player indicia or spots may be 5 and the maximum player indicia or spots may be 20. The player may win one or more prizes based on the number of player indicia matched by the called house indicia.

In the example of sports wagering, a player may be seated in a player area that may include a betting terminal which includes a monitor and input means. A player may make or place periodic wagers on a variety of sporting events.

As the player plays the games, the gaming device and/or a server or another computing device tracks data representative of the gameplay of the player (referred to herein as "gameplay data"), such as a theoretical win or loss, a past history, wager amounts, a number of plays per hour, wager amounts relative to an amount of time spent playing games on the gaming device, a number of wins or losses of the player, a cumulative amount wagered by the player, an amount of money won or lost by the player, and/or any other suitable data. The gameplay data is used to determine whether the player is eligible to receive a comp. The comp may include, for example, one or more free beverages, free meals, free tickets, reduced price meals or tickets, and/or the like.

In one embodiment, a comp indicator is included within, attached to, or displayed on the gaming device. The comp indicator may be energized or activated in any conventional way to indicate status including displaying on the game monitor, player tracking module or the like. The comp indicator is used to display to the player and/or to gaming establishment employees whether the player is eligible to receive the comp. If the gameplay data indicates that the player has reached a predetermined threshold of play and/or wagering activity, for example, the player is determined to be eligible to receive the comp. The comp indicator may then be activated to notify the player and/or gaming establishment employees that the player is eligible to receive the comp. The comp indicator activation may include any suitable means for displaying comp status, comp eligibility, change in comp status, incremental progress toward comps, continual progress toward comps, reduction in comp status after awarding of comps, etc., and may include any visual or sensory indicator or indication. Gaming establishment employees may then take action in response to the notification, such as by awarding the comp to the player. While the comp indicator is sometimes described as being a visual indicator, it should be recognized that the comp indicator may notify the player and/or gaming establishment employees using any suitable sensory perception.

A technical effect of the systems and methods described herein includes one or more of: (a) presenting a game of chance to a player on a gaming device; (b) enabling the player to input money or credits for use in the game of chance using a payment input device of the gaming device; (c) enabling the player to withdraw money or credits from the gaming device using a payment output device of the gaming device; (d) providing a comp indicator attached to or integrated within the gaming device, wherein the comp indicator is configured to provide an indication if the player is determined to be eligible for a comp; (e) generating gameplay data associated with the game of chance for the player using the gaming device; (f) receiving input from the player at the gaming device to enable the player to play the game of chance; (g) randomly determining a game outcome for the game of chance using a randomization device; (h) transmitting the gameplay data from the gaming device to a computing device; (i) determining, by the computing device, whether the player is eligible for the comp based on the gameplay data; and (j) transmitting data representative of whether the player is determined to be eligible for the comp from the computing device to the gaming device.

Comp monitoring or accounting may also be monitored locally or remotely by management to insure proper compliance. Systems and methods described herein may be self-contained within a gaming device or may reside in a server-based system such as a slot accounting system (SAS).

As used herein, a "game of chance" or "game" refers to an electronic game that is played by a player in which an outcome of the game of chance is at least partially based on chance or a random selection of game components. A game may be categorized by a game variety and/or a game size, for example. It should be recognized by those of ordinary skill in the art that the term "random" is not limited to true randomness, such as truly random numbers. Rather, pseudorandom numbers and pseudorandom algorithms are included within the meaning of "random." In addition, those of ordinary skill in the art will recognize that permutation generators may additionally or alternatively be used to generate player card indicia or other game components.

Gaming devices described herein may use real money for play, or may utilize a credit-based system in which the credits used for the games do not have a cash value. Similarly, prizes for the games may be in the form of credits, cash, and/or physical prizes such as televisions, automobiles, or the like.

The play of a game, or the gameplay, includes the drawing or selection of a plurality of house indicia after one or more player cards have been selected. The house indicia are drawn or selected until a game ending criteria is met. The game ending criteria may include, for example, the matching of a pattern on the player card, or the drawing or selection of a predetermined maximum number of house indicia. It should be recognized that other suitable game ending criteria may be used to end the play of the game.

As used herein, the term "player indicia" refers to indicia, such as objects, graphics, symbols, numbers, letters, or the like, that are printed on, displayed on, or otherwise associated with a player card used by the player to play a game of chance. In at least some embodiments, the player may select one or more player indicia for each player card.

The term "house indicia" or "game indicia" refers to indicia generated, called, or otherwise selected by a gaming establishment or an operator of the game. In one embodiment, house indicia are compared to player indicia on each player card to determine if each player card satisfies one or more winning conditions.

The term "ball call" refers to a random selection of house indicia in connection with a game of chance. The terms "select," "draw," "call," "determine," and "generate" are used interchangeably with respect to the selection of house indicia, numbers, or balls in a game. A ball call may include drawing or receiving a random ball with a number indicated on the ball, or may more generally refer to a random selection of a number or another suitable house indicia using a randomization device. A "ball," as used herein, may be a round plastic, wood, or glass spherical object with a number or other indicia displayed thereon, or may be an electronic representation of a spherical object with a number or other indicia displayed thereon. It should be recognized that the term "ball" may also include non-spherical objects or electronic representations, such as cubes, electronic images, and/or the numbers or indicia by themselves.

As used herein, the term "pattern" refers to a predetermined combination of spaces of a player card. In at least some embodiments, a winning combination is satisfied if player indicia included within the spaces associated with a pattern are matched to house indicia called during the game.

As used herein, the term "the house" refers to a game operator or a gaming establishment operator. For example, if a game is operated within or by a casino, the casino may be referred to as the house. Alternatively, the house may refer to a software application contained within a mobile device, such as a cell phone or a tablet computing device, that operates the game on the mobile device.

As used herein, the term "fixed prize" or "fixed payout" refers to a prize or payout that is a predetermined multiple of an amount wagered on the game, or that is a fixed amount regardless of the amount wagered. The fixed prizes or payouts are typically listed on a pay table associated with the game.

In contrast, progressive prizes or payouts are prizes or payouts in which at least a portion of the payout or prize increases or changes based on the amounts wagered by the players who are playing the game to win the progressive prize.

Any suitable game of chance may be played that operates according to the described embodiments. Example games of chance playable according to the disclosure herein include video poker, video reel slots, a traditional keno game, a traditional bingo game, a Vegas Numbers® game, a Nevada Numbers® game, a Super Flashboard® game, a Pattern Bingo™ game, and sports betting. However, it should be emphasized that these games are merely exemplary, and any other suitable game may be played as described herein.

In a Vegas Numbers® game, the player may select between 1 and 10 player indicia from a pool of 80 indicia for one or more player cards. In addition, 20 house indicia are drawn from the pool of 80 indicia. The house indicia are compared to the player selected indicia. Prizes are awarded based on a number of player indicia that match the selected house indicia, regardless of whether a pattern of player indicia is matched. In one embodiment, a progressive prize may be awarded as one or more of the prizes. The prizes and/or the game may be linked or shared among other gaming devices or locations so that any one of the gaming devices may win one or more of the prizes, such as the progressive prize.

In a Nevada Numbers® game, the player may select 5 player indicia out of a pool of 80 indicia for one or more player cards. In addition, 5 house indicia are drawn from the pool of 80 indicia. The house indicia are compared to the 5 player selected indicia. Prizes are awarded based on a number of player indicia that match the selected house indicia, regardless of whether a pattern of player indicia is matched. A progressive prize may be awarded as one or more of the prizes. The prizes and/or the game may be linked or shared among other gaming devices or locations so that any one of the gaming devices may win one or more of the prizes, such as the progressive prize.

In a Super Flashboard® bingo game, the player may select between 5 and 10 player indicia out of a pool of 75 indicia for one or more player cards. In addition, 24 house indicia are drawn from the pool of 75 indicia. The house indicia are compared to the player selected indicia. Prizes are awarded based on a number of player indicia that match the selected house indicia, regardless of whether a pattern of player indicia is matched. A progressive prize may be awarded as one or more of the prizes. The prizes and/or the game may be linked or shared among other gaming devices or locations so that any one of the gaming devices may win one or more of the prizes, such as the progressive prize.

In the Pattern Bingo™ game, the player may select any number of player indicia from a pool of 75 indicia for one or more player cards. The player may also select one or more patterns of player indicia to be matched and may also select the player indicia within each pattern. A predetermined number of house indicia, such as 48 house indicia, are drawn from the pool of 75 indicia. The house indicia are compared to the player selected indicia. Prizes are awarded based on whether the pattern or patterns of player indicia are matched by the selected house indicia. A progressive prize may be awarded as one or more of the prizes. The prizes and/or the game may be linked or shared among other gaming devices or locations so that any one of the gaming devices may win one or more of the prizes, such as the progressive prize.

A "local game" is a game that is played by players within a predetermined location, such as within a single gaming establishment, or players playing the game across a local area network. A "local prize" or a "local payout" (including a local progressive prize or a local progressive payout) is a prize that may be won during a local game.

In some embodiments, different groups of players may qualify to compete to win different prizes. For example, a first group of players positioned in a gaming establishment may be able to compete to win one or more local prizes (e.g., progressive prizes and/or pari-mutuel prizes) while a second group of players may not be able to compete to win those prizes, for example, if the second group of players is positioned outside of the gaming establishment. However, the first group of players and the second group of players may be able to compete to win one or more other shared or common prize, such as one or more progressive and/or pari-mutuel prizes administered over a wide area network.

An "individual prize" is a prize that is only awarded to a player of an individual gaming device. For example, if a group of players are playing a game over a network, the game may provide one or more individual prizes that are tied to a single gaming device such that the individual prizes are only able to be won by the player of the gaming device. Individual prizes are sometimes referred to as gaming device specific player prizes because the individual prizes are specific to a player's gaming device. Accordingly, while a plurality of players may play to win one or more shared or common progressive prizes and/or pari-mutuel prizes, each player is prevented from winning individual prizes associated with, or "tied to," any other player's gaming device.

As used herein, the terms "connect" and "couple" are not limited to only including direct connections. Rather, unless otherwise specified, indirect connections are included within the definitions of "connect" and "couple." For example, two devices may be considered to be connected together even if there are other devices or components connected between the two devices. Any suitable means to connect or couple devices or components together may be used.

A player reward card refers to a physical or electronic card, token, or other device or data that enables a system to identify a player in connection with, among other things, a reward program or campaign. Accordingly, the player reward card may serve to identify the player and may enable gameplay, credits, funds, or other data to be associated with the player.

A player card refers to a card that may be used by the player to play bingo or another game of chance. The player card typically includes a plurality of spaces that may display or include player indicia. The player card may be an electronic card that is transmitted to a device or generated by a device that the player is using to play the game of chance. Alternatively, the player card may be manufactured from paper, cardboard, cardstock, plastic, and/or any other suitable material.

Methods described herein may be embodied within a plurality of instructions stored within a memory device of a computing device. Moreover, a processor of the computing device, or of a computing device coupled to the memory device, executes the instructions to perform the functions described herein and/or to cause the functions described herein to be performed. The instructions may be grouped together to form one or more computer-readable program modules.

Computing devices typically include at least one processor and at least one memory device. The processor may be, without limitation, an x86-based logic circuit, an ARM-based logic circuit, and/or a system-on-a-chip circuit. It should be recognized that these examples are non-limiting, and a variety of other programmable circuits may be included within the definition of "processor." The memory device may include random access memory (RAM), flash memory, read-only memory (ROM), hard disk drives, magnetic-based memory, and/or any other form of computer-readable memory.

A desktop computer is one example of a computing device. Other examples of computing devices include, without limitation, electronic gaming machines (also known as slot machines), kiosks, cell phones, tablets, PDAs, laptop computers, and smart watches. It should be recognized that computers or computing devices may be implemented as one or more virtual machines, virtual servers, and/or any other virtual device. A server is another type of computing device that may receive network connections from a computer or a plurality of computers or other computing devices.

As used herein, the term "module" or "program module" refers to a computer program, dataset, and/or instruction set that, when executed by a processor, performs the functions described herein. In one embodiment, the module may be included within a computer program, or may be connected to a computer program in any suitable manner. Any computer readable instructions may be programmed or hard-coded in a device, such as a gaming device, in any suitable manner.

FIG. 1 is a block diagram of a system 100 that may be used to play one or more games of chance, such as video poker, video slots, sports betting, bingo or keno. The games of chance may be played by a player against other players, or may be played by the player against the house.

System 100 is operated using components and devices within one or more gaming establishments 102, such as a first gaming establishment 104 and a second gaming establishment 106. It should be recognized that any suitable number of gaming establishments 102 may be provided within system 100. Accordingly, system 100 is not limited to including two gaming establishments 102 as illustrated in FIG. 1. In one embodiment, gaming establishments 102 are locations in which devices (e.g., gaming devices) that play or operate at least a portion of the game of chance are located. For example, gaming establishments 102 may be casinos, racetracks, bingo halls, keno parlors, or any other establishments. In another example, gaming establishments 102 may be residences or businesses in which one or more devices are located for playing or operating the game of chance. Gaming establishments 102 may additionally or alternatively include any combination of the examples described herein.

In one embodiment, gaming establishments 102 are physically remote from each other and are communicatively connected to at least one network 108, such as a wide area network (WAN), a metropolitan area network (MAN), and/or the Internet, for example. Alternatively, gaming establishments 102 may be separate rooms or sections of a casino or another facility that are communicatively connected together by network 108. It should be recognized that network 108 may be a wired Ethernet network, a wireless Ethernet network, a combination of wired and wireless Ethernet networks, or any other suitable wired and/or wireless network.

In one embodiment, each gaming establishment 102 includes a local game server 110 (referred to herein as a "local server") and a player reward server 112. Local server 110 and player reward server 112 may alternatively be implemented as or within a single server. Local server 110 is coupled to a plurality of gaming devices 114 through an internal network 116, such as a private local area network (LAN) within gaming establishment 102, for example. Gaming devices 114 may be located in separate gaming establishments 102, or within the same gaming establishment 102. In one embodiment, a gateway 118 is provided to enable local server 110 of each gaming establishment 102 to securely connect to network 108.

In one embodiment, local server 110 is a server computer (or "server") that monitors and controls the games played on gaming devices 114, including local games. In one embodiment, the local games include games that are played against the house and/or that are played against other players within gaming establishment 102.

In addition, local server 110 may administer other background tasks that enable games to be played on gaming devices 114. For example, local server 110 may facilitate authenticating gaming devices 114 and the players using gaming devices 114, and may facilitate allocating payments or credits between players and the house. Local server 110 may include payment processing capabilities to enable players to receive electronic funds from a bank or another financial institution or to deposit electronic funds to the bank or financial institution. Alternatively, the payment processing capabilities may be included in a separate server or another device that is communicatively connected to local server 110. In addition, local server 110 may interface with player reward server 112 to facilitate tracking and administering player rewards. Each gaming device 114, group of gaming devices 114, local servers 110, player reward servers 112, or the like may collect and/or generate data desired for accounting purposes, such as for use in slot accounting systems.

In one embodiment, local server 110 may enable gaming devices 114 within gaming establishment 102 to participate in one or more games that share one or more progressive or pari-mutuel prizes with other gaming establishments 102 and/or gaming devices 114. While progressive prizes are described in embodiments herein, it should be recognized that pari-mutual prizes may be substituted as desired, and vice versa. In such an embodiment, each local server 110 may be coupled to a wide area progressive (WAP) server 120 that administers the prizes. For example, WAP server 120 receives data from each local server 110 and/or from gaming devices 114 regarding an amount wagered by each player playing the game. WAP server 120 may allocate a portion of each wager to the prizes and may communicate the current prize amounts to local servers 110 and/or to gaming devices 114.

Gaming devices 114 may include one or more kiosks or electronic gaming machines (EGMs) (also known as "slot machines"). Gaming devices 114 may additionally or alternatively include one or more desktop computers or one or more mobile gaming devices 122, such as, without limitation, cellular phones, tablet computing devices, and/or laptops. Mobile gaming devices 122 may connect to local server 110, WAP server 120, and network 108 via a wireless data network represented by cell tower 124. For example, mobile gaming devices 122 may connect to any suitable network 108 (and thereby to local servers 110 and/or WAP server 120) via a "3G" or a "4G" wireless data network. It should be recognized that mobile gaming devices 122 may additionally or alternatively connect to network 108 using another suitable wireless network, such as a wireless Ethernet network. For convenience, gaming devices 114 described herein may also include mobile gaming devices 122.

One or more point-of-sale (POS) terminals 126 may also be included within each gaming establishment 102 to enable players to "cash out" winnings from one or more gaming devices 114 and/or to perform other account management activities related to player accounts. POS terminals 126 may be connected to local server 110, for example, and/or to WAP server 120 as desired.

In addition, system 100 may include an auditing system 128 coupled to WAP server 120, local server 110, and/or gaming devices 114, for example, through network 108. Auditing system 128 may be used to audit and/or track components of system 100 to ensure compliance with applicable regulations.

In one embodiment, a plurality of gaming devices 114 having different operating systems and/or system architectures may connect to local server 110 or to another suitable server to play one or more games of chance. In such an embodiment, gaming devices 114 may be used to play a session bingo game, for example, or any other game of chance.

During operation, the player utilizes or selects a gaming device 114 and initiates a gaming session for playing one or more games of chance ("games"). Optionally, the player inserts a player reward card or enters a player reward number or other identification information into gaming device 114. If the identification information is entered, gaming device 114 transmits the identification information to local server 110 for authentication, or authentication may be accomplished locally within gaming device 114. Local server 110 communicates with player reward server 112 to establish the player's identity and to associate the gameplay with the player account. Local server 110 authenticates the player and gaming device 114 and authorizes the player to play the game or games on gaming device 114 if desired or required.

When play of the game is initiated, during selection of the game, or during play of the game, the player may be required to purchase or generate credits. The player may purchase or generate credits by inserting cash or a ticket-in-ticket-out voucher into gaming device 114 or another device. Alternatively or additionally, the player may transfer credits or cash to gaming device 114 from banking accounts, credit accounts, gaming establishment accounts, and/or gaming company accounts. In one embodiment, computer-generated credits may be used with gaming device 114, for example, as part of a free-to-play game.

The player selects a game to play and enters a wager on gaming device 114. Gaming device 114 transmits data representative of the selected game and the wager to local server 110. If the player selects a game that is at least partially operated by WAP server 120 or that includes one or more progressive prizes administered by WAP server 120, local server 110 transmits the wager and game information and/or selection to WAP server 120. WAP server 120 may increment the progressive prizes based on the wager received from the player and may communicate the updated prize amounts via network 108 to all other players (via associated gaming devices 114) playing to win the progressive prizes.

The player plays the game on gaming device 114. The following gameplay is described as being administered by WAP server 120. However, it should be recognized that the gameplay (i.e., the play of the game of chance) may be alternatively or additionally administered by local server 110 and/or gaming device 114. For example, if gaming device 114 is a cellular phone or a tablet computing device, the gameplay may be administered through an application installed on gaming device 114.

In one embodiment, the player may play a game of bingo by selecting a game or game type, one or more player cards, selecting one or more winning patterns for the player cards, and/or selecting one or more numbers or other player indicia for the player cards using gaming device 114. The selected player cards, winning patterns, and player indicia are transmitted to WAP server 120. The player cards are included within one or more game tickets issued by WAP server 120, and the game tickets are communicated to gaming device 114 via network 108 and local server 110. WAP server 120 selects or receives randomly generated house indicia and compares the house indicia to the player indicia and the pattern or patterns selected for the player cards. Alternatively, the functions described herein (e.g., comparing the house indicia to the player indicia and the pattern or patterns selected for the player card) may be performed in gaming device 114. It should be recognized that the house indicia may be randomly generated using a randomization device, such as hardware, firmware, and/or software-based random number generator (RNG), a ball blower or console, a ball cage, and/or any other suitable device or machine that enables numbers or other house indicia to be randomly generated. In an alternative embodiment, WAP server 120 (or another device) may designate a server, computer, or another device to provide randomly selected house indicia during the game, and may receive the house indicia from the designated device.

WAP server 120 determines whether the player wins a prize based on the comparison of the house indicia to the player indicia. For example, WAP server 120 determines whether the player indicia within the pattern or patterns selected for each card match the house indicia that were randomly determined (sometimes also referred to as the house indicia that were "called"). If the player indicia within a pattern match the called house indicia, the player may win a prize based on a pay table associated with the game. The prize may be one of the progressive prizes or the prize may be a fixed prize identified in the pay table. WAP server 120 determines the appropriate payout to be paid to the player based on the pay table and transmits data representative of the payout to local server 110.

Local server 110 receives the payout data and credits the player account accordingly. In addition, local server 110 may transmit the gameplay data and/or payout data to player reward server 112 to enable player reward server 112 to update the player history and other gameplay data for the player. When the player is done playing, the player may "cash out" some or all of the credits in the player account or may deposit the credits into the player account using POS terminal or kiosk 126, for example. The player account may be stored on gaming device 114, local server 110, or player reward server 112, for example.

In one embodiment, the player may enter the wager and/or may initiate play of the game on a first gaming device 114 and may complete the gameplay on a second gaming device 114. Alternatively, the player plays the game on first gaming device 114 and receives the results of the gameplay (e.g., whether the player won and how much the winnings are) on second gaming device 114. For example, the player may begin playing the game on a kiosk or electronic gaming machine, and may complete the game or view the results of the game on a cell phone. In such an embodiment, WAP server 120 and/or local server 110 may transmit the player's gameplay data from the 1st gaming device 114 to the second gaming device 114.

Figure 2:
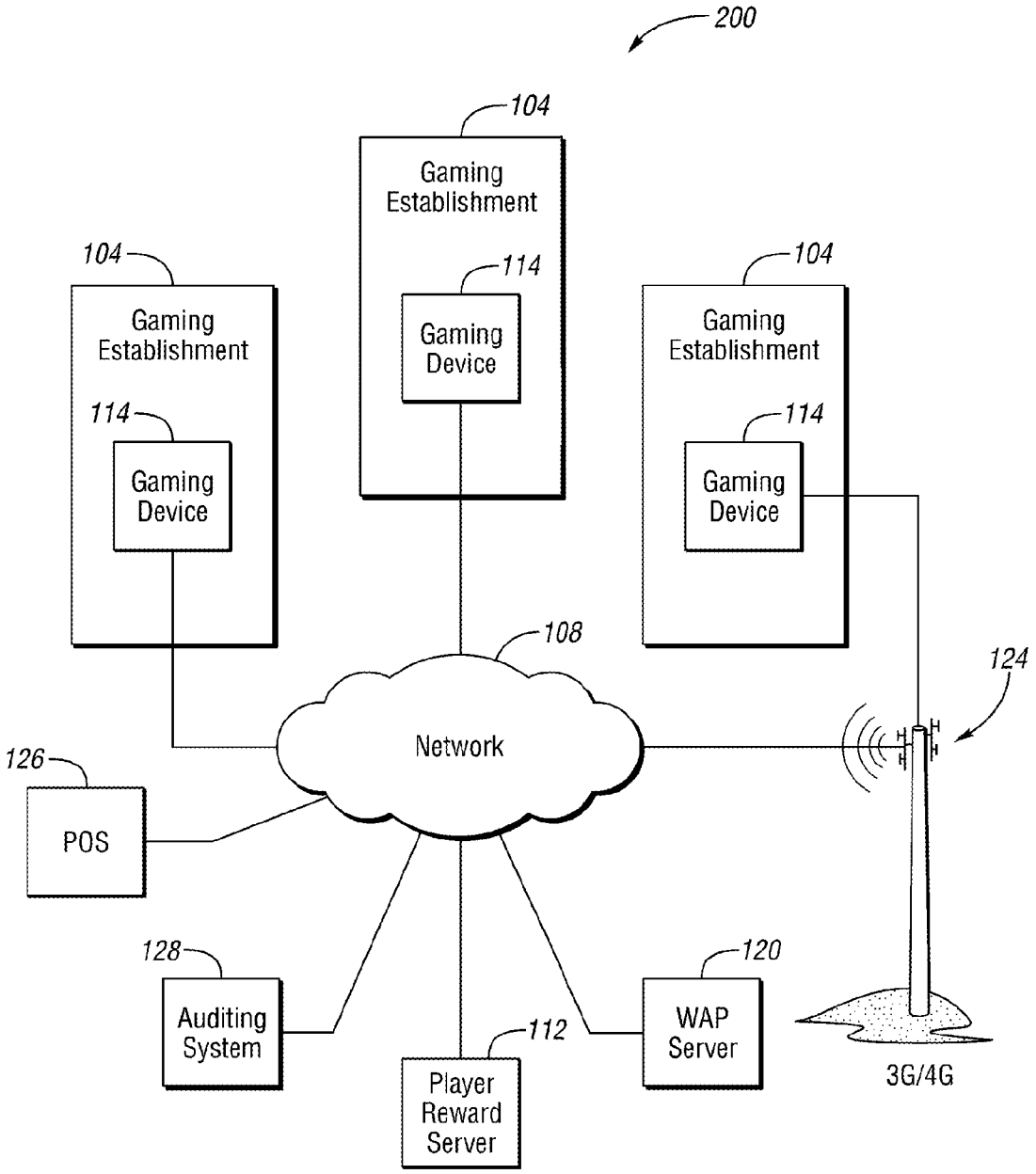
FIG. 2 is a block diagram of another system that may be used to play a game of chance.

FIG. 2 is a block diagram of another system 200 that may be used to play one or more games of chance, such as bingo or keno. Unless otherwise specified, system 200 is similar to system 100 (shown in FIG. 1) and similar components are labeled in FIG. 2 with the same reference numerals used in FIG. 1. It should be understood that more or less components may be included within the various embodiments described herein.

In the embodiment shown in FIG. 2, system 200 includes a plurality of gaming devices 114 that are positioned in a plurality of gaming establishments 102. Gaming devices 114 may connect to network 108 without using a local server 110 (shown in FIG. 1), and may connect to WAP server 120 and/or to player reward server 112 through network 108. For example, gaming devices 114 may be playing one or more Internet-based games that connect to WAP server 120 through a web server. In some embodiments, one or more gaming devices 114 may connect to WAP server 120 and/or to player reward server 112 through a wireless data network as described above. Accordingly, gaming devices 114 interact with WAP server 120 to play the game, and WAP server 120 performs the game administration and other tasks handled by local server 110 as described above in FIG. 1. In a similar manner, POS terminal 126 may connect to gaming devices 114 and/or WAP server 120 via network 108. In other respects, system 200 performs in a similar manner as described above.

During operation, the player utilizes or selects a gaming device 114 and initiates a gaming session to play one or more games on gaming device 114. The player inserts a player reward card or enters a player reward number or other identification information into gaming device 114. Gaming device 114 transmits the identification information to player reward server 112 to establish the player's identity and to associate the gameplay with the player account. Player reward server 112 authenticates the player and gaming device 114 and authorizes the player to play the game on gaming device 114. In one embodiment, gaming device 114 also transmits the identification information to WAP server 120 to enable WAP server 120 to associate the player with the game to be played. As previously described, player identification or authentication may be optional.

In another embodiment, WAP server 120 authenticates the player using the player identification information in addition to, or instead of, the authentication performed by player reward server 112. In some embodiments, player reward server 112 is omitted and the functions of player reward server 112 are incorporated within WAP server 120.

The player selects a game to play and enters a wager using gaming device 114. If the player selects a game that is operated by WAP server 120 or that includes one or more progressive prizes administered by WAP server 120, gaming device 114 transmits the wager and game selection to WAP server 120. WAP server 120 may increment the progressive prizes based on the wager received from the player and may communicate the updated prize amounts via network 108 to all other players (via associated gaming devices 114) playing to win the progressive prizes.

The player plays the game on gaming device 114. The following gameplay is described as being administered by WAP server 120. However, it should be recognized that the gameplay may be alternatively or additionally administered by gaming device 114. For example, if gaming device 114 is a cellular phone or a tablet computing device, the gameplay may be administered through an application installed on gaming device 114.

In one embodiment, the player may play a game of bingo by selecting one or more player cards, selecting one or more winning patterns for the player cards, and/or selecting one or more numbers or other player indicia for the player cards using gaming device 114. In another embodiment, the player may play a game of keno by selecting one or more player cards and selecting one or more numbers or other player indicia for the player cards using gaming device 114. The selected player cards, winning patterns (for example, in the bingo embodiment), and player indicia are transmitted to WAP server 120. The player cards are included within one or more game tickets issued by WAP server 120, and the game tickets are communicated to gaming device 114 via network 108 and local server 110. WAP server 120 selects or receives randomly generated house indicia and compares the house indicia to the player indicia and the pattern or patterns selected for the player cards. It should be recognized that the house indicia may be randomly generated using a randomization device, such as hardware, firmware, and/or software-based random number generator (RNG), a ball blower or console, a ball cage, and/or any other suitable device or machine that enables numbers or other house indicia to be randomly generated.

WAP server 120 determines whether the player wins a prize based on the comparison of the house indicia to the player indicia. For example, in an embodiment in which the player plays a game of bingo, WAP server 120 determines whether the player indicia within the pattern or patterns selected for each card match the house indicia that were randomly determined. If the player indicia within a pattern match the called house indicia, the player wins a prize based on a pay table associated with the game. In an embodiment in which the player plays a game of keno, WAP server 120 determines whether the player indicia selected for each card match the house indicia that were randomly determined. If a predetermined number of the player indicia match the called house indicia, the player wins a prize based on a pay table associated with the game. The prize may be one of the progressive prizes or the prize may be a fixed prize identified in the pay table. WAP server 120 determines the appropriate payout to be paid to the player based on the pay table and transmits data representative of the payout to gaming device 114 for display to the player.

WAP server 120 also credits the player account to reflect the prize that was won by the player. In addition, WAP server 120 may transmit the gameplay or payout data to player reward server 112 to enable player reward server 112 to update the player history and other gameplay data for the player. When the player is done playing, the player may "cash out" some or all of the credits in the player account and/or gaming device 114 or may deposit the credits in the player's account using POS terminal 126, for example.

In one embodiment, the player may enter the wager and/or may initiate play of the game on a first gaming device 114 and may complete the gameplay on a second gaming device 114. Alternatively, the player plays the game on first gaming device 114 and receives the results of the gameplay (e.g., whether the player won and how much the winnings are) on second gaming device 114. For example, the player may begin playing the game on a kiosk or electronic gaming machine, and may complete the game or view the results of the game on a cell phone. The game completion may be for a game currently being played, and/or may be for one or more future games (i.e., one or more games that have not yet started). For example, the player may enter sufficient credits or other consideration into gaming device 114 to purchase gameplay for a plurality of future games that use the same player card or that use other preselected or random player cards. The player may then complete one or more of the future games on another gaming device 114 (or any other suitable device) and/or may receive the result of one or more of the future games on another gaming device 114 (or any other suitable device).

In one embodiment, the player may purchase any number of future games (i.e., games to be played in the future) by entering a wager, a number of cards to play for each game, and a number of games to play. After inserting sufficient cash or credits to pay for the games, WAP server 120 or another device or machine that is administering the game (such as gaming device 114) may automatically display the called house indicia for each game and a result of each game to the player. The player may watch the results of the game in real time, or may view the results at a later time, for example, by viewing a summary of the game results. The player may view the results (in real time or later) on the same gaming device 114 used to initiate the games and enter the wagers, on another gaming device 114, or on any other suitable device.

In another embodiment, such as an embodiment in which the game is administered through an application installed on a cell phone, a tablet computing device, or another gaming device 114, WAP server 120 only administers the progressive prizes, or some or all prizes associated with the game being played. In such an embodiment, gaming device 114 randomly selects the house indicia using a randomization device included within, or connected to, gaming device 114. In addition, gaming device 114 may determine whether the player indicia within the player selected pattern match the house indicia, thus determining whether the player wins a prize. Gaming device 114 may transmit the results of the game to WAP server 120. The results of the game may include, for example, an indication whether the player won, the house indicia randomly selected, the player indicia selected, the player pattern selected, the number of ball calls that were required to match the house indicia to the player indicia, and/or any other aspect of the game.

In one embodiment, WAP server 120 confirms the result of the game before awarding the prize to the player. For example, WAP server 120 may determine whether the house indicia match the player indicia within the player selected pattern independently of the game result reported by gaming device 114.

Figure 3:
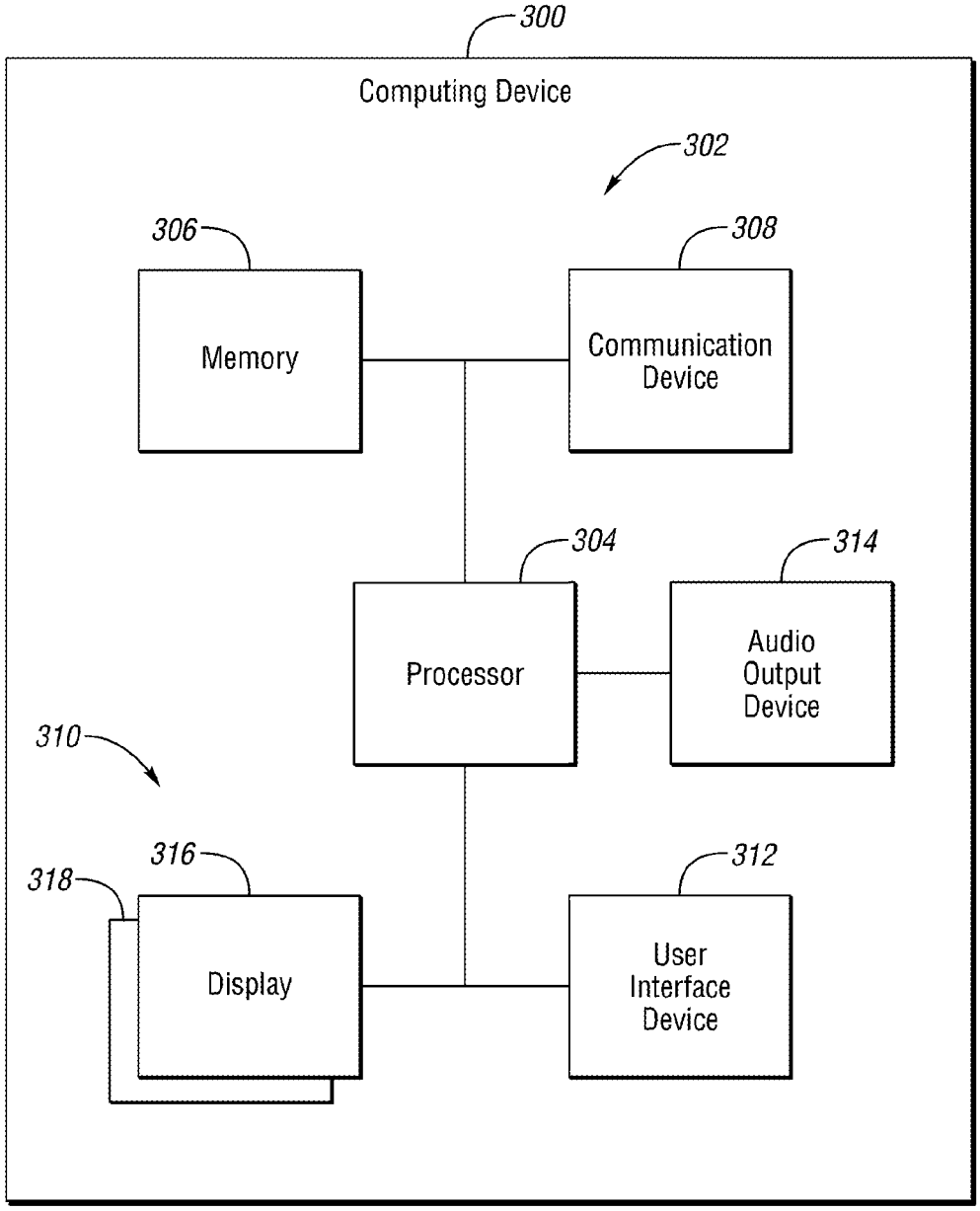
FIG. 3 is a block diagram of a computing device that may be used with the system shown in FIG. 1 or the system shown in FIG. 2.

FIG. 3 is a block diagram of a computing device 300 that may be used with system 100 (FIG. 1) or system 200 (shown in FIG. 2). More specifically, one or more gaming devices, servers, or other devices described in system 100 or system 200 may be implemented as a computing device 300. For example, local server 110, WAP server 120, player reward server 112, gaming devices 114, and/or mobile gaming devices 122 may be computing devices 300.

Computing device 300 includes a plurality of computing device components 302, such as a processor 304, a computer-readable memory device 306, and a communication device 308. In one embodiment, computing device 300 may also include a display 310, a user interface device 312, and/or an audio output device 314. It should be recognized that memory device 306, communication device 308, display 310, and user interface device 312 (if provided) may be connected to processor 304 and/or to each other via any suitable bus or busses, interfaces, or other mechanisms.

Processor 304 includes any suitable programmable circuit including one or more microcontrollers, microprocessors, application specific integrated circuits (ASICs), systems on a chip (SoCs), programmable logic circuits (PLCs), field programmable gate arrays (FPGAs), and/or any other circuit capable of executing the functions described herein. The above examples are exemplary only, and thus are not intended to limit in any way the definition and/or meaning of the term "processor."

Memory device 306 is an electronic storage device that includes transitory or non-transitory computer readable medium, such as, without limitation, random access memory (RAM), flash memory, a hard disk drive, a solid state drive, a compact disc, a digital video disc, and/or any suitable memory. Memory device 306 may include data as well as instructions that are executable by processor 304 to program processor 304 to perform functions described herein. For example, the methods described herein may be performed by one or more processors 304 executing instructions stored within one or more memory devices 306.

Communication device 308 may include, without limitation, a network interface controller (NIC) or adapter, a radio frequency (RF) transceiver, a public switched telephone network (PSTN) interface controller, or any other communication device that enables computing device 300 to operate as described herein. In one embodiment, communication device 308 may connect to communication devices 308 of other computing devices 300 of system 100 or system 200 through network 108 or another network using any suitable wireless or wired communication protocol.

Display 310 may include, without limitation, a liquid crystal display (LCD), a vacuum fluorescent display (VFD), a cathode ray tube (CRT), a plasma display, a light-emitting diode (LED) display, a projection display, and/or any suitable visual output device capable of displaying graphical data and text to a user. For example, display 310 may be used to display a graphical user interface to a player or an administrator, one or more images associated with a game such as bingo, keno, or another game of chance, player statistics, gameplay data, and/or any other suitable data.

User interface device 312 may include, without limitation, a keyboard, a keypad, a touch screen, a mouse, a scroll wheel, a pointing device, an audio input device employing speech-recognition software, a video input device that registers movement of a user, and/or any other suitable device that enables the user to input data into computing device 300 and/or retrieve data from computing device 300.

Audio output device 314 may include, without limitation, one or more speakers, or any other device that enables data to be audibly output from computing device 300. For example, gameplay data and/or music may be audibly output from audio output device 314. In addition, if the player wins a prize, audio output device 314 may be used to alert the player and/or others about the win.

While the foregoing computing device components 302 have been described as being included within a computing device 300, it should be recognized that at least some computing devices 300 may not include each component 302. For example, a computing device 300 may not include audio output device 314. In addition, a computing device 300 may include any suitable number of each individual computing device component 302. For example, a computing device 300 may include a plurality of processors 304 or processor cores and/or a plurality of memory devices 306 (of the same or different types, sizes, etc.). In addition, computing device 300 may include a plurality of displays 310, such as a first display 316 and a second display 318. In one embodiment, first display 316 may provide a graphical user interface to a player, and second display 318 may display one or more aspects of gameplay to the player as described more fully herein. Alternatively, first display 316 and second display 318 may display any suitable aspect of the game as desired.

Figure 4:
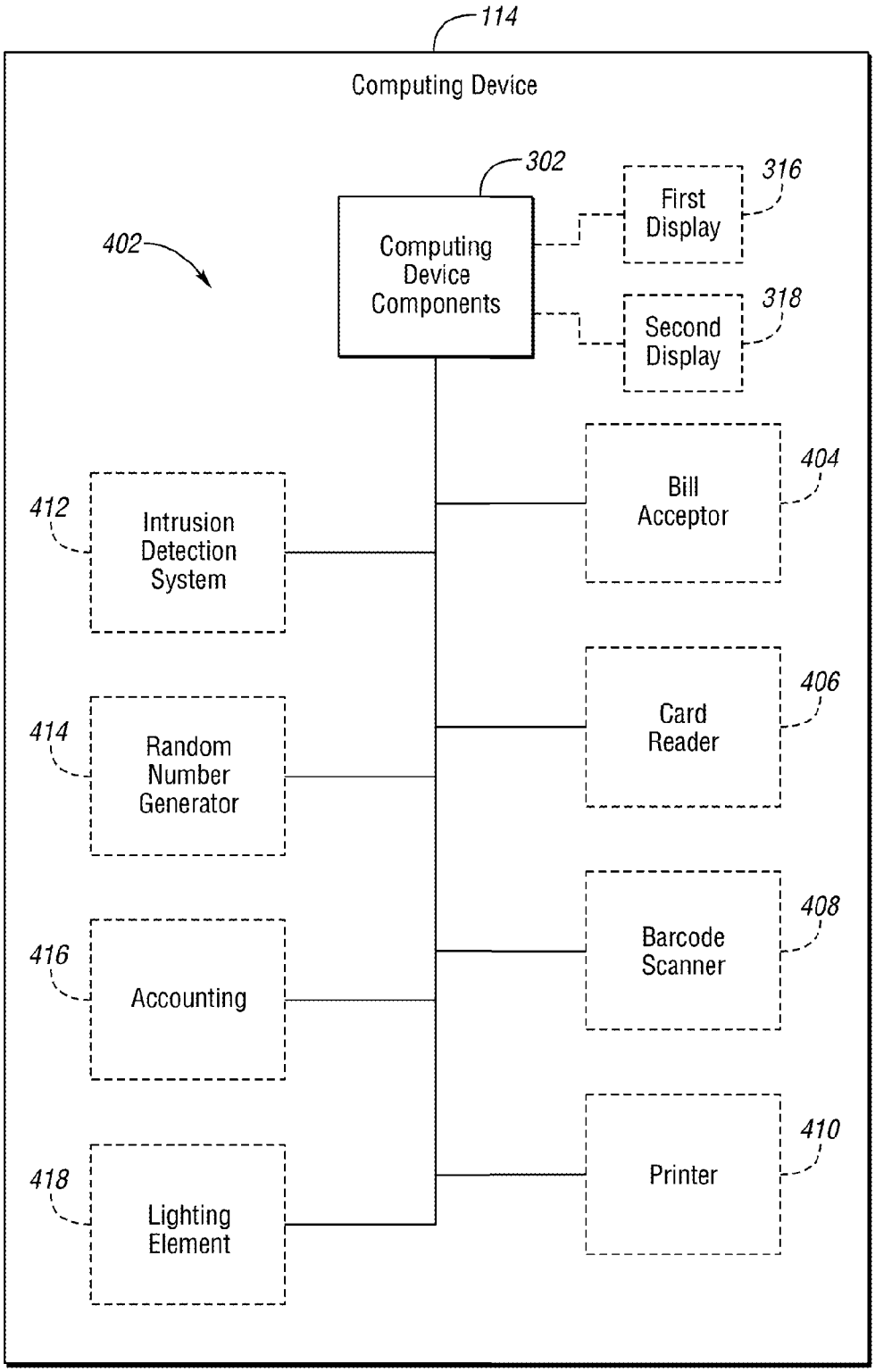
FIG. 4 is a block diagram of a gaming device that may be used with the system shown in FIG. 1 or the system shown in FIG. 2.

FIG. 4 is a block diagram of a gaming device 114 that may be used with system 100 (shown in FIG. 1) or system 200 (shown in FIG. 2). As described above, gaming device 114 is a computing device 300 (such as an EGM or a kiosk) that includes a plurality of computing device components 302 positioned within a cabinet or other housing. In one embodiment, computing device components 302 include first display 316 and second display 318. In addition, gaming device 114 may include a plurality of gaming device components 402 including a bill acceptor 404, a card reader 406, a barcode scanner 408, a printer 410, an intrusion detection system 412, a randomization device 414, and an accounting interface 416 that are positioned within, or coupled to, the cabinet or housing. In one embodiment, gaming device 114 may also include at least one lighting element 418 coupled to the cabinet or housing.

It should be recognized that in some embodiments, a gaming device 114 may not include each gaming device component 402 illustrated in FIG. 4. For example, if gaming device 114 is a cellular phone, gaming device 114 may not include bill acceptor 404, card reader 406, barcode scanner 408, and/or printer 410. Rather, in some embodiments, the functions of each omitted gaming device component 402 may be replaced by equivalent software, hardware, and/or firmware if desired. Optional components may be designated using dashed lines in the figures.

Bill acceptor 404 is a payment input device that enables gaming device 114 to receive and identify paper currency. For example, bill acceptor 404 may receive and identify dollar bills or other currency that are inserted into bill acceptor 404. In one embodiment, bill acceptor 404 includes a scanner that scans paper currency inserted therein. Bill acceptor 404 may also include optical character recognition (OCR) capabilities that enable bill acceptor 404 to identify the amount of currency inserted into bill acceptor 404 from a scanned image of the currency. Bill acceptor 404 may transmit data representative of the amount of currency inserted into gaming device 114 to processor 304, for example. Processor 304 may cause the amount of currency to be converted into credits usable with the game, and may add the credits to the player's account.

Card reader 406 is a device that "reads," or obtains data encoded in, player reward cards or other cards or media that are inserted into reader 406. In one embodiment, card reader 406 is a magnetic card reader that reads barcodes or magnetic strips included within a player reward card. In another embodiment, card reader 406 wirelessly reads data encoded within the player reward card by accessing a chip, such as a radio frequency identification (RFID) chip, embedded within the card. Card reader 406 decodes the data obtained from the cards and transmits the decoded data to processor 304. In one embodiment, card reader 406 is used to read player identification information encoded within player reward cards. Processor 304 may transmit the player identification information to player reward server 112 to identify the player, to allow for the transfer of funds or credits, to facilitate authenticating the player, and/or to authorize the player to play a game on gaming device 114. In one embodiment, the player may "log in" to gaming device 114 by swiping the player reward card or otherwise passing the player reward card through, or inserting the player reward card within, card reader 406. In another embodiment, the player may enter a number or other identifier associated with the player reward card into gaming device 114, through user interface device 312 for example, instead of using card reader 406. In another embodiment, the insertion of the player reward card and player entering the identifier into user interface device 312 may be combined. In yet another embodiment, the player may use a near field communication (NFC) device, such as an NFC device incorporated within communication device 308, to read the player reward card or data representative of the player card.

In one embodiment, barcode scanner 408 is an optical or a magnetic scanner that is optimized to read barcodes on media positioned proximate to scanner 408. For example, barcode scanner 408 may be optimized to read barcodes printed on paper receipts (sometimes referred to as "tickets" or vouchers, not to be confused with game or player tickets that may include player selected patterns, player indicia, and the like) and/or barcodes displayed electronically on a cell phone or tablet computing device. It should be recognized that the barcodes read by barcode scanner 408 may be linear or one-dimensional barcodes, two-dimensional barcodes, or may even include data represented in a form other than a barcode. For example, barcode scanner 408 may read images and/or text indicative of data, such as currency or credits, usable with gaming device 114. Barcode scanner 408 extracts the data from the barcode and transmits the data to processor 304. For example, barcode scanner 408 may scan a paper receipt or voucher that includes an amount of currency or credits usable by the player with a gaming device 114 and may transmit the amount of credits to processor 304. In such an example, barcode scanner 408 may act as a payment input device. Processor 304 may cause the amount of currency or credits to be displayed to the player on first display 316 (or on display 310 in embodiments including a single display 310) to inform the player how many credits or currency is available to be used in playing a game.

Printer 410 may be used to print paper receipts (also known as tickets as described above) that indicate an amount of currency or credits available to the player. In many locations, the tickets or receipts may alternatively be referred to as vouchers. Printer 410 may act as a payment output device that enables a player to cash out or withdraw money or credits from gaming device 114 by printing a voucher representative of the money or credits. In one embodiment, printer 410 is a thermal printer that is fed by a roll of paper or any suitable paper stock. In a further embodiment, the roll of paper includes one or more watermarks that are visible when printer 410 has printed the receipt on the paper. Alternatively, printer 410 may print the watermark on the receipt, or may include another security mechanism to facilitate preventing counterfeit receipts from being made. For example, printer 410 may include an image or a code on the receipt that identifies gaming device 114, printer 410, or another component of gaming device 114 along with a time that the receipt was printed. Other suitable security mechanisms may be used as well. It should be recognized that barcode scanner 408 and printer 410 may cooperate such that a security mechanism printed on the receipt may be received and validated by barcode scanner 408, in conjunction with processor 304, for example. Barcode scanner 408 may be located remotely from gaming device 114, such as within a redemption kiosk, a casino cage, or the like.

Intrusion detection system 412 notifies processor 304 if a case, cabinet, or other housing enclosing components of gaming device 114 is opened or modified without authorization. In one embodiment, intrusion detection system 412 includes a pair of contacts that transmit an electronic signal to processor 304 if the housing of gaming device 114 is opened (e.g., if the opening of the housing separates the contacts). In another embodiment, intrusion detection system 412 may include a light sensor that detects a change in the light within the housing of gaming device 114. Intrusion detection system 412 may also include a key or another mechanism for disabling the transmission of the signal to processor 304 in the event that maintenance or other authorized access to gaming device 114 components is desired.

In one embodiment, intrusion detection system 412 includes a software program (a "monitoring program") that monitors one or more applications installed on gaming device 114. For example, if gaming device 114 is a cell phone that includes an application for playing the game thereon, the monitoring program may monitor the application to determine whether the application is modified without authorization. In one embodiment, the monitoring program stores a hash value or a digital fingerprint of the application when the application is installed and/or when the application undergoes authorized modification (e.g., if the application is updated or patched). However, if the monitoring program determines that the application has been modified without authorization, the monitoring program may cause a signal or another notification to be transmitted to processor 304. For example, the monitoring program may periodically calculate a new hash value of the application and/or create a new digital fingerprint of the application. The monitoring program then compares the new hash value and/or digital fingerprint to the stored hash value and/or digital fingerprint. If the hash values or fingerprints are different, the monitoring program may determine that the application has been modified without authorization. It should be understood that the hash value, the monitoring program, and/or the digital fingerprint may be generated by any suitable means and may be encrypted for additional security.

In response to the signal or notification from intrusion detection system 412 and/or the modification program, processor 304 may perform one or more actions. For example, processor 304 may alert an administrator within gaming establishment 102 by transmitting a message via communication device 308, may cause audio output device 314 to emit an alarm or another audible alert, may cause first display 316 to display an error or a warning, and/or may disable the application and/or gaming device 114 such that the game is unable to be played on gaming device 114.

In one embodiment, randomization device 414 is an electronic random number generator (RNG) 414 or a permutation generator that may be implemented by a dedicated hardware device with associated embedded software. Alternatively, RNG 414 or the permutation generator may be implemented entirely in software executing on gaming device 114. RNG 414 may be used to randomly determine a game outcome for the game of chance. In one embodiment, RNG 414 or the permutation generator provides house or game draws of between 1 and n numbers, where n may be a suitable number based on the game type selected to be played by the player. RNG 414 or the permutation generator may be programmed via hardware, software, or firmware to provide a particular range of numbers (or other indicia) and numbers of draws for a particular application. For example, in one embodiment of bingo according to the present disclosure, RNG 414 or the permutation generator initially provides 24 randomly generated numbers having values between 1 and 75 for each game. Additional draws or numbers may be provided to play the game to conclusion depending on the particular implementation as described in greater detail herein. In addition, RNG 414 or the permutation generator may be used to randomly select a plurality of player indicia to be used with one or more player cards. In embodiments in which a processor, such as processor 304, is described as randomly selecting indicia, it should be recognized that processor 304 may interface with randomization device 414 or the permutation generator to select the indicia. In other embodiments, processor 304 may include randomization device 414 or the permutation generator, or may execute instructions to perform the functions of randomization device 414 or the permutation generator.

Accounting interface 416 is used to interface with an accounting system, such as a slot accounting system, at or operated by a gaming establishment 104. Accounting interface 416 may include or be connected to a network interface, such as communication device 308 for use in communicating gameplay data, player identification information, and/or other data to the accounting system for accounting and/or auditing purposes.

Lighting element 418 may include, for example, one or more LEDs, slot machine candles, fluorescent tubes, and/or any other element that emits light as controlled or directed by processor 304. In one embodiment, lighting element 418 is activated to display light, or one or more lighting patterns, when processor 304 determines that a winning ticket was scanned via card reader 406 or when processor 304 otherwise determines that a ticket is a winning ticket. Lighting elements 418 may also be activated upon receipt of a signal from intrusion detection system 412 (e.g., upon the determination that gaming device 114 has been opened and/or modified without authorization) and/or upon any other suitable determination.

In one embodiment in which gaming device 114 is a kiosk, the kiosk may interface with another gaming device 114 operated by or otherwise associated with the player, such as a cell phone or another mobile device. For example, the kiosk may be configured to transmit a result of one or more games of chance to the player's mobile device to notify the player whether one or more player cards or game tickets are winning cards or tickets.

The kiosk may also notify the player that a software application is available to be installed on the player's mobile device. If the player installs the application on the mobile device, for example, the results of the games of chance and/or the determinations of whether the player's card and/or tickets are winners may be automatically transmitted to the application to be displayed to the player. Alternatively, the kiosk or another device (such as local server 110 or WAP server 120) may automatically transmit the results of the games and/or the determinations of the winning cards and/or tickets to the player's mobile device or other device via email, SMS message, MMS message, and/or by any other suitable means. In one embodiment, the kiosk (i.e., processor 304 of the kiosk) or another device (such as local server 110 or WAP server 120) may wait to transmit the results of the games until all of the games for the player's purchased cards or tickets have been completed. Accordingly, if the player purchases player cards or game tickets for a current game and/or one or more future games, the results of the current game and the future games may not be transmitted until all of the future games associated with the player's cards or tickets have been completed.

The player may also view the player cards and/or the game tickets that the player has selected on the player's mobile device or other device, for example, using the application. After the player receives the results of the games and/or the determinations of whether the player's cards and/or tickets are winners, the player may use the mobile device (i.e., the application installed on the mobile device) to receive any winnings from the games and/or to cancel any unplayed games, player cards, and/or game tickets. The winnings may be credited to the player's account, for example, using the mobile device.

In one embodiment, one or more advertisements and/or promotions may be presented to the player via the mobile device or other device (e.g., through the application). For example, after the player has been notified of any winning tickets or player cards, a promotion may be presented to the player on the mobile device that offers a bonus or discount for one or more products or services if the player uses (or redeems) at least a portion of the winnings to purchase the product or service. Alternatively, the promotion may be transmitted along with, or before, the player has been notified of any winning tickets or player cards. The bonus or discount may be restricted to being usable within a predetermined amount of time after the promotion was transmitted to the mobile device, or the bonus or discount may be increased if the player purchases the product or service within the predetermined amount of time. For example, a promotion may be offered to the player in which the player receives a bonus (free) dinner if the player cashes in or redeems a winning ticket at a casino within 24 hours of the promotion being sent to the player's device. As another example, the player may receive bonus credits if the player purchases one or more game tickets for a new game of chance using at least a portion of the winnings.

Figure 5:
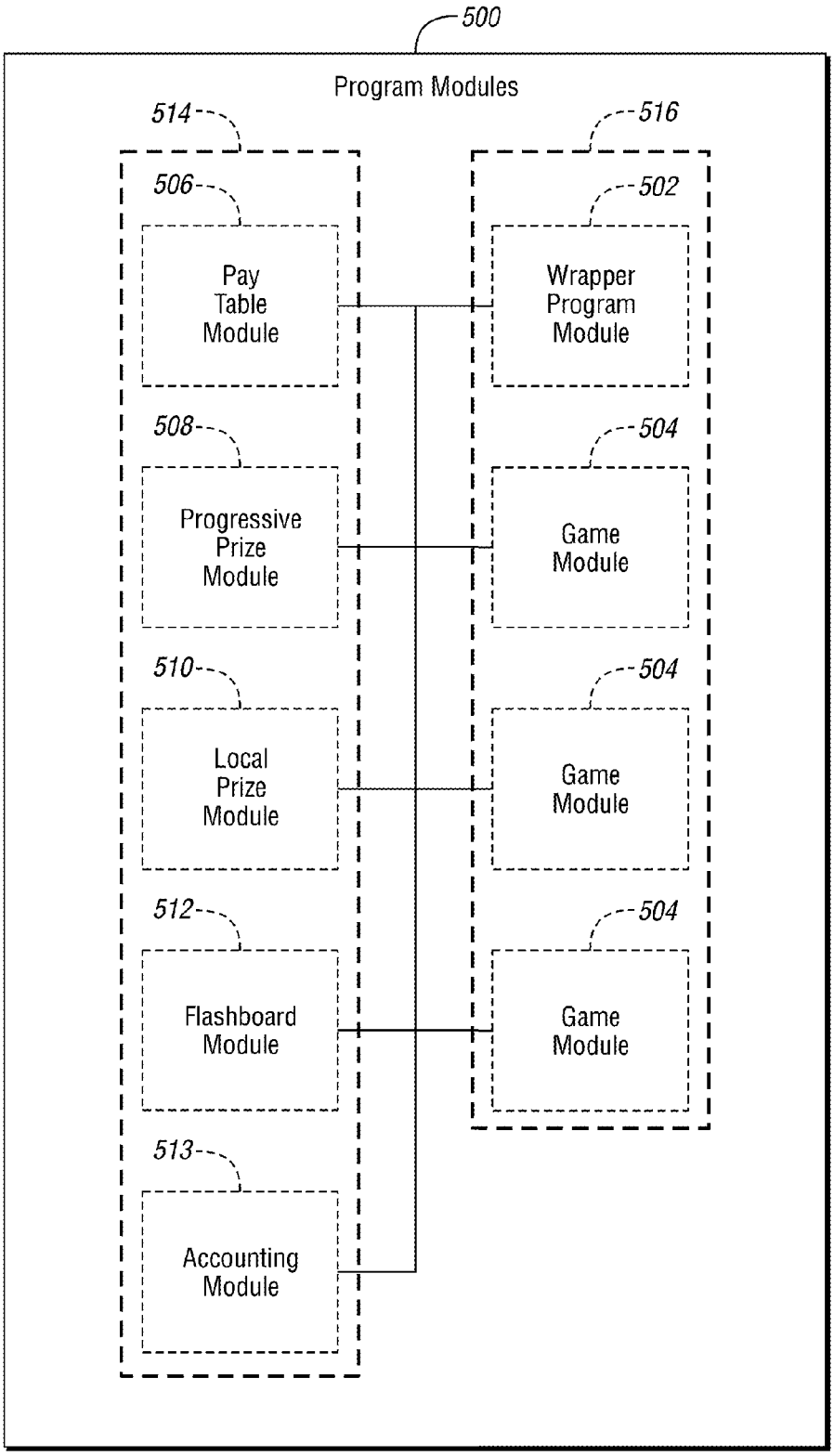
FIG. 5 is a block diagram of a plurality of program modules that may be used with the system shown in FIG. 1 or the system shown in FIG. 2 to administer a game of chance.

FIG. 5 is a block diagram of a plurality of program modules 500 that may be used with system 100 (shown in FIG. 1) or system 200 (shown in FIG. 2) to administer one or more games of chance, such as bingo or keno. In one embodiment, program modules 500 are installed and/or stored within local server 110, WAP server 120, and/or gaming devices 114. For example, program modules 500 may be stored in memory device 306 of local server 110, WAP server 120, and/or gaming devices 114.

Program modules 500 are hardware, firmware, or software programs or applications that, when executed by processor 304 of local server 110, WAP server 120, and/or gaming device 114, cause processor 304 to perform the functions described herein. In one embodiment, program modules 500 include a wrapper program module 502, a plurality of game modules 504, a pay table module 506, a progressive prize module 508, a local prize module 510, a flashboard module 512, and/or an accounting module 513. A first plurality 514 of program modules 500 may be installed within each local server 110 and/or WAP server 120 and a second plurality 516 of program modules 500 may be installed within each gaming device 114. It should be recognized that in embodiments in which the game of chance is administered by gaming device 114 (e.g., when a cell phone or a tablet computing device is used as gaming device 114), some or all of the first plurality 514 of program modules 500 may be incorporated within gaming device 114 and executed by processor 304 of gaming device 114. Alternatively, some or all of the second plurality 516 of program modules 500 may be incorporated within local server 110 and/or WAP server 120. Together, wrapper program module 502, game modules 504, and other program modules 500 that present and/or administer one or more games may be referred to herein as a game application, or an application.

In one embodiment, wrapper program module 502 is used at least in part to provide a graphical user interface (GUI) on first display 316 of gaming device 114 (or on display 310 in embodiments that include a single display). Wrapper program module 502 operates to provide an entry point or a game entry interface for a player to access gaming device 114, and to enable the player to select a game of chance to be played on gaming device 114. For example, the games of chance may be categorized into a plurality of game sizes and a plurality of game variations. Wrapper program module 502 may present the game sizes and the game variations to the player, using first display 316, and may enable the player to select a game to play by selecting a game size and game variation through user interface device 312.

In one embodiment, wrapper program module 502 may present a list of player card sizes (i.e., game sizes or matrices), such as 3×3, 4×4, and 5×5, to the player for selection on first display 316. In addition, wrapper program module 502 may present a list of games or game variations to the player for selection on first display 316. Alternatively, the game size and game variation may be combined into one selectable icon, such as an icon representing a first variation of 3×3 bingo or a second variation of 5×5 bingo. If the player selects a size and variation, wrapper program module 502 calls or branches to a game module 504 that provides the selected game size and variation.

In one embodiment, game modules 504 each provide a game associated with the selected game size and/or game variation to the player using gaming device 114, local server 110, and/or WAP server 120. Accordingly, in one embodiment, each game is provided by a separate game module 504. Alternatively, each game module 504 may provide more than one game to the player.

Pay table module 506 provides a pay table associated with each game such that one or more pay tables may be associated with each game module 504. In one embodiment, pay table module 506 provides a pay table associated with a game when game module 504 requests the pay table and/or when a predetermined event occurs during the game. Pay tables associated with a game may be changed as desired by a game operator by any suitable means. The predetermined event may include, for example, the player selecting a "See Pays" or another icon displayed on first display 316 that represents a request to view the pay table for the game. The predetermined event may also include reaching a point in the game in which the house indicia are matched to the player indicia within a selected pattern to determine whether the player wins a prize.

Progressive prize module 508 may be used to administer aspects of one or more progressive prizes, such as one or more progressive prizes offered to players playing across network 108. For example, progressive prize module 508 may receive information regarding an amount wagered by each player playing a game that has a chance to win the progressive prize. Progressive prize module 508 may allocate a first portion of each wager to a first progressive prize to increase the size of the progressive prize. Progressive prize module 508 may allocate a second portion of each wager to a second progressive prize, and may continue in a similar manner for any additional progressive prizes, if desired or applicable. Accordingly, a plurality of progressive prizes may be provided for each game and may be at least partially funded by each wager.

Local prize module 510 may be used to administer aspects of one or more local prizes, such as one or more prizes that may be won by players playing against each other within a gaming establishment 102. In addition, local prize module 510 may administer aspects of one or more fixed prizes, such as prizes that may be won only by individual players playing on respective gaming devices 114. Accordingly, fixed or individual prizes may be awarded to a player based on the gameplay of the player against randomization device 414 of gaming device 114, rather than based on winning against other players.

In one embodiment, flashboard module 512 may be used to display called bingo numbers or other house indicia within one or more gaming establishments. In another embodiment, flashboard module 512 may be used to display called bingo numbers, keno numbers, or other house indicia on gaming devices 114 themselves, for example, on second display 318 (or on display 310 in embodiments that include a single display) during play of the game. Flashboard module 512 may cause the house indicia to be displayed as a rectangular matrix of spaces (sometimes referred to as a "flashboard"). For bingo games played utilizing 75 numbers or indicia, the letters B, I, N, G, and O may be pre-printed above five vertical columns of the matrix with one letter appearing above each column to assist players in more quickly locating a called number on their card(s). For 75 number bingo games, the numbers printed on the card are commonly arranged as follows: 1 to 15 in the B column, 16 to 30 in the I column, 31 to 45 in the N column, 46 to 60 in the G column, and 61 to 75 in the O column. However, other arrangements of the flashboard may be used instead of the arrangement described herein.

Accounting module 513 may be used to interface with an accounting system, such as a slot accounting system or auditing system 128, at or operated by a gaming establishment 104. In one embodiment, accounting module 513 is incorporated within, or executed by, accounting interface 416. Any suitable data, such as gameplay data, player identification information, an amount of prizes won by a player, and/or any other suitable data may be collected and transmitted by accounting module 513.

For keno games played utilizing 80 number or indicia, the numbers may be arranged sequentially in a matrix such that numbers 1-10 appear sequentially in a first row, the numbers 11-20 appear sequentially in a second row below the first row, the numbers 21-30 appear sequentially in a third row below the second row, and so on. It should be recognized that embodiments of keno games having a different number of player indicia (or spots) may be used, such as 49 or 25 spots.

It should be recognized that two or more program modules 500 may be combined together such that the functionality of each program module 500 is incorporated into the combined module. Likewise, each program module 500 may be split into two or more sub-modules that each perform a portion of the functionality of the program module 500 being split. Accordingly, while the above-described program modules 500 are described individually, each may be combined or split into other sub-modules as desired.

Figure 6B:
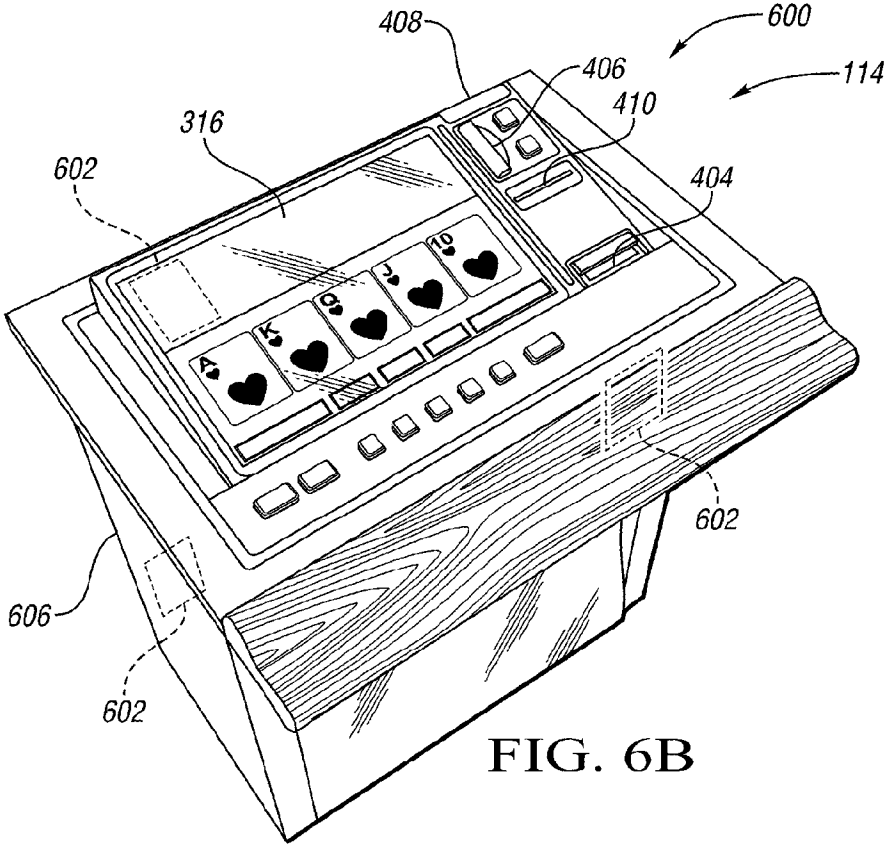
FIGS. 6A and 6B are illustrations of an electronic gaming machine that may be used with the system shown in FIG. 1 or the system shown in FIG. 2.
Figure 6A:
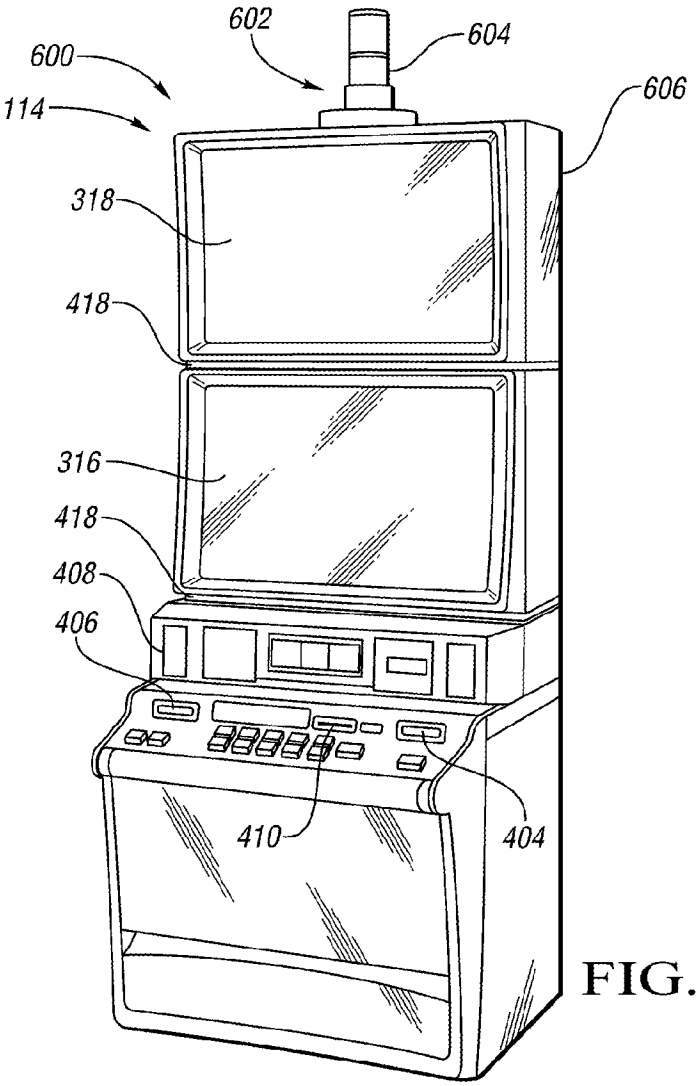

FIG. 6A is an illustration of an exemplary electronic gaming machine (EGM) 600 configured as a stand-alone kiosk (also referred to as "kiosk 600") that may be used with the systems described herein. In one embodiment, EGM 600 is a gaming device 114. FIG. 6B is an illustration of EGM 600 configured as a bar top machine described herein. EGM 600 may include one or more comp indicators 602, which may be incorporated into, or implemented by, a candle device 604, lighting element 418, or another device.

Referring to FIG. 6A, comp indicator 602 visually notifies or alerts the player when the player is determined to be eligible to receive one or more comps from a gaming establishment, for example. Comp indicator 602 may also display or otherwise notify the player of the progress towards attaining the comp or comps. Such comps may include, for example, one or more free beverages, free meals, free rooms, free credits for one or more games of chance, free prizes, free tickets to a performance, free services (e.g., spa services), and/or a discount or reduced price for one or more of the foregoing goods or services (e.g., with respect to a market price of the goods or services). In one embodiment, comp indicator 602 may include an audio notification or other sensory notification in addition to, or in place of, the visual notification. While comp indicator 602 is described as being used with EGM 600, it should be recognized that comp indicator 602 may be used with any gaming device 114 and/or computing device 300.

Candle device 604 may include a light fixture attached to a cabinet 606 or other housing of EGM 600. Candle device 604 may be lit or activated to indicate that attention is needed at EGM 600 from an attendant or another employee (sometimes referred to as personnel) of a casino or other gaming establishment, for example. While candle device 604 is illustrated as being attached to a top portion of cabinet 606, it should be recognized that candle device 604 may be attached to cabinet 606 in any suitable location, or may be incorporated within cabinet 606 as desired. In an embodiment in which comp indicator 602 is incorporated in candle device 604 or is implemented by candle device 604, candle device 604 may be lit or activated to indicate that the player is eligible for a comp. The comp indicator activation may include any suitable means for displaying comp status, comp eligibility, change in comp status, incremental progress toward comps, continual progress toward comps, reduction in comp status after awarding of comps, etc., and may include any visual or sensory indicator or indication. The lighting or activation of comp indicator 602 (i.e., candle device 604) may notify the player that the player may receive the comp and/or may notify an attendant or other personnel at the gaming establishment that the player is eligible for the comp. Accordingly, player satisfaction may increase as the player knows when he or she is eligible for the comp. In addition, costs may be reduced for the gaming establishment as the gaming establishment personnel will not award comps prematurely (e.g., before the comp is economically justifiable for the gaming establishment). It is understood that the term attendant may apply to any employee or group of employees of a gaming establishment such as servers, bartenders, slot attendants, waiters, waitresses, managers, and the like.

In another embodiment, comp indicator 602 is implemented as, or incorporated within, one or more lighting elements 418 coupled to, or incorporated within, an exterior of gaming device 114. In such an embodiment, lighting elements 418 may be lit or activated when the player is determined to be eligible to receive the comp. Alternatively, comp indicator 602 may be implemented as, or incorporated within, one or more LEDs or other lights that are activated or lit when the player is determined to be eligible to receive the comp. The LEDs, lighting elements 418, or other lights may be activated to provide one color (e.g., green) or group of colors when the player is determined to be eligible to receive the comp, and may be activated to provide another color (e.g., red) or group of colors when the player is determined to be ineligible to receive the comp. The group of colors may include a plurality of colors such as green (indicating the player is eligible for a comp), yellow (indicating that the player is in an intermediate position where the player or casino personnel are notified that play levels may not be adequate for comps), and red (indicating that play levels are inadequate to receive comps). Further colors may be included as well, such as blue or any other suitable color, to indicate, for example, that the player is eligible for a premium or higher level comp as compared to the comp available when the comp indicator is colored green. Comp indicator 602 may additionally or alternatively be displayed within any other suitable portion of EGM 600 (or another gaming device 114), such as within or proximate to a player tracking module (e.g., card reader 406), or in any other suitable location.

In one embodiment, processor 304 of EGM 600 determines when the player is eligible to receive the comp. Alternatively, processor 304 of another computing device, such as local server 110, player reward server 112, or WAP server 120 determines when the player is eligible to receive the comp. The player may be determined to be eligible to receive the comp based on the gameplay of the player, such as based on an amount of coin-in by the player at EGM 600, a number of wins or losses of the player at EGM 600, an amount of wagering activity by the player, an amount of money won or lost by the player, an amount of player loyalty points accrued over time, an amount of player loyalty points in total, the player's loyalty tier level, the player's minimum bet, the player's maximum bet, the player's average bet, the player's time on device without playing, a statistical hold percentage of EGM 600, and a theoretical win of the player during a period of gameplay on EGM 600 and/or based on other amounts of money spent at the gaming establishment, for example.

In one embodiment, as the amount of money wagered over time by the player increases, the player comes closer to becoming eligible to receive the comp. For example, the gaming establishment may determine a threshold amount of wagering activity or other gameplay aspects that must be reached before the player is determined to be eligible to receive each comp. The threshold amount may be set to different amounts for each comp offered by the gaming establishment. As the player plays the game or games on EGM 600, for example, the gaming establishment may award points or other representations of the player's progress toward becoming eligible for the comp (sometimes referred to as "comp eligibility points"). Once the player's points or play levels are determined to reach or exceed the threshold amount, the player may be determined to be eligible to receive the comp and comp indicator 602 may be activated accordingly. The comp indicator activation may include any suitable means for displaying comp status, comp eligibility, change in comp status, incremental progress toward comps, continual progress toward comps, reduction in comp status after awarding of comps, etc., and may include any visual or sensory indicator or indication. As used herein, the term "points" is not limited to numerical numbers or points. Rather, points may include any suitable indicator, metric, or designator as desired. It should be recognized that comp eligibility points may be different than points that are awarded or accumulated based on an amount of coin-in or other factors (sometimes referred to as "player points," "play points," or "gameplay points") as described in more detail below or may be the same as play points where points may be utilized for any applicable purpose such as food or beverage, free play, promotions, etc.

The player's comp eligibility, and progress towards eligibility, may be associated with the player's reward card or account for the player. For example, as the player plays one or more games, or otherwise spends money in the gaming establishment, EGM 600 or another suitable computing device 300 transmits data representative of the gameplay, money spent, and/or comp eligibility points earned to player reward server 112 or another computing device 300. Player reward server 112 (or another computing device 300 that receives the data) determines the comp eligibility points or progress towards eligibility for the comp (if not yet determined) and associates the points or progress with the player account and/or player reward card. Accordingly, the player's progress towards eligibility for the comp may be stored and updated and/or used at a later time if desired. In another example, player reward server 112 may determine that a player is or is not eligible based on historical play. Many establishments create player reward tiers that recognize a player's play over time and may institute a comp policy that higher tier players always receive comps while lower tier players must demonstrate adequate play levels on a case by case basis to be eligible for comps. This eligibility may be shown on comp indicator 602.

In one embodiment, comp indicator 602 may be located and designed so a player may not readily see, recognize, or have access to comp indicator 602. However, it should be recognized that casino personnel, for example, may be trained to understand where to look for comp indicator 602 and/or how to recognized comp indicator 602.

Referring to FIG. 6B, many casinos include EGMs 600 that are referred to as bar top machines. In these embodiments, EGMs 600 are placed at a slight horizontal angle to facilitate play as illustrated in FIG. 6B, for example. In such embodiments, comp indicator 602 may be located on the game display, the display of a player tracking module (PTM), a video overlay, the top or side surfaces of the cabinet, or may be generally hidden from the player when located on the rear semi-vertical portion of the cabinet or housing. In some embodiments, one or more devices or components, such as a PTM (or another embodiment of comp indicator 602), may be externally mounted on or connected to an EGM 600 or another suitable gaming device 114. In such embodiments, these components or devices (e.g., the PTM or other comp indicator 602 embodiment) may be considered to be a part of EGM 600 or gaming device 114.

Figure 7:
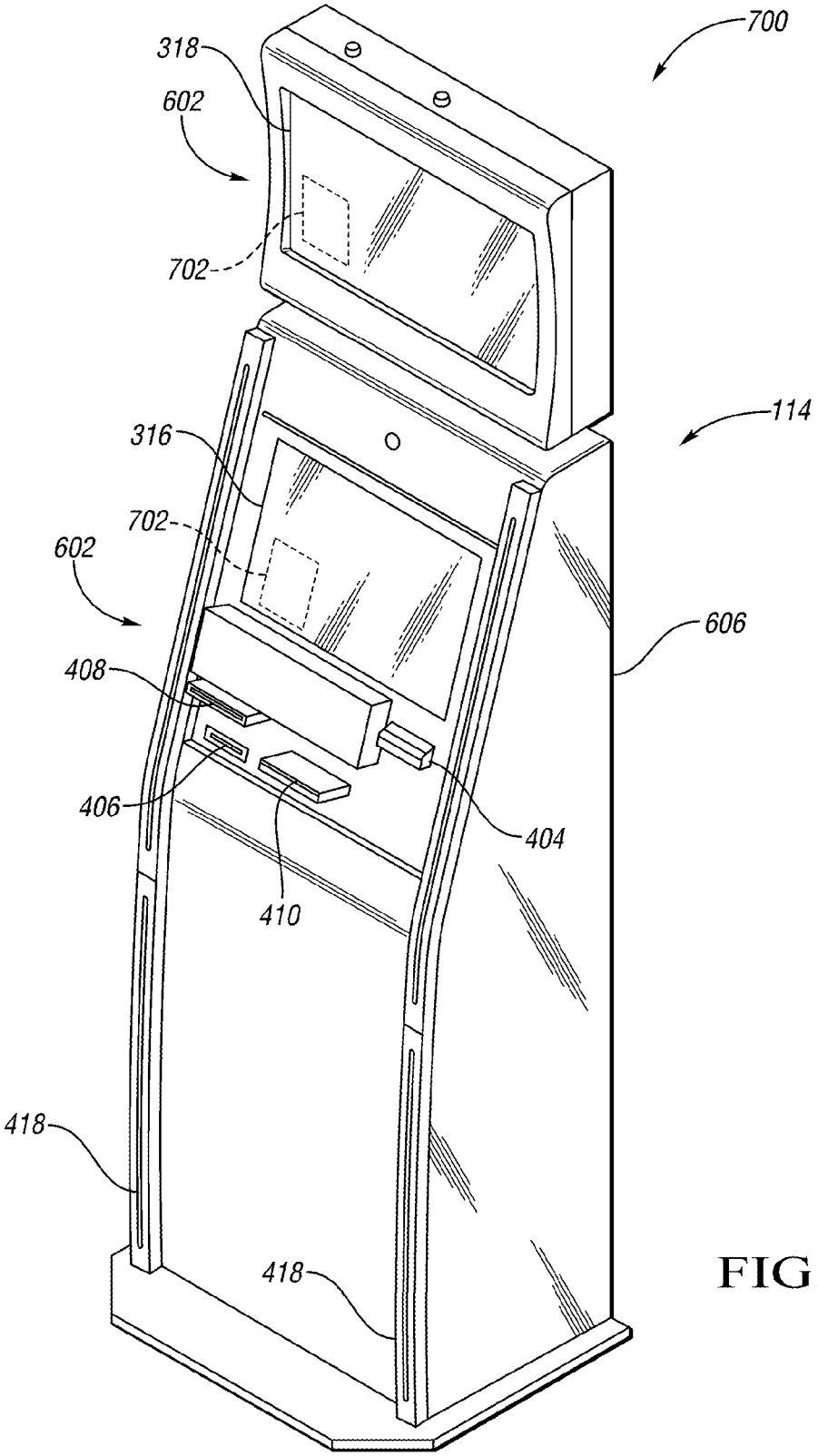
FIG. 7 is an illustration of a kiosk gaming device that may be used with the system shown in FIG. 1 or the system shown in FIG. 2.

FIG. 7 is an illustration of an exemplary kiosk gaming device 700 (also referred to as "kiosk 700") that may be used with the systems described herein. In one embodiment, kiosk 700 is a gaming device 114. Unless otherwise specified, kiosk 700 is similar to EGM 600 (shown in FIGS. 6A and 6B) and similar components are labeled in FIG. 7 with the same reference numerals used in FIGS. 6A and 6B.

Kiosk 700 may include one or more comp indicators 602, which may be incorporated into, or implemented by, a display 310, such as first display 316 and/or second display 318. More specifically, comp indicator 602 may be implemented as one or more images or icons 702 displayed within first display 316 and/or second display 318. The comp indicator image 702 may include, for example, a chart, a gauge, a scale, a bar, and/or any other indicator that displays whether the player is eligible for the comp and/or the player's progress towards the comp. In one embodiment, image 702 may be colored with a first color (or group of colors) when the player is determined to be eligible for the comp, and may be colored with a second color (or group of colors) when the player is determined to be ineligible for the comp. In another embodiment, image 702 may be displayed when the player is determined to be eligible for the comp and may be hidden or not displayed when the player is determined to be ineligible for the comp. In yet another embodiment, comp indicator 602 may be located in or on any convenient location on kiosk 700 such as any cabinet location. Comp indicator 602 may be located and designed so a player may not readily see, recognize, or have access to comp indicator 602. However, it should be recognized that casino personnel, for example, may be trained to understand where to look for comp indicator 602 and/or how to recognized comp indicator 602.

Additionally or alternatively, comp indicator 602 may be displayed on one or more computing devices 300 of the gaming establishment, such as POS terminal 126. The display of comp indicator 602 on POS terminal 126 (or another gaming establishment device) may be accomplished in any of the manners described herein with reference to comp indicator 602 of kiosk 700 or EGM 600. In such a manner, attendants or other personnel of the gaming establishment may monitor the player's progress towards eligibility of the comp. In another embodiment, comp indicator 602 may reside in a plurality of locations and may have a plurality of configurations. For example and without limitation, comp indicator 602 may be configured to be included within, or may be positioned on or within, local server 110, player reward server 112, POS terminal 126, and/or EGM 600. Data relating to player comp eligibility, casino personnel adherence to comp policy and comp eligibility, accounting functions (either on a case by case basis or an over time basis), or any other desired function may be generated and stored by local server 110 or player reward server 112, for example. Accordingly, management may determine if casino personnel are responsibly adhering to a casino's comp policy as on occasion casino personnel may choose to ignore comp indicator 602 in order to increase tips from players. Therefore, comp indicator 602 may help prevent and/or correct such an otherwise potentially major loss of revenue for casinos or other gaming establishments.

Figure 8A:
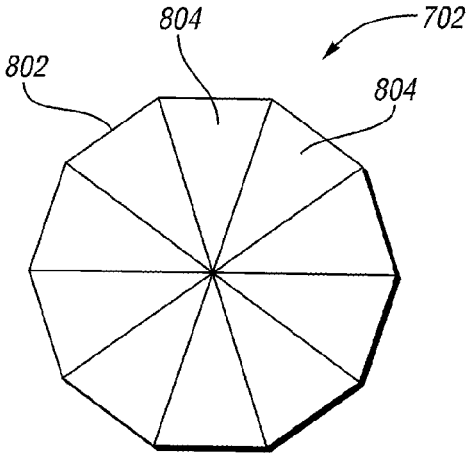
FIGS. 8A-8C are block diagrams of comp indicator images that may be used with the electronic gaming machine shown in FIGS. 6A and 6B and the kiosk gaming device shown in FIG. 7.
Figure 8B:
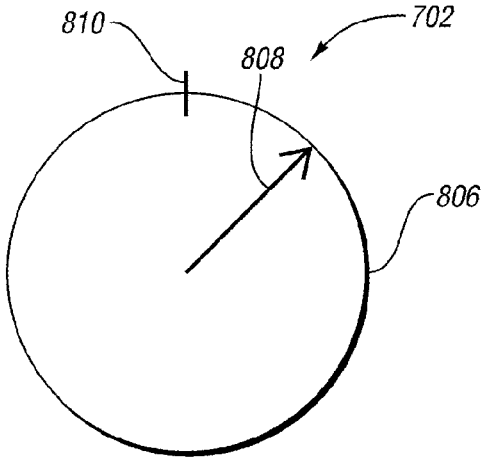
Figure 8C:
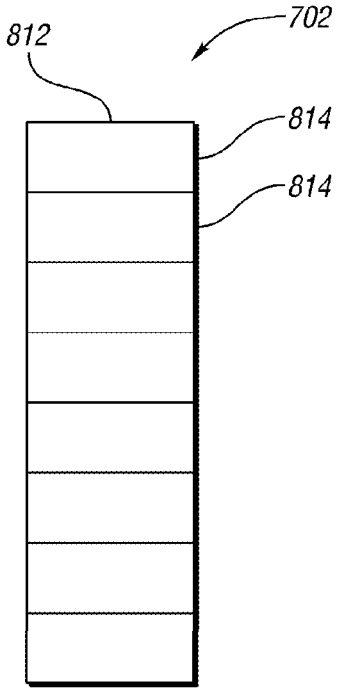

FIGS. 8A-8C illustrate comp indicator images 702 that may be used with EGM 600 (shown in FIGS. 6A and 6B), kiosk 700 (shown in FIG. 7), and/or other gaming devices 114 or computing devices 300 as described herein. While FIGS. 8A-8C illustrate certain embodiments of comp indicator image 702, it should be recognized that any suitable image, graphic, icon, or other visual indicator may be used for comp indicator image 702. Comp indicator images 702 may be virtual images displayed on a monitor or other display of EGM 600 such as a player tracking module, or may be separate physical devices such as candle devices 604 or similar devices mounted to the cabinet of EGM 600. In another embodiment, comp indicator 602 may be idle and accessed only when queried by casino personnel by touch or by other means.

At least some comp indicator images 702 are illustrated herein as having a plurality of sections that indicate progress towards comp eligibility. However, it should be recognized that one or more sections may be removed such that no gradations are displayed within comp indicator images 702, or one or more sections or other portions of comp indicator images 702 may be replaced with any other gradation indicator.

FIG. 8A illustrates a pie chart 802 as one embodiment of comp indicator image 702. Pie chart 802 includes a plurality of equally-sized sections 804 that represent the player's progress towards achieving eligibility for the comp. In the example illustrated in FIG. 8A, 10 sections 804 are included, although any suitable number of sections 804 may be used as desired. As the player progressively accumulates comp eligibility points or other representations of progress towards eligibility for the comp, sections 804 are graphically filled in or marked accordingly. For example, if 100 points are needed to be eligible to receive the comp, a new section 804 shown in FIG. 8A will be filled in for every 10 points achieved by the player. In addition, sections 804 may be partially filled in or marked if the player has not yet accumulated enough points to fill in an entire section 804. In the example described herein, a section 804 may be 10% filled in or marked for every point accumulated by the player.

When all or a predefined number of sections 804 have been filled in or marked, the threshold amount of comp eligibility points has been reached and the player may be eligible to receive the comp. In one embodiment, pie chart 802 and/or sections 804 may flash, change colors, or change other visual aspects thereof to reflect that the player is now eligible to receive the comp. In another embodiment, pie chart 802 may not reset after a comp is awarded, but may instead remain at a level that is consistent with the player's ongoing play. In such an embodiment, the player comp eligibility is not determined on a case-by-case basis, but instead by average ongoing play.

FIG. 8B illustrates a gauge or dial 806 as another embodiment of comp indicator image 702. Gauge 806 includes an arrow or pointer 808 that represents the player's progress towards achieving eligibility for the comp. As the player progressively accumulates comp eligibility points or other representations of progress towards eligibility for the comp, arrow 808 is rotated about gauge 806 accordingly. For example, if 100 points are needed to be eligible to receive the comp, arrow 808 will move 1% of the distance around gauge 806 for every point achieved by the player.

When arrow 808 reaches a completion or predefined marker 810, the threshold amount of comp eligibility points has been reached and the player may be eligible to receive the comp. In one embodiment, gauge 806 and/or portions thereof may flash, change colors, or change other visual aspects thereof to reflect that the player is now eligible to receive the comp. In another embodiment, gauge 806 may not reset after a comp is awarded, but may instead remain at a level that is consistent with the player's ongoing play. In such an embodiment, the player comp eligibility is not determined on a case-by-case basis, but instead by average ongoing play. If the play remains above a predefined level, the player will receive ongoing comps. In contrast, if the play does not remain above the predefined level, the player may be denied comps. In all embodiments, there may be a "grey area" where the player comp eligibility is sufficiently close to being satisfied, and it may be in the discretion of casino personnel to award or deny a comp. It is understood that comp eligibility determinations may vary from gaming establishment to gaming establishment and include any applicable metrics, eligibility requirements, criterion, etc.

FIG. 8C illustrates a graduated scale or bar chart 812 as one embodiment of comp indicator image 702. Scale 812 includes a plurality of equally-sized sections 814 that represent the player's progress towards achieving eligibility for the comp. In the example illustrated in FIG. 8C, 8 sections 814 are included, although any suitable number of sections 814 may be used as desired. As the player progressively accumulates comp eligibility points or other representations of progress towards eligibility for the comp, sections 814 are graphically filled in or marked accordingly in a similar manner as described above with respect to FIG. 8A.

When all or a predefined number of sections 814 have been filled in or marked, the threshold amount of comp eligibility points has been reached and the player may be eligible to receive the comp. In one embodiment, scale 812 and/or sections 814 may flash, change colors, or change other visual aspects thereof to reflect that the player is now eligible to receive the comp. In another embodiment, scale 812 may not reset after a comp is awarded, but may instead remain at a level that is consistent with the player's ongoing play. In such an embodiment, the player comp eligibility is not determined on a case-by-case basis, but instead by average ongoing play.

While FIG. 8A illustrates a pie chart 802, FIG. 8B illustrates a gauge 806, and FIG. 8C illustrates a bar chart 812, it should be recognized by those of ordinary skill in the art that any suitable means may be utilized to display or indicate player comp eligibility.

Figure 9:
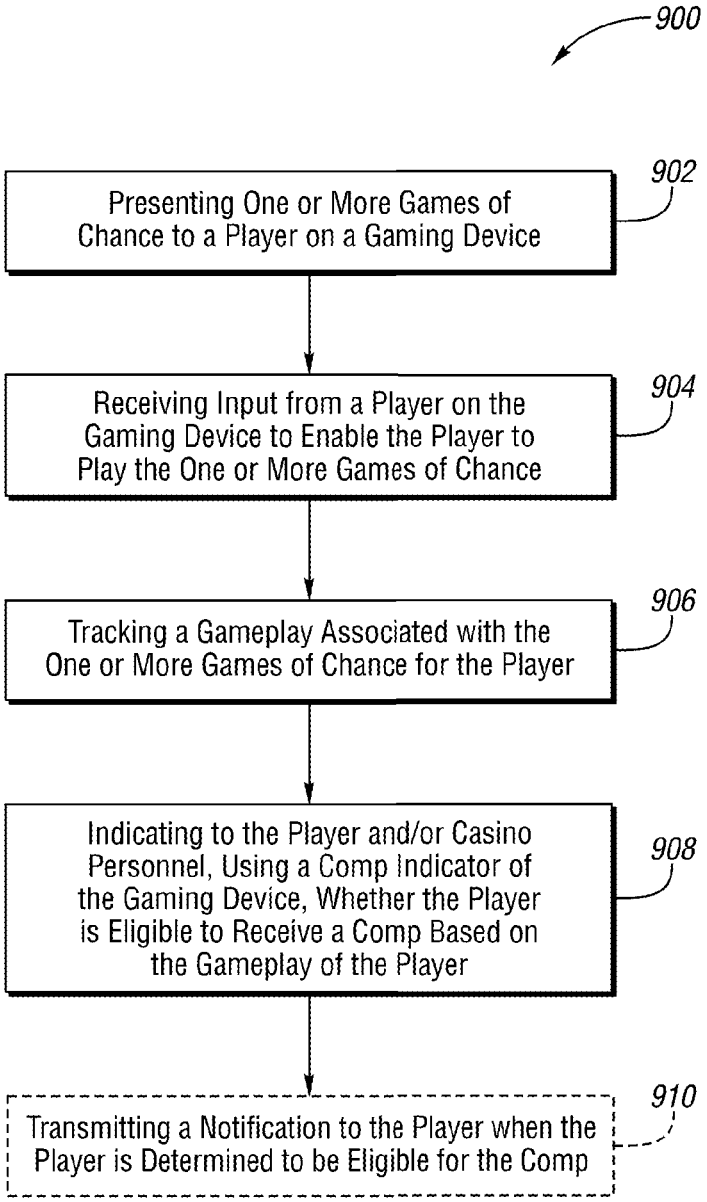
FIG. 9 is a flow diagram of a method of indicating eligibility of a player to receive one or more comps.

FIG. 9 is a flow diagram of a method 900 of indicating eligibility of a player to receive one or more comps. In one embodiment, the comps may include, without limitation, one or more free beverages, free meals, free rooms, free credits for one or more games of chance, free prizes, free tickets to a performance, free services (e.g., spa services), and/or a discount or reduced price for one or more of the foregoing.

One or more games of chance may be presented 902 to a player on a gaming device, such as EGM 600, kiosk 700, or another gaming device 114. The games of chance may include video reel slots, video poker, sports betting or sport book games, bingo or bingo-related games, keno or keno-related games, and/or any other games of chance. The game or games may be displayed to the player, for example, on one or more displays 310 of gaming device 114.

Input is received 904 from the player on gaming device 114 to enable the player to play the one or more games of chance. For example, the player may use user interface device 312 to input commands and selections to play the game.

A gameplay associated with the one or more games of chance is tracked 906 for the player. For example, gaming device 114, local server 110, player reward server 112, and/or WAP server 120 may individually or jointly track the gameplay of the player to enable a determination to be made whether the player is eligible to receive the comp. The tracked gameplay may include an amount of time the player has played on gaming device 114, an amount of money wagered on gaming device 114, an amount of money won or lost on gaming device 114, an amount of money spent by the player at a gaming establishment in which gaming device 114 is located, and/or any other suitable data. In addition to monitoring players who are identified via player cards or other player identification means, unidentified players may also be monitored.

In one embodiment, comp indicator 602 of gaming device 114 indicates 908 to the player and/or casino personnel whether the player is eligible to receive a comp based on the gameplay of the player. Comp indicator 602 may indicate 908 the player's eligibility to receive the comp by, for example, displaying a progress that the player has made towards achieving the comp on a scale, a gauge, or another image or indicator, and/or by activating a light or button when the player is determined to be eligible for the comp. The light may be activated to display a first color (e.g., green or blue) when the player is determined to be eligible to receive the comp, and may be activated to display a second color (e.g., red) when the player is determined to be ineligible to receive the comp. The progress made towards eligibility of the comp may be updated on comp indicator 602, for example, based on the wagering activity of the player, based on a number of wins or losses of the player, based on an amount of money won or lost by the player, based on a total amount of gameplay points accumulated by the player during a period of gameplay, based on an amount of money wagered by the player during a period of gameplay (sometimes referred to as the "coin-in" amount of the player), based on a theoretical win of the player during a period of gameplay, and/or based on any other activity of the player.

In one embodiment, an optional notification may be transmitted 910 to the player, such as to a mobile device operated or owned by the player, when the player is determined to be eligible to receive the comp. In another embodiment, comp indicator 602 or another portion of gaming device 114 may display an amount of wagering activity or other gameplay that is required to achieve the comp. For example, if the player has wagered $100 and the gaming establishment determines that $200 is the minimum amount needed to be wagered to receive the comp, comp indicator 602 or another portion of gaming device 114 may display to the player that the player needs to wager $100 more to receive the comp.

Figure 10:
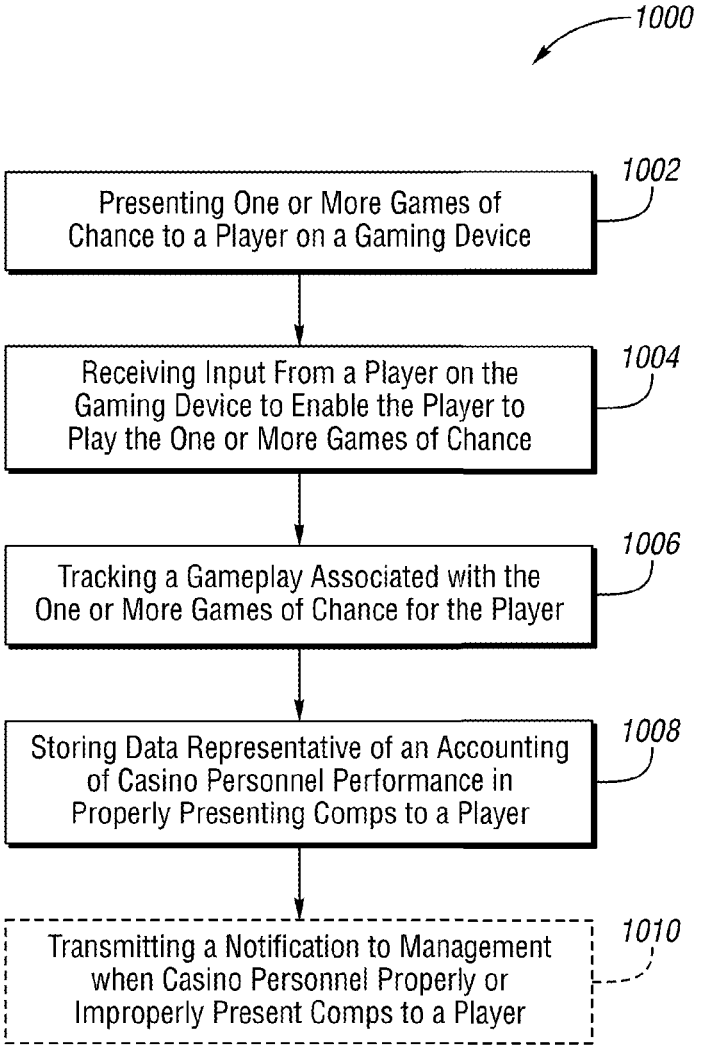
FIG. 10 is a flow diagram of a method indicating an accounting of casino personnel performance in properly presenting comps to a player.

FIG. 10 is a flow diagram of a method 1000 indicating an accounting of casino personnel performance in properly presenting comps to a player. It should be recognized that the performance of other personnel, rather than just casino personnel, may be monitored to account for the performance of properly presenting comps to a player.

One or more games of chance may be presented 1002 to a player on a gaming device, such as EGM 600, kiosk 700, or another gaming device 114. The games of chance may include video reel slots, video poker, sports betting or sport book games, bingo or bingo-related games, keno or keno-related games, and/or any other games of chance. The game or games may be displayed to the player, for example, on one or more displays 310 of gaming device 114.

Input is received 1004 from the player on gaming device 114 to enable the player to play the one or more games of chance. For example, the player may use user interface device 312 to input commands and selections to play the game.

A gameplay associated with the one or more games of chance is tracked 1006 for the player. For example, gaming device 114, local server 110, player reward server 112, and/or WAP server 120 may individually or jointly track the gameplay of the player to enable a determination to be made whether the player is eligible to receive the comp. The tracked gameplay may include an amount of time the player has played on gaming device 114, an amount of money wagered on gaming device 114, an amount of money won or lost on gaming device 114, an amount of money spent by the player at a gaming establishment in which gaming device 114 is located, and/or any other suitable data. In addition to monitoring players who are identified via player cards or other player identification means, unidentified players may also be monitored. In one embodiment, comp indicator 602 indicates to one or more casino personnel whether the player is eligible to receive one or more comps based on the player's gameplay in a similar manner as described above.

In one embodiment, a computing device 300, such as gaming device 114, local server 110, player reward server 112, POS terminal 126, and/or WAP server 120, stores 1008 data representative of an accounting of casino personnel (or other personnel) performance in properly presenting comps to the player. For example, computing device 300 may store a date and time that the personnel gave a comp to the player, the gameplay of the player relevant to determining eligibility for the comp at the time the comp was given, the name of the personnel who gave the comp, the type and/or quantity of the comp, and/or any other suitable details to enable an accurate and complete accounting to be made for the personnel. The accounting may be displayed on computing device 300 (e.g., gaming device 114, POS terminal 126, and/or one of the servers described herein) to enable management, for example, to determine whether the personnel properly presented the comps to the players. In such a manner, an audit and/or a review of the accounting may be performed of the comps provided to ensure that a comp policy of the casino or other gaming establishment has been followed in a satisfactory manner.

In one embodiment, an optional notification may be transmitted 1010 to the player, such as to a mobile device operated or owned by the player, when the player is determined to be eligible to receive the comp. In another embodiment, comp indicator 602 or another portion of gaming device 114 may display an amount of wagering activity or other gameplay that is required to achieve the comp. For example, if the player has wagered $100 and the gaming establishment determines that $200 is the minimum amount needed to be wagered to receive the comp, comp indicator 602 or another portion of gaming device 114 may display to the player that the player needs to wager $100 more to receive the comp.

Figure 11:
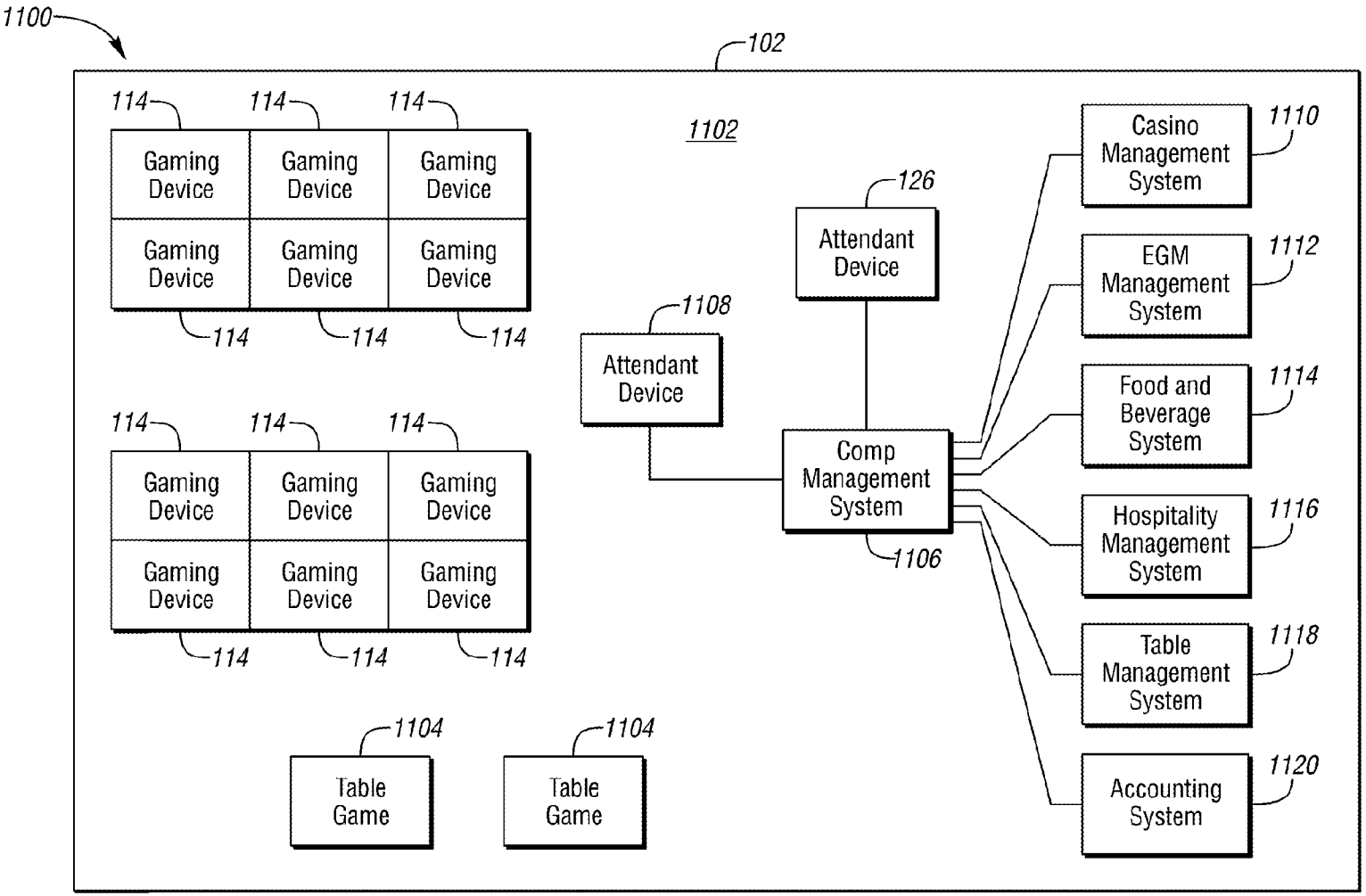
FIG. 11 is a block diagram of a gaming system that may be used to provide a game of chance.

FIG. 11 is a block diagram of an exemplary gaming system 1100 that may be used to implement the comp indicator and other disclosures described herein. While gaming system 1100 is described in the context of a casino environment, gaming system 1100 may be used with any suitable gaming establishment 102.

In one embodiment, gaming system 1100 includes a plurality of gaming devices 114 positioned on a gaming floor 1102. While the following description is directed to an embodiment in which gaming devices 114 are electronic gaming machines (EGMs), it should be recognized that any suitable gaming devices 114 may be used as described above with reference to FIGS. 1 and 2. Gaming system 1100 may also include a plurality of table games 1104, such as blackjack, poker, baccarat, and the like.

In one embodiment, gaming system 1100 includes a comp management system 1106 that may be used to manage, control, and/or implement a comp policy within gaming system 1100. More specifically, in one embodiment, comp management system 1106 may control the operation and interaction of comp indicator 602 with gaming devices 114 as described more fully herein. In one embodiment, comp management system 1106 includes at least one computing device 300.

In one embodiment, gaming system 1100 includes at least one attendant device 1108. Attendant device 1108 may include one or more mobile computing devices 300, such as a tablet computing device or a smartphone. Attendant device 1108 may be carried throughout gaming floor 1102 and may be operated by an attendant, another employee of gaming establishment 102 (such as a manager of the attendant), and/or any other person as desired. Attendant device 1108 may interface with comp management system 1106 to upload gameplay data and/or other data to comp management system 1106, and to receive data from comp management system 1106 regarding the comp eligibility of the players and/or gaming devices 114 of gaming establishment 102. For example, an attendant may enter data into attendant device 1108 regarding a player's name, the player's reward card number, amount wagered or other gameplay data, and/or any other suitable data. The attendant may additionally or alternatively enter data representative of any free beverages or other comps given to a player. The data may be transmitted between attendant device 1108 and comp management system 1106 (or any other system or device) wirelessly or via a wired interface. It should be recognized that attendant device 1108 may also transmit and receive any other suitable data between comp management system 1106 and/or any other suitable system or computing device 300 of gaming system 1100.

In one embodiment, attendant device 1108 may include a global positioning satellite (GPS) device or another geolocation device that is used to determine the location of attendant device 1108. Attendant device 1108 may transmit location coordinates or other data representative of the location of attendant device 1108 to a casino management system 1110 and/or to an electronic gaming machine (EGM) management system 1112, for example, to determine which gaming devices 114 are near attendant device 1108. Alternatively, the location of attendant device 1108 may be triangulated or otherwise determined from a signal transmitted by a wireless network adapter of attendant device 1108, for example.

In one embodiment, casino management system 1110 or another system causes each gaming device 114 to transmit a player's name, the player's reward card number, amount of coin-in or other gameplay data, and/or any other suitable data to attendant device 1108 when attendant device 1108 is determined to be within a predefined distance or proximity (such as within 10 feet) of gaming device 114. Alternatively, gaming devices 114 may automatically transmit the gameplay data to attendant device 1108 (without being directed to transmit the data by casino management system 1110) if gaming device 114 detects that attendant device 1108 is within a predetermined distance from gaming device 114 (e.g., through use of RFID, NFC, or other proximity sensing means of gaming device 114) and/or if attendant device 1108 transmits a signal to gaming device 114 requesting the gameplay data from gaming device 114.

In one embodiment, the attendant may enter beverage orders for players into attendant device 1108, and those beverage orders may be communicated to comp management system 1106, to a food and beverage system 1114, and/or to any other suitable system or device. If the attendant indicates that the beverage is to be comped (i.e., given to the player for free), comp management system 1106 may verify that the player that ordered the beverage is eligible for the comp. More specifically, comp management system 1106 may determine whether the gameplay data indicates that the player is eligible for the comp identified by the attendant. If comp management system 1106 determines that the player is eligible for the comp, attendant device 1108 may present a notification to the attendant that the comp is approved and that the beverage may be given to the player. However, if comp management system 1106 determines that the player is not eligible for the comp, attendant device 1108 may present a notification or error message to the attendant that the player is not eligible and that the comp is denied. While this example has been described with reference to comped beverages, it should be recognized that any suitable comp may be administered as described above.

Gaming system 1100 may include one or more point-of-sale terminals 126. POS terminals 126 may be used to cash out player winnings as described above with reference to FIG. 1, for example. In addition, POS terminals 126 may be used by attendants, managers, or other personnel of gaming establishment 102 to enter beverage orders, to enter food orders, to enter gameplay data, to view gameplay data or comp eligibility status of players, and/or to perform any other suitable function as desired.

Casino management system 1110 may be configured to manage player reward programs, promotional programs, and/or any other suitable operational aspects associated with gaming establishment 102. For example, in one embodiment, casino management system 1110 implements a player reward program while comp management system 1106 implements a comp policy or program. Casino management system 1110 may receive data from any other system within gaming system 1100 and may use the data to provide reports or automated analysis of one or more aspects of gaming establishment 102 and/or gaming system 1100. In one embodiment, casino management system 1110 includes, or is implemented by, player reward server 112 (shown in FIG. 1). Alternatively or additionally, casino management system 1110 may include at least one computing device 300, such as a server.

In one embodiment, casino management system 1110 may integrate one or more programs or policies, such as one or more promotional programs, with the comp policy. For example, a promotion may include emailing or mailing a free beverage or meal offer, a discounted beverage or meal offer, or another suitable offer to a player. Casino management system 1110 may transmit data representative of the offer to comp management system 1106 to integrate the offer with the comp policy. In one embodiment, comp management system 1106 may adjust the player's comp eligibility to reflect the offer given to the player. For example, if the player was mailed or emailed a free beverage offer, comp management system 1106 may automatically set the comp eligibility to a logical "true" value, or may automatically set the player's comp eligibility points to 100% for the comp of a free beverage. Accordingly, the next time that the player plays a game on a gaming device 114, comp indicator 602 of gaming device 114 may automatically indicate that the player is eligible for the comp. In a similar manner, if the player was mailed or emailed an offer for a 50% discount toward a room at an associated hotel, comp management system 1106 may automatically set the comp eligibility points of the player to 50% for the comp of a free hotel room. Accordingly, the next time that the player plays a game on a gaming device 114, comp indicator 602 of gaming device 114 may automatically start out as showing that the player has accumulated 50% of the points required for the comp of a free hotel room.

Additionally or alternatively, holiday or other promotions may be integrated with the comp policy. For example, if casino management system 1110 (or another suitable system) implements a promotion for St. Patrick's Day in which beverages are 50% off, comp management system 1106 may automatically adjust the comp policy such that comp eligibility points toward the comp of a free beverage accumulate twice as fast as normal, or at any other suitably increased rate. Other holiday promotions or other promotions may also be integrated with the comp policy to increase or decrease the accumulation of comp eligibility points for any suitable comps, and/or to adjust the comp policy in any other suitable manner.

In another embodiment, a player reward program implemented by casino management system 1110 (or another suitable system) may be integrated with the comp policy implemented by comp management system 1106 (or another suitable system). For example, the player reward program may implement a tier system in which players may be included in different player reward tiers based on their perceived value and/or historical gameplay. Accordingly, players in different player reward tiers may accumulate comp eligibility points at different rates and/or based on different criteria. For example, a player at the lowest player reward tier may accumulate comp eligibility points at a normal or unenhanced rate, while a player at the next highest player reward tier may accumulate comp eligibility points at an increased rate, such as at a 10% higher rate than the normal rate. Further increases may be included for additional player reward tiers. Additionally or alternatively, higher valued comps may be provided for players at higher player reward tiers. For example, players at the lowest player reward tiers may accumulate points towards lower cost beverage comps, while players at higher player reward tiers may accumulate points to higher cost beverage comps. Accordingly, in one embodiment, players of different player reward tiers may require the same number of comp eligibility points to receive the comp, but they may receive different comps based on their player reward tier level.

In another embodiment, players at different player reward tiers may have different comp eligibility criteria. For example, players at a lowest player reward tier may become eligible for a comp when they have accumulated enough points through coin-in or other gameplay data. In contrast, players at a higher player reward tier may become eligible for a comp based on an amount of time they have been playing at a gaming device 114, such as every 10 minutes, regardless of an amount of coin-in or other gameplay data.

Food and beverage system 1114 may be configured to manage and/or track the sale, preparation, and distribution of food and beverages within gaming establishment 102. In one embodiment, food and beverage system 1114 interfaces with one or more POS terminals 126 to receive orders and/or payment (or comps) for food and/or beverages. Food and beverage system 1114 may also interface with comp management system 1106, for example, to exchange data relating to comps of food and/or beverages. In one embodiment, food and beverage system 1114 includes at least one computing device 300, such as a server.

Food and beverage system 1114 may transmit data representative of food and beverage orders to a bartender or another suitable personnel for preparation of the food and beverage. In addition, food and beverage system 1114 may transmit data representative of the food and beverages order to attendant device 1108 to notify the attendant of the order and/or to notify the attendant when the order is ready to be picked up and delivered to the player.

Hospitality management system 1116 may be configured to manage and/or track the room reservations and other hospitality services associated with gaming establishment 102 and/or any hotel or other lodging affiliated with gaming establishment 102. Hospitality management system 1116 may interface with comp management system 1106, for example, to provide one or more free rooms or rooms at a reduced rate as a result of a player being determined to be eligible for an associated comp. In one embodiment, hospitality management system 1116 includes at least one computing device 300, such as a server.

EGM management system 1112 may be configured to manage the games and other content provided to gaming devices 114. For example, in an embodiment in which one or more gaming devices 114 are EGMs (sometimes known as "slot machines"), EGM management system 1112 may provide the games, game graphics, and other game content to be downloaded and/or installed on gaming devices 114. In one embodiment, EGM management system 1112 includes at least one computing device 300, such as a server.

Table management system 1118 may be configured to manage the operation of one or more table games 1104. In one embodiment, table management system 1118 interfaces with one or more cameras for viewing portions of table games 1104 and players playing table games 1104. Table management system 1118 may also provide chip tracking and inventory (e.g., for chips embedded with RFID or other tracking technology), various reports on gameplay at table games 1104, and the like. In one embodiment, table management system 1118 includes at least one computing device 300, such as a server.

Accounting system 1120 may be configured to manage the accounting and operational expenses of gaming establishment 102. In one embodiment, accounting system 1120 includes at least one computing device 300, such as a server. In one embodiment, accounting system 1120 may interface with auditing system 128 (shown in FIG. 1) and/or accounting interface 416 (shown in FIG. 4) of one or more systems or devices of gaming system 1100. In addition, accounting system 1120 may interface with comp management system 1106 to account for the expenses associated with the comps given through the comp policy. Accounting system 1120 may also transmit data to comp management system 1106 to cause comp management system 1106 to adjust one or more aspects of the comp policy. For example, accounting system 1120 may transmit data requesting that the comp policy increase or decrease the rate that players can accumulate comp eligibility points and/or requesting that the value of the comps be increased or decreased (e.g., by substituting a lesser or more expensive beverage, meal, room, or other comp). Accounting system 1120 may request the change to the comp policy based on the profitability of gaming establishment 102, based on the increase or decrease of the cost of one or more components of the comp (e.g., liquor prices increasing or decreasing, food prices increasing or decreasing, etc.), and/or based on any other suitable criterion or criteria. Alternatively, accounting system 1120 may transmit the foregoing data to comp management system 1106, and comp management system 1106 may make the determination of whether to adjust the accrual rate of comp eligibility points (or to make other adjustments relating to comp eligibility) based on the comp policy.

During operation of gaming system 1100, a comp policy may be identified and administered by comp management system 1106 in conjunction with one or more additional systems or devices of gaming system 1100. The comp policy may identify, for example, the various comps available to be given out to players (such as free beverages, free meals, free rooms, different tiers of free beverages, meals, and rooms, etc.), the points or other progress indicators required for a player to be awarded the comp or comps (referred to herein as "points" or "comp eligibility points" for convenience), the accrual rate of the points for each activity that qualifies to earn points, and the like. Data and/or algorithms representative of the comp policy may be downloaded into gaming devices 114, attendant devices 1108, POS terminals 126, and/or any other suitable device or system to facilitate implementing the comp policy. It should be recognized that the comp policy, or aspects thereof, may be automatically updated or adjusted by casino management system 1110, accounting system 1120, comp management system 1106, and/or any other suitable system or device of gaming system 1100 based on promotions, changes to the pricing or cost of components of the comps, or based on any other suitable data or criteria.

In one example illustrating embodiments described herein, a player plays a game of chance at a gaming device 114, such as an EGM. The player may enter a player reward card (or data representative of the card) into gaming device 114. Gaming device 114 may transmit the data representative of the player reward card to casino management system 1110 for use in identifying the player, authorizing the player to play the game of chance, and tracking gameplay of the player, for example.

As the player plays the game, gaming device 114 tracks gameplay data for the player, including amount of coin-in, win/loss ratio, etc. The gameplay data may be automatically transmitted to comp management system 1106 and/or to other systems or devices, and/or may be stored within gaming device 114 for later retrieval by one or more systems or devices of gaming system 1100. A comp indicator 602 may be displayed on gaming device 114 to indicate to the player and/or to attendants or other personnel when the player is eligible for one or more comps, and/or to indicate the progress made towards becoming eligible for one or more comps. Comp indicator 602 may additionally or alternatively be displayed on one or more POS terminals 126, attendant devices 1108, and/or comp management system 1106, for example.

In one embodiment, comp indicator 602 is displayed on attendant device 1108. When comp indicator 602 indicates that the player is eligible for a comp, the attendant operating attendant device 1108 moves to the player's location on gaming floor 1102, or to the location of gaming device 114 that the player is operating. The attendant may then enter an order for a comped beverage, or another suitable comp that the player is eligible for, in attendant device 1108. Attendant device 1108 may transmit the order to food and beverage system 1114 and/or to comp management system 1106 to verify that the player is eligible to receive the comp and/or to process the order. When the order is transmitted to food and beverage system 1114, preparation and fulfillment of the order (e.g., the beverage) may be initiated, and the order may be completed in a fast and efficient manner. For example, if the attendant enters a beverage order in attendant device 1108, the beverage order may be communicated to a bartender within gaming floor 1102. The bartender may prepare the beverage and have the beverage ready by the time the attendant comes to pick up the beverage. This may save time for the attendant who may otherwise have had to wait at the bar for the bartender to prepare the beverage.

In one embodiment, attendant device 1108 may display a virtual map of gaming floor 1102 and may display gaming devices 114 in proximity to the location of attendant device 1108. When attendant device 1108 is determined to be within a predetermined distance from a gaming device 114, attendant device 1108 may wirelessly receive and display gameplay data from gaming device 114, as well as other data related to the player or game session ("player data"), such as the player name, a tier level relating to the player's comp eligibility and/or player reward program, names of the player's children, spouse, or significant other, the player's favorite beverage or restaurant, and/or any other suitable data. Additionally or alternatively, the player data may be received from comp management system 1106, casino management system 1110, or another suitable system or device.

Additional data may also be transmitted, such as a request for management or security to come to gaming device 114. In one embodiment, the gameplay data and/or player data may be automatically transmitted to attendant device 1108 when attendant device 1108 is determined to be within the predetermined distance from gaming device 114. In another embodiment, only updates to the gameplay data and/or player data may be transmitted to attendant device 1108. For example, the gameplay data and/or player data may only be transmitted to attendant device 1108 if a predetermined time period, such as 10 minutes, has elapsed since the last time the data was transmitted to attendant device 1108, or if sufficient progress has been made in the player's game, such as the coin-in amount has increased by $10 or another predetermined amount, since the last time the data was transmitted to attendant device 1108.

Alternatively, the attendant or operator of attendant device 1108 may select an icon on the virtual map representing a nearby gaming device 114, and in response, attendant device 1108 transmits a request for the gameplay data and/or player data to gaming device 114. In response to the request, gaming device 114 automatically transmits the gameplay data and/or player data to attendant device 1108. The gameplay data and/or player data may be reviewed on attendant device 1108 to determine whether a player of a nearby gaming device 114 is eligible for a comp, and may be reviewed or audited by a manager of the attendant to ensure that the attendant is complying with the comp policy. In one embodiment, if attendant device 1108 is moved within a predetermined proximity (e.g., 10 feet) of a gaming device 114 that a player who is eligible for a comp is playing at, attendant device 1108 may automatically generate a "pop-up" window or dialogue box that notifies the attendant that the player is eligible for the comp. The window or dialogue box may also enable the attendant to order a comped beverage or another comp that the player is eligible for.

In one embodiment, the player may not have accumulated enough points to be eligible for a comp. However, the player may be enabled to "spend" the accumulated points to obtain a reduced value comp or to obtain a discount toward buying the relevant comp. For example, if the player has accumulated 50% of the comp eligibility points required for a free beverage, the player may choose to use those points to obtain a voucher or ticket for a 50% discount (or another suitable percentage) toward the purchase of the beverage. In another embodiment, if the player has accumulated some but not all of the points required for a desired comp, the player may buy the additional points needed to reach comp eligibility using real money or other suitable consideration. For example, if the player has accumulated 90% of the comp eligibility points required for a free room, the player may use real money to buy the additional 10% of the points required.

In one embodiment, if the player has accumulated enough comp eligibility points for a comp to be awarded, but the player does not receive the comp during the time the player is playing at gaming device 114, the player may receive a voucher or ticket that is redeemable for the comp when the player cashes out of gaming device 114 or otherwise ends the gaming session at gaming device 114. In a similar manner, a voucher or ticket that is redeemable for a discount towards purchase of the comp may be given to the player if the player accumulates some, but not all, of the comp eligibility points required for the comp. The voucher or ticket described herein may be printed from gaming device 114, may be printed from POS terminal 126, may be printed from attendant device 1108, may be printed at a remote device (such as a box office computer or a restaurant computer), may be delivered to the player by an attendant, and/or may be wirelessly delivered to the player as a digital voucher or ticket via an application installed on the player's smart phone or tablet, for example.

In another embodiment, a player may install an application on a smart phone, a tablet, or another portable computing device 300 to enable the player to view comp eligibility points and/or status. In one example, if a player accumulates comp eligibility points while playing a game on a gaming device 114, the player may view those points on the application. If the player moves to another portion of gaming floor 1102, such as to a table game 1104 to play a game of blackjack, the player may present the player reward card, or the application, to enable the dealer to enter the player reward card, or the player reward card number that may be displayed on the application, for example, into an attendant device 1108 or another device connected to table management system 1118 or to comp management system 1106. The dealer may also enter gameplay data for the player into attendant device 1108 or another device to track the gameplay of the player at table game 1104. Gameplay data associated with the play of the table game 1104 may therefore be associated with the player reward card and/or may cause the player to accumulate more comp eligibility points. Accordingly, the player may accumulate a portion of the comp eligibility points needed to obtain a comp while playing a first game (e.g., at a gaming device 114) and may accumulate another portion or the remainder of the comp eligibility points needed to obtain the comp while playing a second game (e.g., a table game 1104).

In another embodiment, the player may accumulate a portion of the comp eligibility points at a first gaming device 114 and may accumulate another portion or the remainder of the comp eligibility points at a second gaming device 114. In such an embodiment, the comp eligibility and/or the comp eligibility points may "follow" the player as the player plays on different gaming devices 114 and/or as the player plays different types of games within gaming establishment 102.

In one embodiment, the application may additionally include a geolocation or tracking feature that enables an attendant to locate the player within gaming floor 1102 (for example, with appropriate player consent). Accordingly, if the player accumulates enough points to become eligible for a comp, the application may notify comp management system 1106, casino management system 1110, and/or attendant device 1108, for example. Alternatively, comp management system 1106, casino management system 1110, and/or attendant device 1108 may track the accumulation of the player's comp eligibility points and may determine when the player is eligible for the comp. The attendant may then be dispatched to the player's location (as reported by the application) and the attendant may then order a beverage or procure another suitable comp for the player according to the comp eligibility.

In one embodiment, RFID tags embedded within the chips used at table game 1104 may be tracked by a wireless RFID reader at table game 1104. The wireless RFID reader may transmit gameplay data associated with the player to table management system 1118, to comp management system 1106, to the application installed on the player's device, and/or to any other suitable device or system. The gameplay data may then be used to determine whether the player is eligible for a comp. Alternatively, the dealer at table game 1104 may manually input data into a system (such as table management system 1118) regarding the player's gameplay, and the data may be used to determine comp eligibility as described herein.

While at least some of the embodiments described herein have included associating a player reward card with gameplay data and comp eligibility determinations, in some embodiments, a player who does not use a player reward card (sometimes referred to as an "uncarded player") may still become eligible for comps under the comp policy. In such embodiments, gameplay data associated with the play of a game of chance on a gaming device 114 by the player may still be used to determine the comp eligibility of the player. However, the gameplay data, and thereby the comp eligibility points and/or determination, may be associated with gaming device 114 itself, rather than with a player reward card. Accordingly, if the player accumulates comp eligibility points and/or is determined to be eligible for a comp during the play of the game on gaming device 114, the player may lose those comp eligibility points and/or comp eligibility determination if the player cashes out and/or moves to a different gaming device 114.

In one embodiment, attendant device 1108 may receive gameplay data and/or player data from a gaming device 114 at which an uncarded player is playing a game. The gameplay data and/or player data may be reviewed to determine the player's potential value to gaming establishment 102, the player's potential player reward tier, and/or any other suitable aspect. The attendant may use the data to offer one or more comps to the player in accordance with the comp policy and/or may offer the player the chance to sign up for a player reward card or the like. In one embodiment, an uncarded player may accumulate comp eligibility points at a slower rate than a player who uses a player reward card in an effort to incentivize players to use the player reward cards. As a further incentive for players to sign up for a new player reward card, the attendant may offer the player an increased comp eligibility point accumulation rate for a predetermined period of time (such as a day, a week, etc.) if a player signs up for a new player reward card.

In another embodiment, accumulation of comp eligibility points may be implemented as a side game or a secondary game along with a primary game (e.g., bingo, keno, poker, reel or slot game etc.) provided by gaming device 114. For example, a group of friends or other players may play a primary game of chance at neighboring gaming devices 114, or gaming devices 114 located within a subsection of gaming floor 1102. The comp eligibility and/or comp eligibility points of each player may be compared by comp management system 1106 (or another suitable system) and the first player that becomes eligible for a comp may win a prize or an extra comp, for example. In one example, the first player to become eligible for the comp of a free beverage may receive an additional free beverage for a total of two free beverages, while the other players may only receive the one free beverage upon becoming comp eligible.

In one exemplary embodiment, a comp policy may be implemented by comp management system 1106. Alternatively, the comp policy may be implemented by an EGM 600 and/or by another suitable computing device 300. The comp policy may include a plurality of comp tiers that are used to determine the comp eligibility of the player. For example, the comp policy may include a red tier that indicates the player is not eligible for comps, a yellow tier that indicates the player is eligible for comps but the comps must be approved by an attendant, a manager, or another suitable casino personnel, a green tier that indicates the player is automatically approved for comps, and/or a blue tier that indicates the player is eligible for premium comps. It should be recognized that the colors, the numbers, and the categories of tiers described herein are exemplary only, and that any other colors, numbers, and/or categories of tiers may be used as desired.

In one embodiment, comp management system 1106 may calculate a number of comp eligibility points for the player according to a predetermined algorithm based on one or more comp eligibility criteria that are stored in comp management system 1106. Criteria used by the algorithm may be based one or more of an amount of coin-in by the player at the gaming device, a number of wins or losses of the player at the gaming device, an amount of wagering activity by the player, an amount of money won or lost by the player, the player's loyalty points that have accrued over a period of time, the player's loyalty points in total, the player's loyalty tier level, the player's minimum bet, the player's maximum bet, the player's average bet, the player's time on the gaming device without playing the game of chance, a statistical hold percentage of the gaming device, and a theoretical win of the player during a period of gameplay on the gaming device. The criteria listed herein are non-limiting and exemplary only, and other criteria may be used in addition to, or in place of, the criteria listed herein.

One exemplary algorithm that may be used to calculate the number of comp eligibility points is given by Eq. 1:

$$CEP=PHP+DP+PP \quad \text{(Eq. 1)}$$

where CEP is the number of comp eligibility points, PHP is a number of points based on the player's history of play at one or more gaming establishments 102, DP is a number of points based on the amount of money or credits deposited by the player at a current gaming device 114, and PP is a number of points based on the amount of play the player has engaged in (or an amount wagered over time) at gaming device 114.

In one embodiment, the calculated number of comp eligibility points (CEP) may be used to determine the player's comp eligibility based on Table 1. The comp eligibility points, comp tiers, and comp eligibility determinations listed in Table 1 are exemplary only and should not be viewed as limiting.

TABLE 1

| Comp Eligibility Points (CEP) | Comp Tier | Comp Eligibility |
|---|---|---|
| 0-1.0 | Red | Not comp eligible |
| 1.1-2.0 | Yellow | Comp eligible but approval needed |
| 2.1-9.0 | Green | Comp eligible; comps automatically given |
| 9.1 and above | Blue | Eligible for premium comps; comps automatically given |

In one embodiment, the player history points (PHP) may be calculated in a linear or a non-linear manner by referencing a lookup table of values based on the player's reward tier or loyalty tier. For example, Table 2 may be referenced by comp management system 1106 or another suitable device or system to determine PHP in a non-linear manner. The tiers and PHP values listed are exemplary only and should not be viewed as liming.

TABLE 2

| Reward/Loyalty Tier | Player History Points (PHP) |
|---|---|
| Uncarded player/Tier 0 | 0 |
| Tiers 1-2 | 0 |
| Tiers 3-4 | 1.1 |
| Tiers 5-6 | 2.0 |
| Tiers 7-9 | 6.0 |
| Tier 10 | 9.1 |

In one embodiment, the number of deposit points (DP) may be calculated in a linear or a non-linear manner by referencing a lookup table of values based on the amount of money or credits deposited at the gaming device 114 the player is currently playing at. For example, Table 3 may be referenced by comp management system 1106 or another suitable device or system to determine DP in a non-linear manner. The deposit amounts and DP values listed are exemplary only and should not be viewed as liming.

TABLE 3

| Initial Deposit | Deposit Points (DP) |
|---|---|
| $1-$19 | 0 |
| $20-$50 | 0.2 |
| $51-$99 | 0.3 |
| $100 and above | 0.4 |

In one embodiment, the number of play points (PP) may be calculated in a linear or a non-linear manner by referencing a table of lookup values or by using a suitable algorithm or other calculation. For example, the PP may be calculated in a linear manner by multiplying the amount wagered over time by 0.15, or any other suitable value. Therefore, in one example, if $50 was wagered on gaming device 114 during play of one or more games of chance, the PP may be calculated to be 7.5. The PP may be decreased by 0.02 (or any other value) for every 15 seconds (or any other time period) of inactivity at gaming device 114 (i.e., for every 15 seconds that the player is determined to not be playing a game of chance). In one embodiment, if the total number of comp eligibility points is greater than a predetermined threshold, the PP are not reduced despite periods of inactivity by the player. For example, if the comp eligibility points are greater than 10 in the example above, the PP (and thereby the CEP) is not reduced as a result of inactivity at gaming device 114. However, if the player does not play any more games of chance at gaming establishment 102, the CEP may be reduced or reset to a predetermined value as described more fully herein. Comp eligibility points may follow the player if the player moves from a first gaming device 114 to a second gaming device 114, effectively transferring the comp eligibility points from the first gaming device 114 to the second gaming device 114.

Continuing the example above, if the player is determined to be in the yellow comp tier, the player may be eligible for a comp, but the comp may be subject to approval by an attendant or a manager, for example. In one embodiment, if more than one comp is given to the player while the player is in the yellow comp tier, an alert or message may be transmitted from comp management system 1106 or another suitable system or device to a device or system operated by a manager or other supervisory personnel. Accordingly, The number of comp eligibility points (CEP) may start out at 0 or another suitable initial value before the player begins playing at gaming device 114, and may reset to the initial value after 24 hours or another suitable amount of time has passed without playing at one or more gaming devices 114 at a gaming establishment 102, for example. Data representative of the comp eligibility points and/or the comp eligibility status may be transmitted from comp management system 1106 (or another suitable system or device) to gaming device 114. Gaming device 114 may then display the comp eligibility points and/or the comp eligibility status on comp indicator 602, for example.

While the above-described comp policy included a comp eligibility calculation or determination based on Eq. 1, it should be recognized that any suitable algorithm, calculation, or comp eligibility determination may be utilized as desired. For example, different gaming establishments 102 may implement different algorithms, different comp eligibility criteria, or use different values within the algorithm, to determine comp eligibility for players and may include using point values or any other suitable means. As a further example, instead of using comp eligibility points, any other suitable progress indicator may be used to determine or indicate the eligibility of a player to receive one or more comps.

Figure 12:
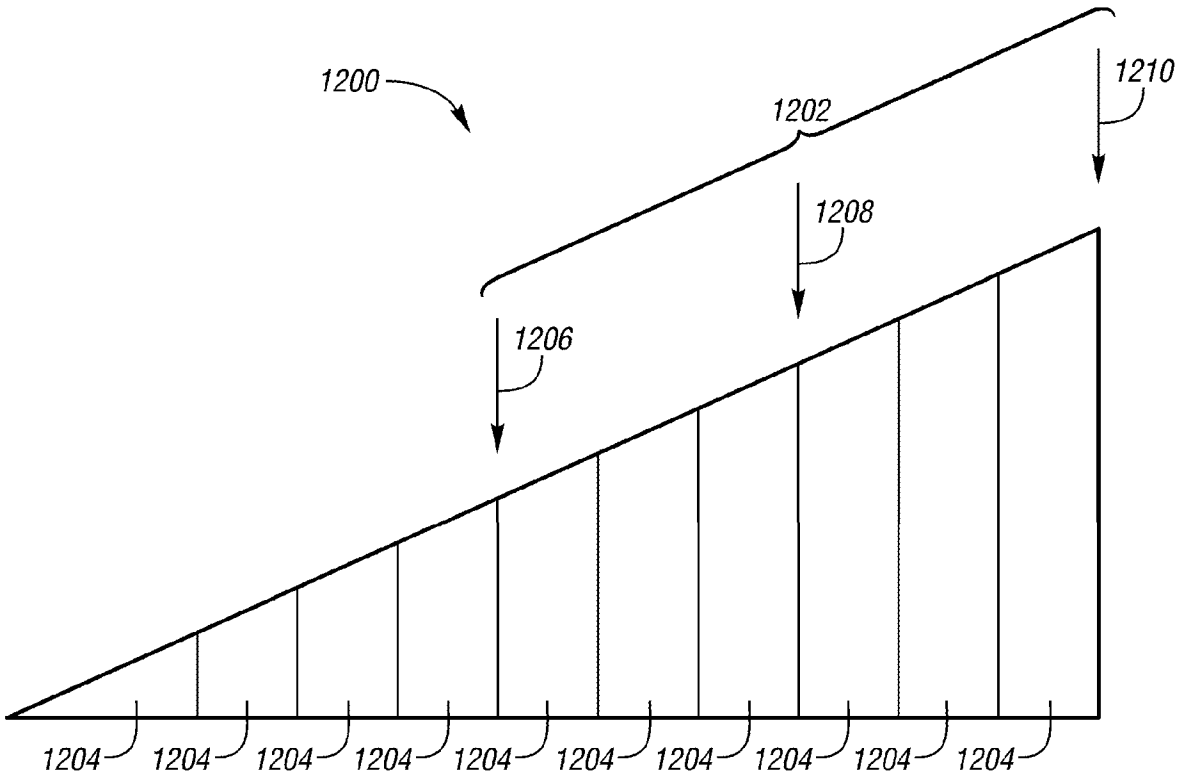
FIG. 12 is a block diagram of another comp indicator image that may be used with one or more gaming devices described herein.

FIG. 12 illustrates an alternative comp indicator image 1200 that may be used with EGM 600 (shown in FIGS. 6A and 6B), kiosk 700 (shown in FIG. 7), and/or other gaming devices 114 or computing devices 300 as described herein. Comp indicator image 1200 may be a virtual image displayed on a monitor or other display of EGM 600, or may be incorporated within one or more other components of EGM 600 or another gaming device 114, such as candle devices 604 or player tracking modules, for example.

In one embodiment, comp indicator image 1200 may include a plurality of comp levels or tiers 1202 that a player may become eligible to be awarded. While 3 tiers 1202 are illustrated in FIG. 12, it should be recognized that any suitable number of tiers 1202 may be provided.

Comp indicator image 1200 is illustrated as having a plurality of sections 1204 that indicate progress towards each tier 1202. However, it should be recognized that sections 1204 may be removed such that no gradations are displayed between tiers 1202, or sections 1204 may be replaced with any other gradation indicator.

During the play of a game on a gaming device 114, a player may accumulate comp eligibility points, or other comp eligibility progress designators. As the player accumulates the comp eligibility points, sections 1204 of comp indicator image 1200 may incrementally be filled in from the left of the image to the right. Each section 1204 may be filled in all at once, or may be progressively filled in until the entire section 1204 is filled. When the player has accumulated enough comp eligibility points to fill in each section 1204 of a first tier 1206, the player may be eligible for a comp associated with first tier 1206. For example, the player may be eligible for a free beverage upon reaching first tier 1206. In one embodiment, if the player receives the comp for first tier 1206, the comp eligibility points are reset to 0 or are reduced by the amount needed to reach first tier 1206. Alternatively, the player may receive the comp but continue accumulating comp eligibility points without the points being reduced.

If the player accumulates enough comp eligibility points to fill in each section 1204 of a second tier 1208 (as well as the underlying sections 1204 of first tier 1206), the player may be eligible for a comp associated with second tier 1208. For example, the player may be eligible for a free meal upon reaching second tier 1208. In one embodiment, if the player receives the comp for second tier 1208, the comp eligibility points are reset to 0, are reduced by the amount needed to reach second tier 1208 from first tier 1206, or are reduced by the total amount of points needed to reach second tier 1208 from 0. Alternatively, the player may receive the comp but continue accumulating comp eligibility points without the points being reduced.

Likewise, if the player accumulates enough comp eligibility points to fill in each section 1204 of a third tier 1210 (as well as the underlying sections 1204 of first tier 1206 and second tier 1208), the player may be eligible for a comp associated with third tier 1210. For example, the player may be eligible for a free room upon reaching third tier 1210. In one embodiment, if the player receives the comp for third tier 1210, the comp eligibility points are reset to 0, are reduced by the amount needed to reach third tier 1210 from second tier 1208, or are reduced by the total amount of points needed to reach third tier 1210 from 0. Alternatively, the player may receive the comp but continue accumulating comp eligibility points without the points being reduced.

While a variety of embodiments have been described herein for comp indicator 602, including a variety of comp indicator images 702 and 1200, it should be recognized that any or all of the embodiments may be used within gaming establishment 102. It should also be recognized that each gaming device 114 within gaming establishment 102 may have a different comp indicator 602 displayed or implemented. For example, comp management system 1106 or another system or device may be programmed to provide each of the comp indicators 602 and/or comp indicator images 702 and/or 1200 described herein, and may download or otherwise provide different comp indicators 602 and/or comp indicator images 702 and/or 1200 to different gaming devices 114 or groups of gaming devices 114 within gaming establishment 102 as desired.

FIG. 13 illustrates an exemplary compliance report 1300 that may be generated by comp management system 1106 or by another suitable system or device of gaming system 1100 (both shown in FIG. 11). Compliance report 1300 may be used by management of gaming establishment 102, for example, to audit and/or review the adherence of one or more attendants to an established comp policy.

In one embodiment, compliance report 1300 may include one or more compliance metrics displayed within a plurality of reporting fields 1302 that may include, for example, a player name 1304, a player reward number 1306, a number of comps earned 1308, a gaming device identifier 1310, a number of comps given 1312, a determination whether an attendant is in compliance with the comp policy (hereinafter referred to as an "in policy determination 1314"), a determination whether the attendant is out of compliance with the comp policy (hereinafter referred to as an "out of policy determination 1316"), a number of comp errors 1318, and/or an error rate 1320 of the attendant. Compliance report 1300 is configurable such that reporting fields 1302 may be added, removed, or rearranged as desired. Each row of compliance report 1300 may be configured to identify one player and to identify the attendant's compliance with the comp policy with regard to the player. Other compliance metrics may be included within compliance report 1300, such as a time the comp was given to the player, a time compliance report 1300 was generated, an identification of the player, a date for the compliance metric and/or compliance report 1300, a name of the attendant assigned to the player, a department the attendant is assigned to, a comp status indicating the player's eligibility to receive the comp, a type of the comp, an amount of the comp, and/or any other suitable metrics or determinations.

Player name 1304 may be the name identified on the player reward card for the player, if applicable. If the player does not have a player reward card, the player name 1304 field may be left blank or may be populated with "Unidentified" or another entry that indicates the player is unidentified.

Player reward number 1306 may be the number or other identified listed on the player reward card for the player. If the player does not have a player reward card, the player reward number 1306 field may be left blank or filled with an entry that indicates the player does not have a player reward card.

Number of comps earned 1308 refers to the number of comps that the player has earned during play at a gaming device 114 and/or during play at a plurality of gaming devices 114 within gaming floor 1102 or gaming establishment 102. Number of comps earned 1308 may be reported by gaming device 114, attendant device 1108, POS terminal 126, or comp management system 1106, for example, or any other suitable device or system.

Gaming device identifier 1310 is a serial number or another suitable identifier of gaming device 114 that the player is currently playing on, or the gaming device 114 that the player was playing on during the timeframe encompassed by compliance report 1300.

Number of comps given 1312 refers to the number of comps that the player has been given during play at a gaming device 114 and/or during play at a plurality of gaming devices 114 within gaming floor 1102 or gaming establishment 102. Number of comps given 1312 may be reported by gaming device 114, attendant device 1108, POS terminal 126, or comp management system 1106, for example, or any other suitable device or system.

In policy determination 1314 and out of policy determination 1316 are indications of whether the attendant has complied with the comp policy with respect to a player. If the attendant has complied with the comp policy with respect to a player, in policy determination 1314 may include a check mark or another suitable indicator for the row corresponding to the player. In contrast, if the attendant has not complied with the comp policy with respect to a player, out of policy determination 1316 may include a check mark or another suitable indicator for the row corresponding to the player.

Number of comp errors 1318 may indicate the number of free beverages or other comps that were erroneously given to the player, for example, when the player was not eligible for the comps. In one embodiment, number of comp errors 1318 may also include the number of free beverages or other comps that were not given to the player despite the player being eligible for the comps.

Error rate 1320 may indicate an overall percentage of comp errors for the attendant during the attendant's shift or other time frame. In one embodiment, comp management system 1106, or another suitable system, may calculate error rate 1320 by dividing the total number of comp errors 1318 incurred by the attendant by the total number of comps that the attendant has given to all players during the attendant's shift. Alternatively, error rate 1320 may be calculated by dividing the total number of out of policy determinations 1316 by the total number of players served by the attendant (i.e., the sum of in policy determinations 1314 and out of policy determinations 1316), or by any other suitable formula. While the above embodiment has been described with reference to a total error rate 1320, it should be recognized that any suitable compliance metric or metrics may be calculated for one or more attendants to quantify the attendant's compliance with the comp policy.

In one embodiment, an alert or message may be transmitted to one or more supervisors or managers of the attendant if the attendant is determined to be out of compliance with the comp policy. For example, if the total number of comp errors 1318 for the attendant exceeds a predetermined number, an alert may be transmitted by comp management system 1106 or another suitable system to a device operated and/or carried by the supervisor or manager of the attendant. Additionally or alternatively, if error rate 1320 exceeds a predetermined number or percentage, an alert may be transmitted by comp management system 1106 or another suitable system to a device operated and/or carried by the supervisor or manager of the attendant.

In one embodiment, comp management system 1106 receives data from food and beverage system 1114 regarding the number of free beverages prepared by one or more bartenders or other personnel. Comp management system 1106 may also receive data from attendant devices 1108 and/or POS terminals 126 regarding the number of free beverages provided to players within gaming establishment 102. Comp management system 1106 may compare the number of free beverages prepared and the number of free beverages provided to players to determine whether the free beverages are being accounted for properly between attendants and bartenders, for example. If the number of free beverages prepared does not match the number of free beverages provided to the players, comp management system 1106 may determine that an inconsistency exists and may send an alert to one or more supervisors or managers and/or may generate a report (such as compliance report 1300) that identifies the inconsistency. In such a manner, comp management system 1106 (or another suitable system) may provide an audit of free beverages or other comps within gaming establishment 102. In one embodiment, one or more automated beverage dispensing systems may also transmit data to comp management system 1106 (or another suitable system) to provide further information regarding the total number of beverages dispensed, for example, to assist with the beverage audit.

While the foregoing embodiments have described a centralized system for determining comp eligibility (e.g., comp management system 1106), it should be recognized that a decentralized system may alternatively or additionally be used to determine comp eligibility. For example, one or more gaming devices 114 may include hardware and/or software that may track gameplay data for a player playing a game of chance on gaming device 114, and that may determine comp eligibility of the player. In such an embodiment, gaming device 114 may notify an attendant of the comp eligibility of a player by transmitting data to attendant device 1108 and/or POS terminal 126, and/or by activating comp indicator 602 of gaming device 114, for example.

Figure 14A:
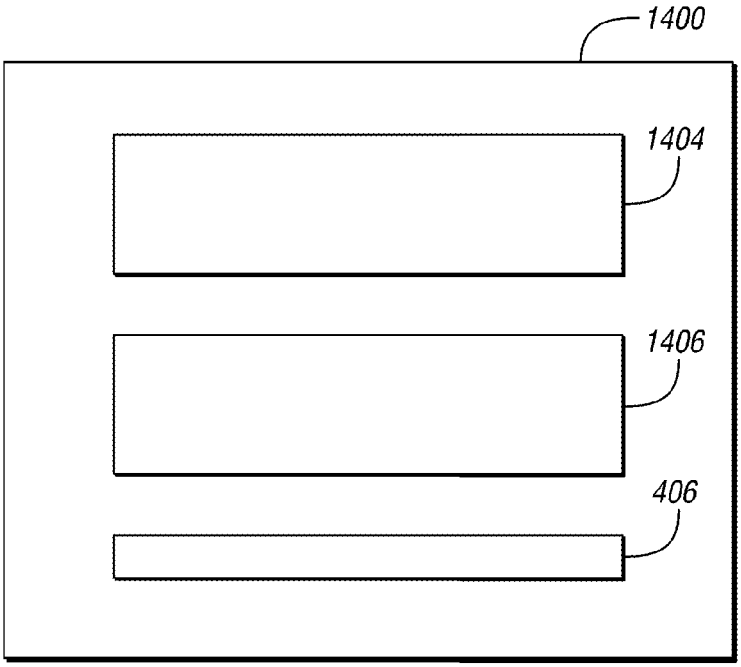
FIGS. 14A-14B are block diagrams of exemplary player tracking modules that may be used with one or more gaming devices described herein.
Figure 14B:
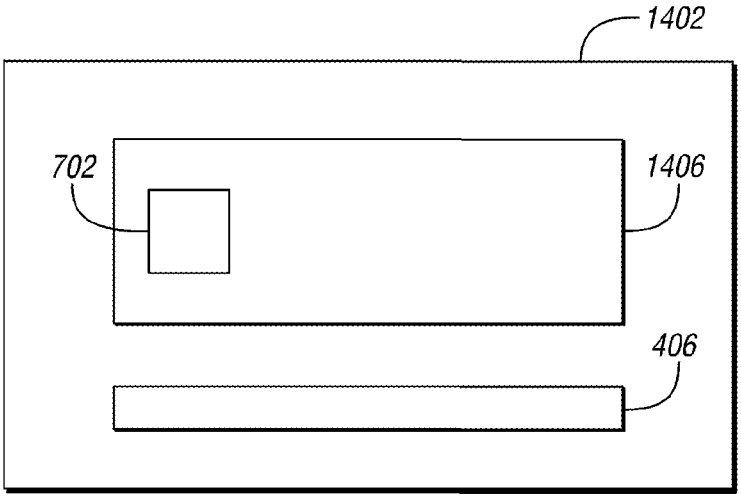

FIG. 14A is a block diagram of an exemplary player tracking module 1400 that may be used with one or more gaming devices 114 (shown in FIG. 1). FIG. 14B is a block diagram of another exemplary player tracking module 1402 that may be used with one or more gaming devices 114 (shown in FIG. 1). In one embodiment, player tracking module 1400 or player tracking module 1402 may be used in place of card reader 406, or card reader 406 may be incorporated within player tracking module 1400 and/or player tracking module 1402. In some embodiments, player tracking module 1400 and/or player tracking module 1402 may be externally mounted on or connected to gaming device 114. In such embodiments, player tracking modules 1400 and/or 1402 may be considered to be a part of gaming device 114.

Referring to FIG. 14A, in one embodiment, player tracking module 1400 may be implemented as an LED-based module that is incorporated into gaming device 114. In such an embodiment, player tracking module 1400 includes user input device 1404, display 1406, and card reader 406. Alternatively, one or more components of player tracking module 1400 may be omitted in certain embodiments.

User input device 1404 may be a numerical keypad, an arrangement of buttons, and/or any other suitable input device. In one embodiment, user input device 1404 may be implemented as user interface device 312 (shown in FIG. 3). User input device 1404 enables a player to access account balances or other information associated with the player reward card. User input device 1404 may also enable the player to redeem one or more comps that the player has become eligible for during play of one or more games on gaming device 114 or during prior gaming sessions, for example. In one embodiment, user input device 1404 may also receive input from the player to print one or more tickets or vouchers for one or more earned comps, and/or to enter any other input associated with the comps.

Display 1406 may be an LED screen that displays data associated with the player reward card. Display 1406 may alternatively be implemented as display 310 (shown in FIG. 3). In one embodiment, display 1406 may also display comp indicator 602, comp indicator image 702 or 1200, and/or data associated with the determination of whether the player is eligible for one or more comps. For example, display 1406 may display the player's progress toward becoming eligible for one or more comps, the type of comp that the player is eligible to receive, and/or any other suitable data relating to comp eligibility and comp redemption.

Referring to FIG. 14B, in one embodiment, player tracking module 1402 may be implemented as an LCD-based module that is incorporated into gaming device 114. In such an embodiment, player tracking module 1402 includes display 1406 and card reader 406. In one embodiment, player tracking module 1402 may be substantially similar to player tracking module 1400 (shown in FIG. 14A) with the exception that display 1406 is a touch sensitive LCD screen that incorporates the functionality of user input device 1404. Accordingly, in one embodiment, display 1406 may display comp indicator image 702 or 1200, or another representation of comp indicator 602.

FIGS. 15A-15E illustrate exemplary user interfaces that may be displayed on display 1406 of player tracking module 1402 (both shown in FIG. 14B), for example. The number and arrangement of user interfaces shown in FIGS. 15A-15E are merely illustrative, and it should be recognized that any suitable number and/or arrangement of user interfaces may be used as desired. Alternatively, the user interfaces illustrated in FIGS. 15A-15E may be displayed in other locations of gaming device 114, such as within a portion of display 1406 (e.g., in a "picture-in-picture" mode or the like).

Figure 15A:
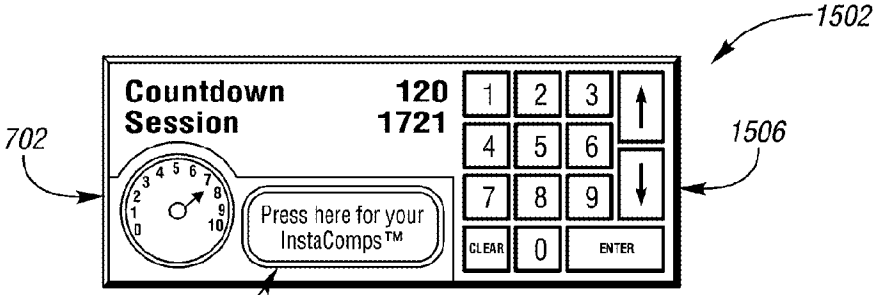
FIGS. 15A-15E are screen captures of exemplary user interfaces that may be used to display and redeem one or more comps on a gaming device described herein.

Referring to FIG. 15A, a first user interface 1502 may be displayed to the player during play of the game of chance on gaming device 114. First user interface 1502 may include comp indicator image 702, a comp redemption icon 1504, and a keypad 1506. While the embodiments described herein reference comp indicator image 702, it should be recognized that comp indicator image 1200 may be included instead of, or in addition to, comp indicator image 702.

Comp indicator image 702 displays the progress of the player toward achieving one or more comps. In the example shown in FIG. 15A, an arrow of comp indicator image 702 may be displayed in a first color, such as red, to indicate that the player is ineligible for a comp, and may be displayed in a second color, such as green, to indicate that the player is eligible for a comp. Alternatively, any other suitable portion of comp indicator image 702 may be used to display the comp eligibility and/or progress towards comp eligibility for the player.

Comp redemption icon 1504 may be used by the player to redeem one or more comps while the player is playing a game at gaming device 114. Accordingly, the player may redeem the comp or comps whenever the player desires, rather than having to wait for an attendant to come and take the player's order.

Figure 15C:
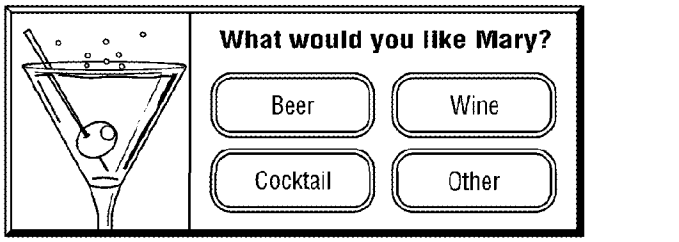
Figure 15B:
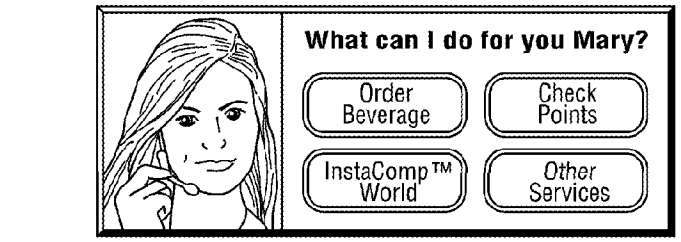

Referring to FIG. 15B, a second user interface 1508 may be displayed to the player on gaming device 114. In one embodiment, second user interface 1508 is displayed when the player selects comp redemption icon 1504 (shown in FIG. 15A). Second user interface 1508 may display, for example, one or more icons that enable the player to order a beverage (i.e., redeem the comp in exchange for the beverage), check comp eligibility points, order another good or service (i.e., redeem the comp in exchange for the good or service), and/or perform any other function or service with respect to the redemption of one or more comps. It should be recognized that the icons shown in FIG. 15B are merely illustrative, and any other suitable icons may be displayed within second user interface 1508 as desired.

Referring to FIG. 15C, a third user interface 1510 may be displayed to the player on gaming device 114. In one embodiment, third user interface 1510 is displayed when the player selects an icon to order a beverage within second user interface 1508. In such an embodiment, third user interface 1510 may display, for example, a list of available beverage categories that the player may select from when redeeming the comp. It should be recognized that the icons shown in FIG. 15C are merely illustrative, and any other suitable icons may be displayed within third user interface 1510 as desired.

Figure 15E:
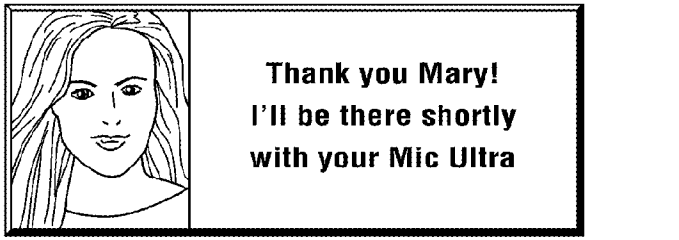
Figure 15D:
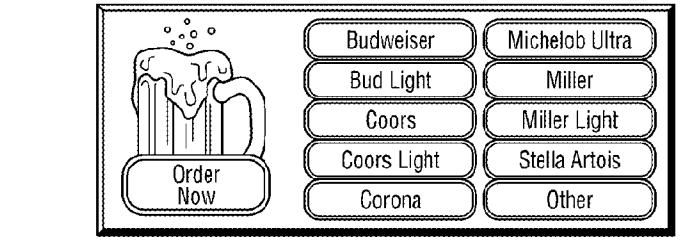

Referring to FIG. 15D, a fourth user interface 1512 may be displayed to the player on gaming device 114. In one embodiment, fourth user interface 1512 is displayed when the player selects an icon to order a beverage category within third user interface 1510. For example, if the player selected the beverage category of "beer" within third user interface 1510, fourth user interface 1512 may display a list of available beers that the player may order when redeeming the comp. It should be recognized that the icons shown in FIG. 15D are merely illustrative, and any other suitable icons may be displayed within fourth user interface 1512 as desired.

Referring to FIG. 15E, a fifth user interface 1514 may be displayed to the player on gaming device 114. In one embodiment, fifth user interface 1514 is displayed when the player selects an icon to order a beverage (e.g., a beer in this example) within fourth user interface 1512. In response to the player's selection of the desired beverage (or other comp in alternative embodiments), fifth user interface 1514 may display a message that the beverage (or other comp) has been ordered. The message may also indicate that the beverage will be brought to the player, or that the comp will otherwise made available to the player in embodiments in which the player selected a good or service other than a beverage for redeeming the comp. It should be recognized that the message shown in FIG. 15E is merely illustrative, and any other suitable messages and/or icons may be displayed within fifth user interface 1514 as desired.

In one embodiment, after the desired comp has been selected (i.e., the desired good or service to be exchanged for the earned comp), data representative of the selected comp may be transmitted to attendant device 1108, comp management system 1106, food and beverage system 1114, and/or to any other suitable device or system to accomplish the redemption of the comp. For example, if the player has selected a beverage as the desired comp, data representative of the beverage order may be transmitted to food and beverage system 1114 to cause a bartender or other suitable person to prepare the beverage. The data representative of the order may also be transmitted to attendant device 1108 of the attendant assigned to the player to notify the attendant that the beverage needs to be brought to the player. Other systems may also be notified of the order, such as comp management system 1106 and casino management system 1110, for example, to update compliance report 1300 and/or to update records relating to the comp policy and/or the player's comp redemption history. The player's comp eligibility points may also be adjusted to reflect the redemption of the comp, as described above.

In other embodiments, the user interfaces described herein may enable the player to select one or more shows, spa services, valet services, dry cleaning services, room services, and/or other suitable goods or services for which to redeem the comp. For example, the player may desire to redeem the comp in exchange for tickets to a show within gaming establishment 102. Gaming device 114 may communicate with other suitable systems or devices, such as one or more computing devices associated with a box office within gaming establishment 102, to retrieve data representative of which shows are available at which show times, the available seats, how many tickets are available, and the like. In such an example, the user interface displayed on display 1406 (or elsewhere on gaming device 114) may present the available shows, show times, and seats to the player, and the player may select the show, show times, and seats using gaming device 114. Gaming device 114 may then transmit data representative of the selected show, show times, and seats to the box office systems or devices to reserve the seats at the show at the selected show times, and may cause the box office devices or systems to print tickets for the player or to reserve the tickets for the player. Alternatively, gaming device 114 may print the tickets for the show using printer 410, for example. In another embodiment, gaming device 114 (or another suitable device or system) may transmit data to an application stored on the player's mobile phone or portable device, and the application may generate one or more virtual tickets that enable the player to attend the show. The above examples are merely illustrative, and other services or goods may be ordered or reserved for the player as redemption for the comp in a similar manner.

In another embodiment, the player reward program may interface with the comp policy or program to enable the player to redeem one or more comps (e.g., using gaming device 114 or by an attendant using attendant device 1108 or POS terminal 126) in exchange for one or more rewards administered under the player reward program.

The systems, methods, and examples described herein should be viewed as illustrative rather than limiting. For example, while the embodiments described herein refer to games of video reel slots, video poker, bingo and keno (or games related thereto), it should be recognized that the systems and methods described herein may be used with any suitable game of chance. Additionally, any number and type of house indicia and/or player indicia may be used with player cards during the game. Player cards, keno boards, and bingo flashboards may be of any suitable size or shape as desired to comply with relevant gaming regulations.

In addition, components of devices or systems described herein may be used in, and/or combined with, other devices or systems described herein unless otherwise specified. Likewise, the functionality of the systems and devices described herein may be used in, combined with, and/or incorporated into other systems and devices described herein unless otherwise specified. For example, two or more of the systems or devices described herein may be combined together, and/or one or more of the systems or devices described herein may be split into two or more other systems or devices.

Unless otherwise specified, "a" or "an" means one or more of a referenced object or step. Furthermore, unless otherwise specified, each method described herein is not limited to the order in which the steps of each method are described or introduced. Rather, the steps may be rearranged in any suitable order, may be omitted, and/or may be combined with steps of other methods as desired. In addition, aspects or components of each embodiment and/or figure described herein may be omitted, or may be combined with, or modified to include, aspects or components of any other embodiment and/or figure unless otherwise specified.

Unless otherwise specified, the phrase "at least one of A and B" means one or more of A alone, one or more of B alone, or one or more of the combination of A and B.

This written description uses examples to describe embodiments of the disclosure, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A system, comprising:

a gaming device, comprising:

a processor programmed to provide a game of chance to a player, wherein gameplay data is generated during play of the game of chance;

an electronic storage device configured to store gameplay data for the game of chance;

a user interface device configured to receive input from the player to enable the player to play the game of chance;

a payment input device configured to enable the player to input money or credits for use in the game of chance;

a payment output device configured to enable the player to withdraw money or credits from said gaming device;

a card reader device configured to receive data from a player reward card; and a randomization device configured to randomly determine a game outcome for the game of chance;

a comp indicator communicating with said gaming device, said comp indicator configured to provide an indication if the player is determined to be eligible for a comp; and a computing device coupled to at least one of said gaming device and said comp indicator, said computing device configured to:

receive the gameplay data from said gaming device;

determine whether the player is eligible for the comp based on the gameplay data;

and transmit data representative of whether the player is determined to be eligible for the comp to at least one of said comp indicator and said gaming device, wherein the player accrues comp eligibility points based on a gameplay of the player upon a determination that the player is a member of a first tier of a player reward program, and wherein the player is automatically awarded the comp, regardless of gameplay, upon a determination that the player is a member of a second tier of the player reward program.

2. The system of claim 1, wherein said computing device is configured to determine that the player is eligible for the comp based upon a determination that the player has reached a first comp tier.

3. The system of claim 1, wherein said computing device is configured to award the comp only in response to a player request if the player has reached a first comp tier, and to automatically redeem the comp if said computing device determines that the player has reached a second comp tier.

4. The system of claim 1, wherein a first amount of comp eligibility points are earned from a first amount of gameplay of the player, and said computing device is configured to determine that the player has reached the first comp tier when the player has earned the first amount of comp eligibility points.

5. The system of claim 4, wherein a second amount of comp eligibility points are earned from a second amount of gameplay of the player, and said computing device is configured to determine that the player has reached the second comp tier when the player has earned the second amount of comp eligibility points.

6. The system of claim 1, wherein, upon a determination that the player has redeemed the comp, said computing device is configured to reduce the comp eligibility points accrued by the player by a corresponding amount of comp eligibility points.

7. The system of claim 1, wherein said comp indicator comprises a comp indicator image displayed on said gaming device, and wherein the comp indicator image displays at least a first comp tier.

8. The system of claim 1, wherein said comp indicator comprises a comp indicator displayed on said gaming device, and wherein the comp indicator includes a plurality of sections, each representing a different threshold of gameplay of the player.

9. The system of claim 1, wherein said comp indicator comprises a plurality of sections and is configured to display a corresponding section as being filled in when an amount of gameplay of the player reaches a corresponding threshold for that section.

10. The system of claim 1, wherein the player accrues comp eligibility points at a first rate if the player is determined to be a member of the first tier of the player reward program, and the player accrues comp eligibility points at a second rate if the player is determined to be a member of the second tier of the player reward program.

11. The system of claim 1, wherein said gaming device comprises a player tracking module, and wherein said comp indicator is displayed by said player tracking module.

12. The system of claim 1 wherein the first tier of the player reward program is lower than the second tier of the player reward program.

13. The system of claim 1 wherein the indication that the player is eligible for the comp is provided via the payment output device.

14. The system of claim 1 wherein the comp indicator provides the indication that the player is eligible for the comp by illuminating a light associated with the gaming device.

15. The system of claim 14 wherein the light is attached to the gaming device.

16. The system of claim 1 wherein the comp indicator provides a comp notification that the player is eligible for the comp in response to the computing device determining that the player is eligible for the comp.

17. A system, comprising:

a gaming device, comprising:

a processor programmed to provide a game of chance to a player, wherein gameplay data is generated during play of the game of chance;

an electronic storage device configured to store gameplay data for the game of chance;

a user interface device configured to receive input from the player to enable the player to play the game of chance;

a payment input device configured to enable the player to input money or credits for use in the game of chance;

a payment output device configured to enable the player to withdraw money or credits from said gaming device; and a randomization device configured to randomly determine a game outcome for the game of chance;

a comp indicator in communication with said gaming device, said comp indicator configured to provide an indication if the player is determined to be eligible for a comp; and a computing device coupled to said gaming device, said computing device configured to:

receive the gameplay data from said gaming device;

determine whether the player is eligible for the comp based on the gameplay data; and transmit data representative of whether the player is determined to be eligible for the comp to said gaming device, wherein, upon a determination that the player has redeemed the comp, said computing device is configured to maintain a number of comp eligibility points earned by the player without reducing the comp eligibility points by an amount of comp eligibility points associated with the comp.

18. The system of claim 1, wherein the comp is a first comp, and wherein the player becomes eligible for the first comp after accruing a first amount of comp eligibility points and becomes eligible for a second comp after accruing a second amount of comp eligibility points.

19. The system of claim 18, wherein, upon a determination that the player has redeemed the second comp, said computing device is configured to reduce the comp eligibility points accrued by the player by the first amount of comp eligibility points and the second amount of comp eligibility points.

20. The system of claim 18, wherein, upon a determination that the player has redeemed the second comp, said computing device is configured to reduce the comp eligibility points accrued by the player by the second amount of comp eligibility points.

21. The system of claim 18, wherein, upon a determination that the player has redeemed the second comp, said computing device is configured to maintain a number of comp eligibility points earned by the player without reducing the comp eligibility points by the first amount of comp eligibility points or the second amount of comp eligibility points.

22. A method of administering a comp policy, said method comprising:

presenting a game of chance to a player on a gaming device;

enabling the player to input money or credits for use in the game of chance using a payment input device of the gaming device;

enabling the player to withdraw money or credits from the gaming device using a payment output device of the gaming device;

providing a comp indicator in communication with the gaming device, wherein the comp indicator is configured to provide an indication if the player is determined to be eligible for a comp;

generating gameplay data associated with the game of chance for the player using the gaming device;

receiving input from the player at the gaming device to enable the player to play the game of chance;

randomly determining a game outcome for the game of chance using a randomization device;

transmitting the gameplay data from the gaming device to a computing device;

determining, by the computing device, whether the player is eligible for the comp based on the gameplay data;

transmitting data representative of whether the player is determined to be eligible for the comp from the computing device to the gaming device;

determining that the player has redeemed the comp; and maintaining a number of comp eligibility points earned by the player without reducing the comp eligibility points in response to the comp being redeemed.

23. The method of claim 22, further comprising determining that the player is eligible for the comp based upon a determination that the player has reached a first comp tier.

24. The method of claim 22, further comprising determining that the player is eligible to redeem the comp upon reaching a first comp tier and automatically redeeming the comp if the computing device determines that the player has reached a second comp tier.

25. The method of claim 22, wherein a first amount of comp eligibility points are earned from a first amount of gameplay of the player, said method further comprising determining that the player has reached a first comp tier when the player has earned the first amount of comp eligibility points.

26. The method of claim 25, wherein a second amount of comp eligibility points are earned from a second amount of gameplay of the player, said method further comprising determining that the player has reached the second comp tier when the player has earned the second amount of comp eligibility points.

27. The method of claim 22, wherein the comp is a first comp, and wherein the player becomes eligible for the first comp after accruing a first amount of comp eligibility points and becomes eligible for a second comp after accruing a second amount of comp eligibility points.

28. The method of claim 27, further comprising:

determining that the player has redeemed the second comp; and reducing the comp eligibility points accrued by the player by the first amount of comp eligibility points and the second amount of comp eligibility points.

29. The method of claim 27, further comprising:

determining that the player has redeemed the second comp; and reducing the comp eligibility points accrued by the player by the second amount of comp eligibility points.

30. The method of claim 27, further comprising:

determining that the player has redeemed the second comp; and maintaining the number of comp eligibility points earned by the player without reducing the comp eligibility points by the second amount of comp eligibility points.

31. The method of claim 22, wherein the comp indicator includes a comp indicator image, said method comprising displaying a first comp tier within the comp indicator image.

32. The method of claim 22, further comprising displaying a plurality of sections within the comp indicator associated with a first comp tier, wherein each section of the plurality of sections represents a different threshold of gameplay of the player.

33. The method of claim 22, further comprising filling in each section of a plurality of sections within the comp indicator when an amount of gameplay of the player reaches a respective threshold for each section.

34. The method of claim 22, further comprising causing the player to accrue comp eligibility points at a first rate if the player is determined to be a member of a first tier of a player reward program, and causing the player to accrue comp eligibility points at a second rate if the player is determined to be a member of a second tier of the player reward program.

35. The method of claim 22, further comprising causing the player to accrue comp eligibility points based on a gameplay of the player upon a determination that the player is a member of a first tier of a player reward program, and causing the player to be automatically eligible for the comp, regardless of gameplay, upon a determination that the player is a member of a second tier of the player reward program.

36. The method of claim 22, wherein the gaming device includes a player tracking module, said method further comprising displaying the comp indicator by the player tracking module.

37. A gaming device, comprising:

a processor programmed to provide a game of chance to a player and to determine whether the player is eligible for a comp;

an electronic storage device configured to store gameplay data for the game of chance;

a user interface device configured to receive input from the player to enable the player to play the game of chance;

a payment input device configured to enable the player to input money or credits for use in the game of chance;

a payment output device configured to enable the player to withdraw money or credits from said gaming device;

a card reader device configured to receive data from a player reward card;

a randomization device configured to randomly determine a game outcome for the game of chance; and a comp indicator configured to be activated upon a determination that the player is eligible for a comp, wherein comp eligibility points accrue based on a gameplay of the player upon a determination that the player is a member of a first tier of a player reward program, and wherein the player is automatically eligible for the comp, regardless of gameplay, upon a determination that the player is a member of a second tier of the player reward program.

38. The gaming device of claim 37, wherein said processor is configured to determine that the player is eligible for the comp based upon a determination that the player has reached a first comp tier.

39. The gaming device of claim 38, wherein said processor is programmed to determine that the player is automatically eligible to redeem the comp if said processor determines that the player has reached a second comp tier.

40. The gaming device of claim 39, wherein a first amount of comp eligibility points are earned from a first amount of gameplay of the player, and said processor is programmed to determine that the player has reached the first comp tier when the player has earned the first amount of comp eligibility points.

41. The gaming device of claim 40, wherein a second amount of comp eligibility points are earned from a second amount of gameplay of the player, and said processor is programmed to determine that the player has reached the second comp tier when the player has earned the second amount of comp eligibility points.

42. The gaming device of claim 40, wherein, upon a determination that the player has redeemed the comp, said processor is programmed to reduce the comp eligibility points accrued by the player by the first amount of comp eligibility points.

43. The gaming device of claim 37, wherein the comp is a first comp, and wherein the player becomes eligible for the first comp after accruing a first amount of comp eligibility points and becomes eligible for a second comp after accruing a second amount of comp eligibility points.

44. The gaming device of claim 37, wherein the comp is a first comp, and wherein the player becomes eligible for the first comp after accruing a first amount of comp eligibility points and becomes eligible for a second comp after accruing a second amount of comp eligibility points, and wherein upon a determination that the player has redeemed the second comp, said processor is programmed to reduce the comp eligibility points accrued by the player by the first amount of comp eligibility points and the second amount of comp eligibility points.

45. The gaming device of claim 37, wherein, upon a determination that the player has redeemed the comp, said processor is programmed to reduce accrued comp eligibility points by an associated amount of comp eligibility points.

46. The gaming device of claim 37, wherein said comp indicator comprises a comp indicator disposed on said gaming device, and wherein the comp indicator displays at least a first comp tier.

47. The gaming device of claim 37, wherein said comp indicator comprises at least a first comp tier displayed within the comp indicator having a plurality of sections, each section of the plurality of sections representing a different threshold of gameplay of the player.

48. The gaming device of claim 37, wherein said comp indicator is configured to display sections being filled in when an amount of gameplay of the player reaches corresponding thresholds for each section.

49. The gaming device of claim 37, wherein the player accrues comp eligibility points at a first rate if the player is determined to be a member of the first tier of the player reward program, and the player accrues comp eligibility points at a second rate if the player is determined to be a member of the second tier of the player reward program.

50. The gaming device of claim 37, further comprising a player tracking module configured to display said comp indicator.

51. The gaming device of claim 37, wherein the processor is further programmed to accrue comp eligibility points at a first rate if the player is determined to be a member of a first tier of a player reward program, and to accrue comp eligibility points at a second rate if the player is determined to be a member of a second tier of the player reward program, the second rate being higher than the first rate.

52. The gaming device of claim 37 wherein the first tier of the player reward program is lower than the second tier of the player reward program.

53. The gaming device of claim 37 wherein the indication that the player is eligible for the comp is provided via the payment output device.

54. The gaming device of claim 37 wherein the comp indicator comprises a light that is illuminated when the comp indicator is activated.

55. The gaming device of claim 37 further comprising a plurality of colored lights, wherein the comp indicator illuminates one of the plurality of colored lights based on the accrued comp eligibility points.

56. The gaming device of claim 37 wherein the comp indicator provides a comp notification that the player is eligible for the comp in response to determining that the player is eligible for the comp.

57. A gaming device, comprising:

a processor programmed to provide a game of chance to a player and to determine whether the player is eligible for a comp;

an electronic storage device configured to store gameplay data for the game of chance;

a user interface device configured to receive input from the player to enable the player to play the game of chance;

a payment input device configured to enable the player to input money or credits for use in the game of chance;

a payment output device configured to enable the player to withdraw money or credits from said gaming device;

a card reader device configured to receive data from a player reward card;

a randomization device configured to randomly determine a game outcome for the game of chance; and a comp indicator configured to be activated upon a determination that the player is eligible for a comp, wherein, upon a determination that the player has redeemed the comp, said processor is programmed to maintain accrued comp eligibility points earned by the player without reducing the comp eligibility points in response to the player redeeming the comp.

58. The gaming device of claim 57, wherein the processor is further programmed to accrue comp eligibility points at a first rate if the player is determined to be a member of a first tier of a player reward program, and causing the player to accrue comp eligibility points at a second rate if the player is determined to be a member of a second tier of the player reward program.

59. The gaming device of claim 57, wherein the player accrues comp eligibility points based on gameplay of the player upon a determination that the player is a member of a first tier of a player reward program, and wherein the player is automatically awarded the comp, regardless of gameplay, upon a determination that the player is a member of a second tier of the player reward program.

60. The gaming device of claim 57 wherein the processor is further programmed to accrue comp eligibility points at a higher rate if the player is determined to be a member of a player reward program.

61. A gaming device, comprising:

a processor programmed to provide a game of chance to a player and to determine whether the player is eligible for a comp;

an electronic storage device configured to store gameplay data for the game of chance;

a user interface device configured to receive input from the player to enable the player to play the game of chance;

a payment input device configured to enable the player to input money or credits for use in the game of chance;

a payment output device configured to enable the player to withdraw money or credits from said gaming device;

a card reader device configured to receive data from a player reward card;

a randomization device configured to randomly determine a game outcome for the game of chance; and a comp indicator configured to be activated upon a determination that the player is eligible for a comp, wherein the comp is a first comp, and wherein the player becomes eligible for the first comp after accruing a first amount of comp eligibility points and becomes eligible for a second comp after accruing a second amount of comp eligibility points, and wherein upon a determination that the player has redeemed the second comp, said processor is programmed to maintain a number of comp eligibility points earned by the player without reducing the comp eligibility points by the first amount of comp eligibility points or the second amount of comp eligibility points.

62. A gaming device, comprising:

a processor programmed to provide a game of chance to a player and to determine whether the player is eligible for a comp;

an electronic storage device configured to store gameplay data for the game of chance;

a user interface device configured to receive input from the player to enable the player to play the game of chance;

a payment input device configured to enable the player to input money or credits for use in the game of chance;

a payment output device configured to enable the player to withdraw money or credits from said gaming device;

a randomization device configured to randomly determine a game outcome for the game of chance; and a comp indicator configured to be activated upon a determination that the player is eligible for a comp, wherein the player accrues comp eligibility points based on a gameplay of the player upon a determination that the player is a member of a first tier of a player reward program, and wherein the player is automatically awarded the comp, regardless of gameplay, upon a determination that the player is a member of a second tier of the player reward program.

63. The gaming device of claim 62 wherein the processor is further programmed to accrue comp eligibility points in amounts that vary based on whether the player is a member of a player reward program and, if so, a player reward program status.

64. The gaming device of claim 62 wherein the processor is further programmed to accrue comp eligibility points at a first rate if the player is determined to be a member of a first tier of a player reward program, and to accrue comp eligibility points at a second rate if the player is determined to be a member of a second tier of the player reward program.

65. The gaming device of claim 62 wherein the processor is further programmed to determine that the player has redeemed the comp, and to continue accruing comp eligibility points without reducing the comp eligibility points in response to the player redeeming the comp.

* * * * *